US008002645B2

(12) United States Patent
Savarese et al.

(10) Patent No.: US 8,002,645 B2
(45) Date of Patent: Aug. 23, 2011

(54) APPARATUSES, METHODS AND SYSTEMS RELATING TO FINDABLE GOLF BALLS

(75) Inventors: Chris Savarese, Danville, CA (US); Lauro C. Cadorniga, Piedmont, SC (US); Forrest F. Fulton, Los Altos Hills, CA (US); Noel H. C. Marshall, Gerringong (AU); John Glissman, Valley Ford, CA (US); Kenneth P. Gilliland, Petaluma, CA (US); Marvin L. Vickers, Quincy, CA (US); Susan McGill, Redwood City, CA (US); Mark A. Shea, Los Gatos, CA (US); James C. Scheller, Jr., Los Altos, CA (US)

(73) Assignee: Radar Corporation, San Ramon, CA (US)

( * ) Notice: Subject to any disclaimer, the term of this patent is extended or adjusted under 35 U.S.C. 154(b) by 1667 days.

(21) Appl. No.: 11/264,177

(22) Filed: Oct. 31, 2005

(65) Prior Publication Data

US 2006/0128503 A1 Jun. 15, 2006

Related U.S. Application Data

(63) Continuation-in-part of application No. 10/346,919, filed on Jan. 17, 2003, now abandoned.

(51) Int. Cl.
*A63B 43/00* (2006.01)
*A63B 67/02* (2006.01)
*A63B 57/00* (2006.01)

(52) U.S. Cl. ..... 473/353; 473/155; 473/409

(58) Field of Classification Search ..... 473/155, 473/353, 409

See application file for complete search history.

(56) References Cited

U.S. PATENT DOCUMENTS 1,620,290 A 3/1927 Rubin (Continued)

FOREIGN PATENT DOCUMENTS

DE 87 09 503.3 U1 1/1988

(Continued)

OTHER PUBLICATIONS

Invitation to pay additional fees for PCT International Appln No. US04/001126, mailed Aug. 2, 2004 (5 pages).

(Continued)

*Primary Examiner* — David L Lewis
*Assistant Examiner* — William H McCulloch
(74) *Attorney, Agent, or Firm* — Blakely, Sokoloff, Taylor & Zafman LLP

(57) ABSTRACT

Golf ball locators and components of such locators and methods of operating such locators and processing signals within such locators. In one aspect of the inventions described herein, an exemplary method of initializing a golf ball locator includes receiving received RF signals while also transmitting signals used to locate balls and determining a parameter representative of received signal strength of the received RF signals and setting a threshold to determine when subsequent received signals are to cause an indication of golf ball detection. In another aspect of this disclosure, the golf ball locator is a handheld unit having a volume of less than about 150 inches cubed and includes a transmitter, a transmit antenna, a receiver, a receive antenna and a processor coupled to the transmitter and to the receiver, and the handheld unit achieves a signal isolation, between a second harmonic of a transmitted signal from the transmitter and the receiver's received signal, of greater than about 130 to 160 dB. Other aspects are also described.

4 Claims, 46 Drawing Sheets

U.S. PATENT DOCUMENTS

| | | | | | |
|---|---|---|---|---|---|
| 3,351,347 | A | * | 11/1967 | Smith et al. | 473/199 |
| 3,458,205 | A | * | 7/1969 | Douglas et al. | 473/199 |
| 3,782,730 | A | * | 1/1974 | Horchler | 473/353 |
| 4,331,957 | A | | 5/1982 | Enander et al. | |
| 4,528,566 | A | | 7/1985 | Tyler | |
| 4,595,200 | A | | 6/1986 | Shishido | |
| 4,660,039 | A | * | 4/1987 | Barricks et al. | 342/27 |
| 4,698,781 | A | | 10/1987 | Cockerell, Jr. | |
| 4,742,357 | A | * | 5/1988 | Rackley | 342/457 |
| 4,799,062 | A | * | 1/1989 | Sanderford et al. | 342/450 |
| 4,955,613 | A | | 9/1990 | Gendreau et al. | |
| 5,056,106 | A | * | 10/1991 | Wang et al. | 375/130 |
| 5,112,055 | A | | 5/1992 | Barnhill | |
| 5,132,622 | A | | 7/1992 | Valentino | |
| 5,216,429 | A | * | 6/1993 | Nakagawa et al. | 342/45 |
| 5,298,904 | A | | 3/1994 | Olich | |
| 5,423,549 | A | * | 6/1995 | Englmeier | 473/353 |
| 5,447,314 | A | * | 9/1995 | Yamazaki et al. | 473/353 |
| 5,448,599 | A | * | 9/1995 | Gunmar | 375/130 |
| 5,487,542 | A | | 1/1996 | Foley | |
| 5,508,350 | A | | 4/1996 | Cadorniga et al. | |
| 5,538,794 | A | | 7/1996 | Cadorniga et al. | |
| 5,564,698 | A | | 10/1996 | Honey et al. | |
| 5,582,550 | A | | 12/1996 | Foley | |
| 5,586,950 | A | | 12/1996 | Endo | |
| 5,626,531 | A | * | 5/1997 | Little | 473/353 |
| 5,662,534 | A | | 9/1997 | Kroll et al. | |
| 5,663,734 | A | * | 9/1997 | Krasner | 342/357.12 |
| 5,668,828 | A | * | 9/1997 | Sanderford et al. | 375/136 |
| 5,743,815 | A | * | 4/1998 | Helderman | 473/353 |
| 5,820,484 | A | | 10/1998 | Terry | |
| 5,910,057 | A | | 6/1999 | Quimby et al. | |
| 6,024,655 | A | * | 2/2000 | Coffee | 473/407 |
| 6,067,039 | A | * | 5/2000 | Pyner et al. | 342/125 |
| 6,107,920 | A | | 8/2000 | Eberhardt et al. | |
| 6,113,504 | A | * | 9/2000 | Kuesters | 473/353 |
| 6,204,813 | B1 | * | 3/2001 | Wadell et al. | 342/463 |
| 6,236,360 | B1 | * | 5/2001 | Rudow et al. | 342/357.13 |
| 6,246,327 | B1 | | 6/2001 | Eberhardt | |
| 6,263,279 | B1 | * | 7/2001 | Bianco et al. | 701/213 |
| 6,276,266 | B1 | | 8/2001 | Dietz et al. | |
| 6,284,840 | B1 | | 9/2001 | Rajagopalan et al. | |
| 6,357,664 | B1 | | 3/2002 | Zercher | |
| 6,390,935 | B1 | | 5/2002 | Sugimoto | |
| 6,483,427 | B1 | * | 11/2002 | Werb | 340/10.1 |
| 6,620,057 | B1 | * | 9/2003 | Pirritano et al. | 473/353 |
| 6,634,959 | B2 | * | 10/2003 | Kuesters | 473/353 |
| 6,705,942 | B1 | | 3/2004 | Crook et al. | |
| 6,762,244 | B2 | | 7/2004 | Rajagopalan et al. | |
| 6,840,167 | B2 | | 1/2005 | Clark et al. | |
| 6,908,404 | B1 | * | 6/2005 | Gard | 473/407 |
| 7,059,974 | B1 | * | 6/2006 | Golliffe et al. | 473/351 |
| D530,766 | S | * | 10/2006 | Savarese et al. | D21/789 |
| 7,486,591 | B2 | * | 2/2009 | Rooney et al. | 367/137 |
| 7,691,009 | B2 | * | 4/2010 | Savarese et al. | 473/353 |
| 7,766,766 | B2 | * | 8/2010 | Savarese et al. | 473/351 |
| 2001/0006489 | A1 | | 7/2001 | Gaffney | |
| 2001/0045904 | A1 | | 11/2001 | Silzer, Jr. | |
| 2001/0053176 | A1 | * | 12/2001 | Fry et al. | 375/133 |
| 2002/0004723 | A1 | | 1/2002 | Meifu et al. | |
| 2002/0082120 | A1 | | 6/2002 | McLaughlin | |
| 2002/0091017 | A1 | * | 7/2002 | Kuesters | 473/353 |
| 2002/0098913 | A1 | * | 7/2002 | Goldman | 473/353 |
| 2002/0177490 | A1 | * | 11/2002 | Yong et al. | 473/353 |
| 2003/0008727 | A1 | | 1/2003 | Miller | |
| 2003/0017884 | A1 | | 1/2003 | Masters et al. | |
| 2003/0106634 | A1 | | 6/2003 | Adkins et al. | |
| 2003/0191547 | A1 | | 10/2003 | Morse | |
| 2004/0014536 | A1 | * | 1/2004 | Kuesters | 473/353 |
| 2004/0058749 | A1 | * | 3/2004 | Pirritano et al. | 473/353 |
| 2004/0085209 | A1 | * | 5/2004 | Schmidt et al. | 340/573.4 |
| 2004/0142766 | A1 | | 7/2004 | Savarese et al. | |
| 2004/0203289 | A1 | * | 10/2004 | Ice et al. | 439/607 |
| 2004/0206527 | A1 | * | 10/2004 | Yokota | 174/35 R |
| 2005/0070375 | A1 | | 3/2005 | Savarese et al. | |
| 2005/0070376 | A1 | | 3/2005 | Savarese et al. | |
| 2005/0085316 | A1 | * | 4/2005 | Barr | 473/353 |
| 2006/0122007 | A1 | * | 6/2006 | Savarese et al. | 473/351 |
| 2006/0128503 | A1 | * | 6/2006 | Savarese et al. | 473/353 |
| 2007/0155520 | A1 | * | 7/2007 | Savarese et al. | 473/131 |
| 2007/0259740 | A1 | * | 11/2007 | Savarese et al. | 473/409 |
| 2008/0207357 | A1 | * | 8/2008 | Savarese et al. | 473/407 |
| 2009/0314423 | A1 | * | 12/2009 | Savarese et al. | 156/276 |

FOREIGN PATENT DOCUMENTS

| | | | |
|---|---|---|---|
| DE | 39 26 684 | A1 | 2/1991 |
| DE | 100 57 670 | C1 | 3/2002 |
| EP | 1 035 418 | A1 | 9/2000 |
| FR | 2667 510 | A | 4/1992 |
| GB | 2395 438 | A | 5/2004 |
| JP | 2003085510 | A | 3/2003 |
| JP | 2003158414 | A | 5/2003 |
| WO | WO 01/02060 | A1 | 1/2001 |
| WO | WO 01/02061 | A1 | 1/2001 |
| WO | WO 03/068874 | A1 | 8/2003 |

OTHER PUBLICATIONS

PCT Search Report and Written Opinion for PCT International Appln No. US2004/027597, mailed Nov. 19, 2004 (13 pages).

PCT Search Report and Written Opinion for PCT International Appln No. US2004/027598, mailed Dec. 7, 2004 (13 pages).

PCT Search Report and Written Opinion for PCT International Appln No. US2004/001126, mailed Mar. 31, 2005 (21 pages).

PCT International Preliminary Report on Patentability for PCT International Appln No. US2004/001126, mailed Aug. 4, 2005 (14 pages).

PCT International Preliminary Report on Patentability for PCT International Appln No. US2004/027598, mailed Apr. 6, 2006 (8 pages).

PCT International Preliminary Report on Patentability for PCT International Appln No. US2004/027597, mailed Apr. 6, 2006 (8 pages).

PCT Search Report and Written Opinion for PCT International Appln No. US2006/039416, mailed Jan. 29, 2007 (14 pages).

PCT International Preliminary Report on Patentability for PCT International Appln No. US2006/039416, mailed Apr. 24, 2008 (8 pages).

PCT International Preliminary Report on Patentability for PCT International Appln No. US2004/027598, mailed Apr. 6, 2006 (8 pages).

PCT International Preliminary Report on Patentability for PCT International Appln No. US2004/027597, mailed Apr. 6, 2006 (8 pages).

* cited by examiner

| Point | Pitch | Pulse Rate | RSSI |
|---|---|---|---|
| A | 280 Hz | 2 beeps/sec | 1 |
| B | 320 | 4 | 2 |
| C | 360 | 6 | 3 |
| D | 400 | 8 | 4 |
| E | 440 | 10 | 5 |
| F | 460 | 12 | 7 |
| G | 460 | 12 | 8 |
| H | 460 | 12 | 9 |
| I | 460 | 12 | 11 |
| J | 480 | 14 | 14 |
| K | 510 | 16 | 15 |
| L | 560 | 20 | 16 |

| Agree (A) | Disagree (D) | A – D |
|---|---|---|
| 0 | 0 | 0 |
| 0 | 1 | -1 |
| 1 | 1 | 0 |
| 1 | 2 | -1 |
| 2 | 2 | 0 |
| 2 | 3 | -1 |
| 3 | 3 | 0 |
| 7 | 0 | 7 |
| 3 | 3 | 0 |
| 2 | 3 | -1 |
| 2 | 2 | 0 |
| 1 | 2 | -1 |
| 1 | 1 | 0 |
| 0 | 1 | -1 |
| 0 | 0 | 0 |

APPARATUSES, METHODS AND SYSTEMS RELATING TO FINDABLE GOLF BALLS

This application is a continuation-in-part of prior U.S. patent application Ser. No. 10/346,919, filed on Jan. 17, 2003 now abandoned.

FIELD OF THE INVENTION

The inventions relate to sports, such as golf, and more particularly to golf balls, methods for making golf balls and systems for use with golf balls.

BACKGROUND OF THE INVENTION

Golf balls are often lost when people play golf. The loss of the ball slows down the game as players search for a lost ball, and lost balls make the game more expensive to play (because of the cost of new balls). Furthermore, according to the rules of the U.S. Golf Association, a player is penalized for strokes in a round or game of golf if his/her golf ball is lost.

There have been attempts in the past to make findable golf balls in order to avoid some of the problems caused by lost balls. One such attempt is described in German patent number G 87 09 503.3 (Helmut Mayer, 1988). In this German patent, a two piece golf ball is fitted with foil reflectors which are glued to the outer layer of the core. A shell surrounds the foil reflectors and the core. Each of the reflectors consists of a two part foil antenna with a diode connected on the inner ends. The diode causes a reflected signal to be double the frequency of a received signal. A 5 watt transmitter, which is used to beam a signal toward the reflectors, is used to find the ball. The ball is found when a reflected signal is generated by the foil antenna and diode and reflected back toward a receiver. The arrangement of the reflectors and diodes on the ball in this German patent causes the ball to have poor durability and also makes the ball difficult and expensive to manufacture. The impact of a club head hitting such a ball will rapidly cause the ball to rupture due to the interruption of the shell/core interface by the foil reflectors. Furthermore, the presence of the reflectors at this interface will negatively affect the driving distance of such a ball.

Another attempt in the art to make a findable golf ball is described in PCT patent application No. WO 0102060 A1 which describes a golf ball for use in a driving range. This golf ball includes an active Radio Frequency Identification Device (RFID) which identifies a particular ball. The RFID includes an active (e.g., contains transistors) ASIC chip which is energized from the received radio signal. The RFID device is mounted in a sealed capsule which is placed within the core of the ball. The RFID device is designed to be used only at short range (e.g., less than about 10 feet). The use of a sealed capsule to hold the RFID within the ball increases the expense of making this ball.

Other examples of attempts in the prior art to make findable golf balls include: U.S. Pat. Nos. 5,626,531; 5,423,549; 5,662,534; and 5,820,484.

SUMMARY OF THE DESCRIPTION

Various golf ball locators or detectors are described as well as methods of operating and using such devices.

In one exemplary embodiment according to one aspect of the inventions, a method of processing signals in a golf ball detector, which includes a transmitter and receiver, includes: receiving received radio frequency signals while the transmitting occurs; determining a parameter representative of a received signal strength (RSSI) of the received radio frequency signals; and setting a threshold for received signals to indicate golf ball detection, the threshold being set based upon the parameter (which may be a measurement of RSSI). This method may be used to initialize the golf ball detector such that subsequently received radio frequency signals having received signal strengths which are less than the received signal strength obtained during initialization (when both the transmitter and the receiver were operating) will not produce an indication, from a user interface of the golf ball detector, of golf ball detection. In other words, the threshold becomes a baseline for future received signal strength comparisons. If future received signal strengths are less than the threshold, then the golf ball detector decides that a golf ball has not been detected; thus, in this exemplary embodiment, golf ball detections are only indicated to the user through a user interface when the received signal strength exceeds the threshold. The threshold may include the measurement of RSSI and a small "buffer" amount of RSSI added to the measurement of the RSSI. This allows the golf ball locator to be adjusted for interference within the handheld device itself, and also allows for adjustments over time due to changes within a handheld device, such as changes resulting from aging of components, or damage to internal components through water exposure, etc. Further exemplary embodiments of this method include positioning, prior to the determining of the parameter which is representative of received signal strength, the golf ball detector to reduce the chance of a reception of an RF signal from a golf ball having an RF circuit. This positioning is typically performed while the receiving and transmitting is also occurring. This positioning may include aiming the handheld unit directly overhead (e.g. toward the sky) or directly below where there should be no golf balls having RF circuits. In alternative embodiments, the transmitter, as part of an initialization process, may be intentionally aimed at an interfering object in order to cancel the effect of the interfering object.

According to another aspect of the inventions described herein, a handheld golf ball locator has a housing which is small enough to be easily held by a person's hand (e.g. may be less than 12"×6"×4" or preferably less than 9"×5"×3") and contain a transmitter in the housing and a receiver in the housing and also achieve a signal isolation between a second harmonic of a transmitted signal from the transmitter and the receiver's received signal being greater than about 130-160 dB. In certain embodiments, the housing also includes a transmitter antenna which is coupled to the transmitter and a receiver antenna which is coupled to the receiver where both the transmitter and receiver antennas are contained within the housing. This level of isolation may be achieved by a combination of attributes, including: enclosing the transmitter subassembly and the receiver subassembly in separate shielded enclosures in the housing; the use of coplanar stripline circuitry and internal ground planes in the printed circuit boards of the transmitter and receiver subassemblies; soldered onboard shields; soldered radio frequency cable connections; the use of ferrite beads over all of the cables which enter and exit the RF housings; avoiding unintentional bimetallic contact; and the use of tin plating on soldered connections in any region where there is a high current at the transmitting frequencies (e.g. the tin plating is done to avoid any intermetallic contacts between two different types of metallic materials).

According to another aspect of the inventions described herein, an exemplary method of an embodiment for locating a golf ball with a handheld golf ball detector includes: modulating a carrier to provide a spread-spectrum binary phase shift keyed (BPSK) modulated signal, where the modulation includes a pseudorandom binary sequence (also known as a pseudonoise, or PN code) modulated on the carrier; transmitting the BPSK modulated signal in transmitted pulses to locate a golf ball having an RF circuit; and receiving, as a received signal from the RF circuit, a harmonic of the transmitted signal. In certain embodiments, the received signal may be despread by the ball's RF circuit, the harmonic is a 2× harmonic and a single crystal is used to generate a reference frequency for both the transmitting and the receiving.

According to other aspects of the inventions described herein, an exemplary method of indicating a distance to a golf ball from a handheld golf ball locator includes: generating a first set of audio sounds at a first pitch and at a first rate of repetition when at a first distance; generating a second set of audio signals at a second pitch and at a second rate of repetition when at a second distance. In certain implementations of this exemplary embodiment, the first set and the second set of audio sounds are related such that the first distance is larger than the second distance and the first pitch is lower than the second pitch and the first rate is slower than the second rate, and higher pitches and faster rates of repetition indicate shorter distances to the golf ball.

According to other aspects of the inventions described herein, an exemplary method of indicating the distance to a golf ball from a handheld golf ball locator includes: presenting a first user interface which indicates distance between the golf ball locator and the golf ball and which changes at least at a first rate, with changes in distance, over a first range of a representation of distance; and presenting a second user interface which indicates distance between the golf ball locator and the golf ball and which changes at least at a second rate, with changes in distance, over a second range of the representation of distance. In one implementation of this exemplary method, the representation of distance is received signal strength and in an alternative implementation the representation is a measure of distance from a ranging operation which relies upon determining the time of travel of the signals between the ball and the handheld locator. This exemplary method may be used to provide more rapid feedback to the user by making more rapid changes in the user interface when the user is further from the ball, such as when the user is in the beginning stages of searching for the ball and provides a slower rate of change in the user interface as the user approaches the ball. In certain embodiments, the user interface may change at three different rates or at a different number of rates. It is anticipated that users may desire more help from a more rapidly changing user interface at the beginning stages of a search for a golf ball in order to ensure the golfer begins walking in the proper direction relative to a stationary golf ball which may be detected using the harmonic radar techniques described herein.

According to another aspect of the inventions described herein, an exemplary method of locating a stationary golf ball with a handheld golf ball locator includes: transmitting, from a transmitter of the handheld golf ball locator, signals to be received by an RF circuit of the golf ball; and processing an output from a receiver of the handheld golf ball locator, the processing occurring at times that are separated by time periods between processings, the time periods either being different or random in length. Typically, no processing of the output from the receiver occurs during the time periods, where this processing is processing for the purposes of determining a distance to the stationary golf ball. In certain implementations of this method, the transmitter may transmit at random times which are synchronized with the processing of outputs from the receiver, where these random times are measured relative to a time marker of repeating time intervals.

According to another aspect of the inventions described herein, an antenna assembly used to locate golf balls includes a first antenna having a first plane to receive electromagnetic energy at a first frequency, the first antenna having a boresight substantially perpendicular to the first plane, a second antenna having a second plane disposed substantially parallel to the first plane, to radiate electromagnetic energy through the first plane at a second frequency, the second antenna having a second boresight substantially perpendicular to the first plane, and including a first ground plane with respect to the first antenna, and a second ground plane disposed substantially parallel to the second plane, the second antenna disposed between the first antenna and the second ground plane. A method for using an antenna system such as this is also described and further features of various antenna systems for use in a golf ball locator are also described herein.

According to other aspects of the inventions described herein, methods for determining the distance between a handheld golf ball locator and a golf ball are described in which ranging determinations are made based upon measurements relating to the time of travel of signals between the golf ball and the handheld locator.

Other embodiments of golf ball detectors and locators are also described, and other features and embodiments of various aspects of the various inventions will be apparent from this description.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

The present invention is illustrated by way of example and not limitation in the figures of the accompanying drawings in which like references indicate similar elements.

DETAILED DESCRIPTION

Various embodiments and aspects of the invention will be described with reference to details set below, and the accompanying drawings will illustrate the invention. The following description and drawings are illustrative of the invention and are not to be construed as limiting the invention. Numerous specific details such as sizes and weights and frequencies are described to provide a thorough understanding of various embodiments of the present invention. However, in certain instances, well-known or conventional details are not described in order to not unnecessarily obscure the present invention in detail.

Figure 1A:
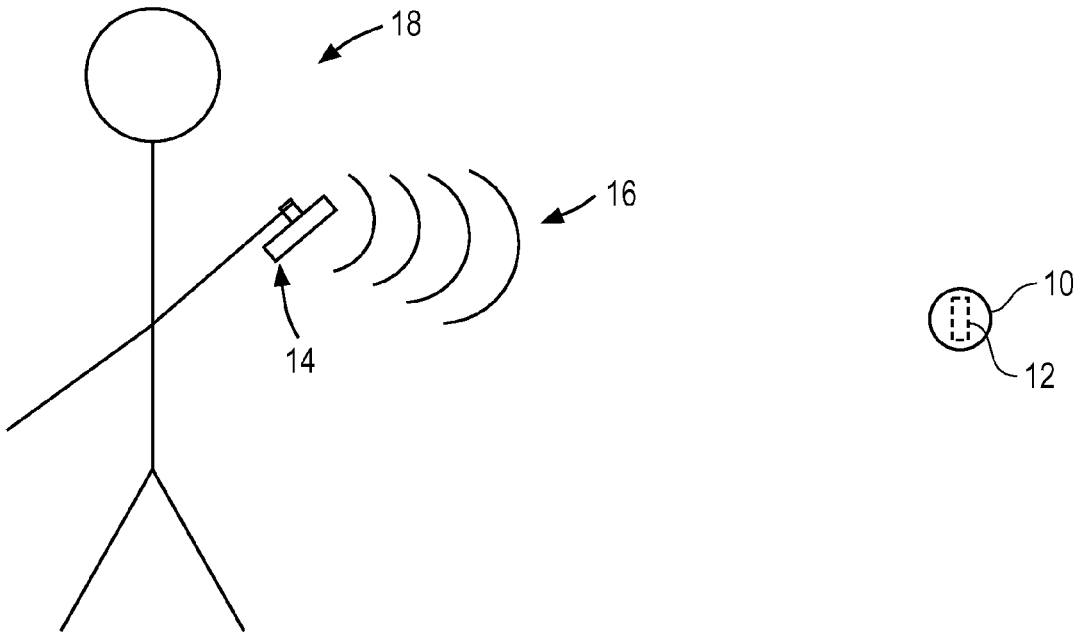
FIG. 1A shows a system for finding a golf ball according to one embodiment of the present inventions.

FIG. 1A shows an example of the system which uses a handheld transmitter/receiver to find a findable golf ball. A person 18 such as a golfer, may carry a handheld transmitter/receiver which is designed to locate a findable golf ball 10 which includes a tag 12 embedded in the golf ball. The handheld transmitter/receiver 14 may operate as a radar system which emits an electromagnetic signal 16 which then can be reflected by the tag 12 back to the transmitter/receiver which can then receive the reflected signal in a receiver in the handheld unit 14. Various different types of tags, such as tag 12, are described further below for use in the golf ball 10. These tags typically include an antenna and a diode coupled to the antenna. The diode serves to double the frequency of the reflective signal (or to provide another harmonic of the received signal), which makes it easier for the receiver to detect and find a golf ball as opposed to another object which has reflected the emitted signal without modifying the frequency of the emitted signal. The center of gravity (and symmetry) of a ball with a tag is substantially the same as a ball without a tag. The tag in certain embodiments is of such a weight and size so that the resulting ball containing the tag has the same weight and size as a ball which complies with the United States Golf Association specifications or the specifications of the Royal & Ancient Golf Club of St. Andrews ("R&A"). Furthermore, in certain embodiments, a ball with a tag has the same performance characteristics (e.g. initial velocity) as balls which were approved for use by the United States Golf Association or the R&A.

Figure 1B:
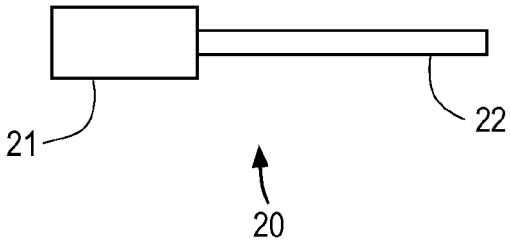
FIGS. 1B and 1C show one embodiment of a handheld golf ball detector or locator.
Figure 1C:
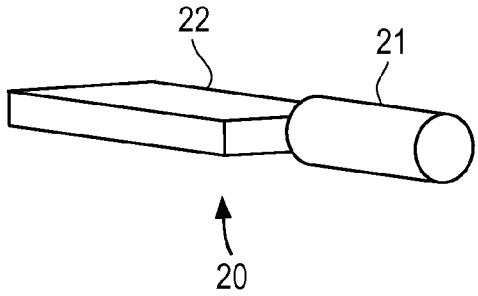

The handheld unit 14 shown in FIG. 1A may have the form shown in FIGS. 1B and 1C and other alternative forms are also described below and shown in other figures. This form, shown in FIGS. 1B and 1C, is one example of many possible forms for a handheld unit. This handheld device is typically a small device having a cylindrical handle which may be 4-5 inches long, and may have a diameter of approximately 1.5 inches. The cylindrical handle, such as handle 21, is attached to a six-sided solid which includes an antenna, such as the antenna casing 22 shown in FIGS. 1B and 1C. FIG. 1B is a side view of a handheld transmitter/receiver which may be used in certain embodiments of the present invention. FIG. 1C is a perspective view of a handheld unit shown in FIG. 1B. The handheld unit is preferably compliant with all regulations of the Federal Communications Commission and is battery powered. The batteries may be housed in the handheld 21, and they may be conventional AA or AAA batteries which may be placed into the handle (or handheld) by a user or they may be rechargeable batteries which can be recharged either through the use of an AC wall/house socket or a portable rechargeable unit (e.g. in a golf cart). In order to comply with regulations of the Federal Communications Commission (FCC) or other applicable governmental regulations regarding radio equipment, the handheld may emit pulsed (or non-pulsed) radar with a power that is equal to or less than 1 watt. In certain embodiments, the handheld unit may emit through its transmitter pulsed radar signals up to 1 watt maximum peak power and up to 4 watts effective isotropic radiated power (EIRP). Thus, the handheld unit for locating golf balls may be sold to and used by the general public in the United States. Several embodiments of handheld transmitters/receivers are described further below. At least some of these embodiments may be sold to and used by the general public in countries other than the United States because the embodiments meet regulatory requirements of those countries. For example, a handheld unit for use and sale in the European Union will normally be designed and manufactured to meet the CE marking requirements and the National Spectrum Authority requirements per the R&TTE (Radio and Telecommunications Terminal Equipment) Directive.

Figure 2A:
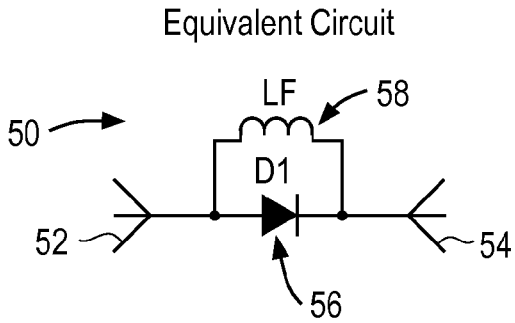
FIG. 2A is an electrical schematic which illustrates an embodiment of a circuit for a tag according to one aspect of the inventions.
Figure 2B:
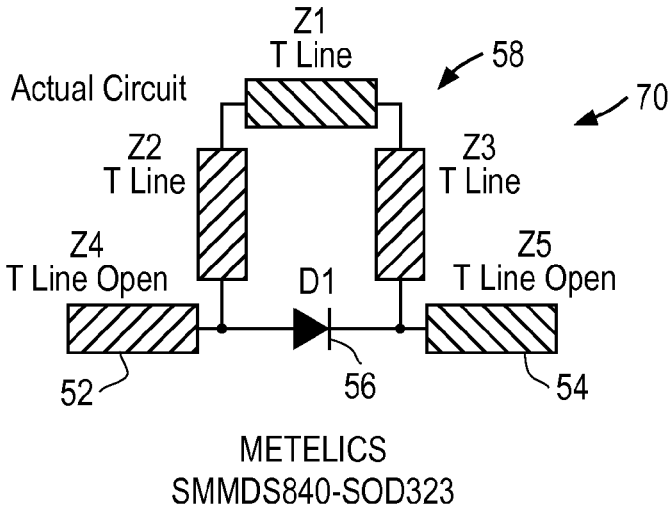
FIG. 2B shows a structural representation of the circuit of FIG. 2A.

FIG. 2A shows an electrical schematic of a tag according to one embodiment. The circuit of the tag 50 includes an antenna having two portions 52 and 54. The portion 52 is coupled to one end of the diode 56, and the portion 54 is coupled to the other end of the diode 56. A transmission line 58 which includes an inductor is coupled in parallel across the diode 56 as shown in FIG. 2A. The diode 56 is designed to double the received frequency so that the reflected signal from the tag is twice (or some harmonic) of the received signal. It will be appreciated that the double harmonic described herein is one particular embodiment, and alternative embodiments may use different harmonics or multiples of the received signal. FIG. 2B shows a structural representation of the circuit of FIG. 2A. In particular, FIG. 2B shows the antenna portions 52 and 54 coupled to their respective ends of the diode 56 which is in turn coupled in parallel to a transmission line 58. In one embodiment of the circuit 70, the diode 56 may be a diode from Metelics Corporation, part number SMND-840 or part number SMSD3004, which are available in a package referred to as an SOD323 package. The circuits shown in FIGS. 2A and 2B may be implemented in structures that have various different shapes and configurations as will be apparent from the following description. Further information about tags on golf balls and about golf balls containing tags can be found in co-pending U.S. patent application Ser. No. 10/672,365, filed Sep. 26, 2003 by inventors Chris Savarese, Noel Marshall, Forrest Fulton, Mark Shea, Lauro Cadorniga, Susan McGill, and Gerald Latus and entitled "Apparatuses and Methods Relating to Findable Balls." This application is published as U.S. published Patent Application No. 20050070375, which application is incorporated herein by reference. Also, further information about such tags and such golf balls can be found in U.S. patent application Ser. No. 11/248,766, filed Oct. 11, 2005, by inventors Chris Savarese, Noel H. C. Marshall, Lauro C. Cadomiga, Susan McGill, and Harold W. Ng and entitled "Methods and Apparatuses Relating to Findable Balls".

Figure 3A:
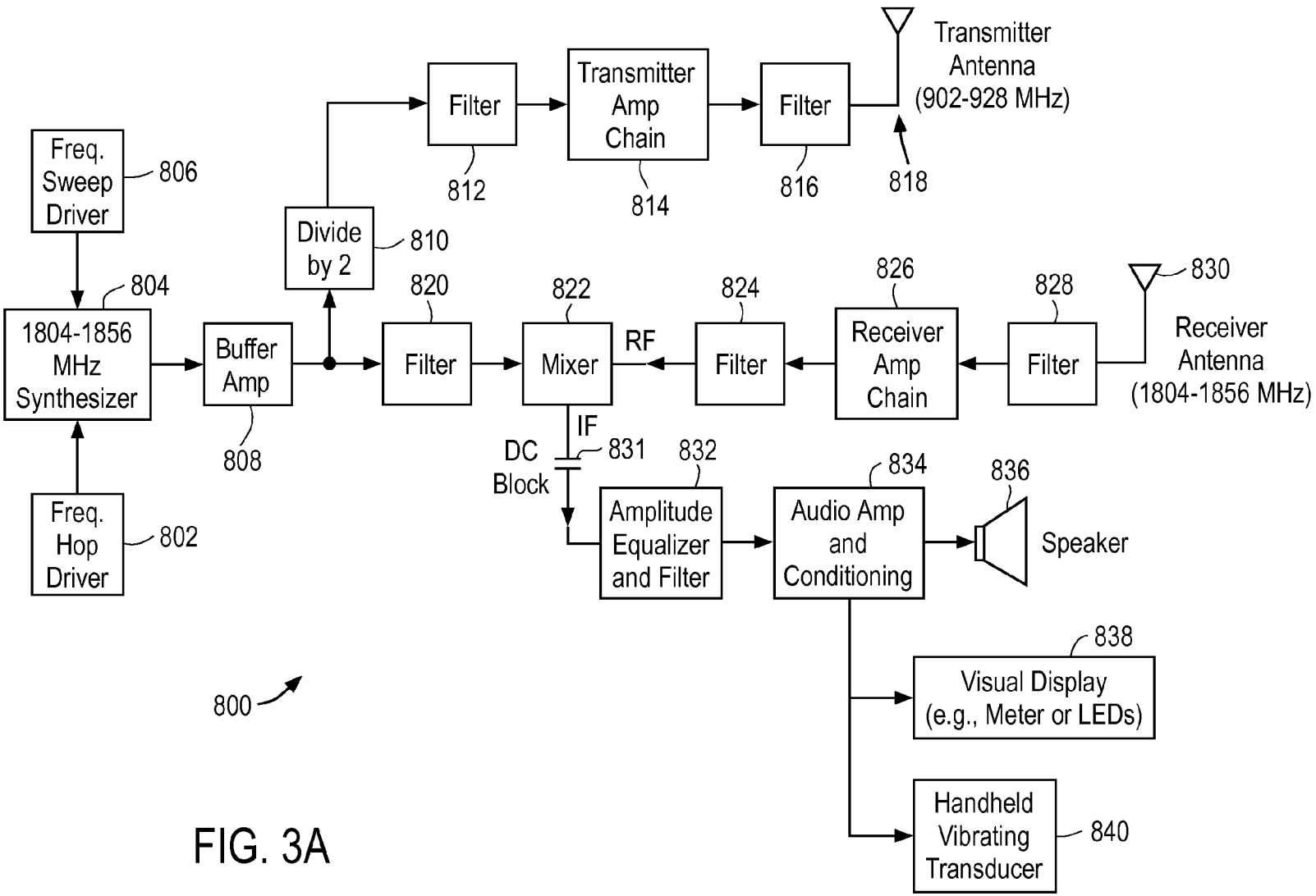
FIGS. 3A, 3B, 3C, 3D and 3E illustrate various different embodiments of a handheld golf ball locator which includes both a transmitter and a receiver.
Figure 3B:
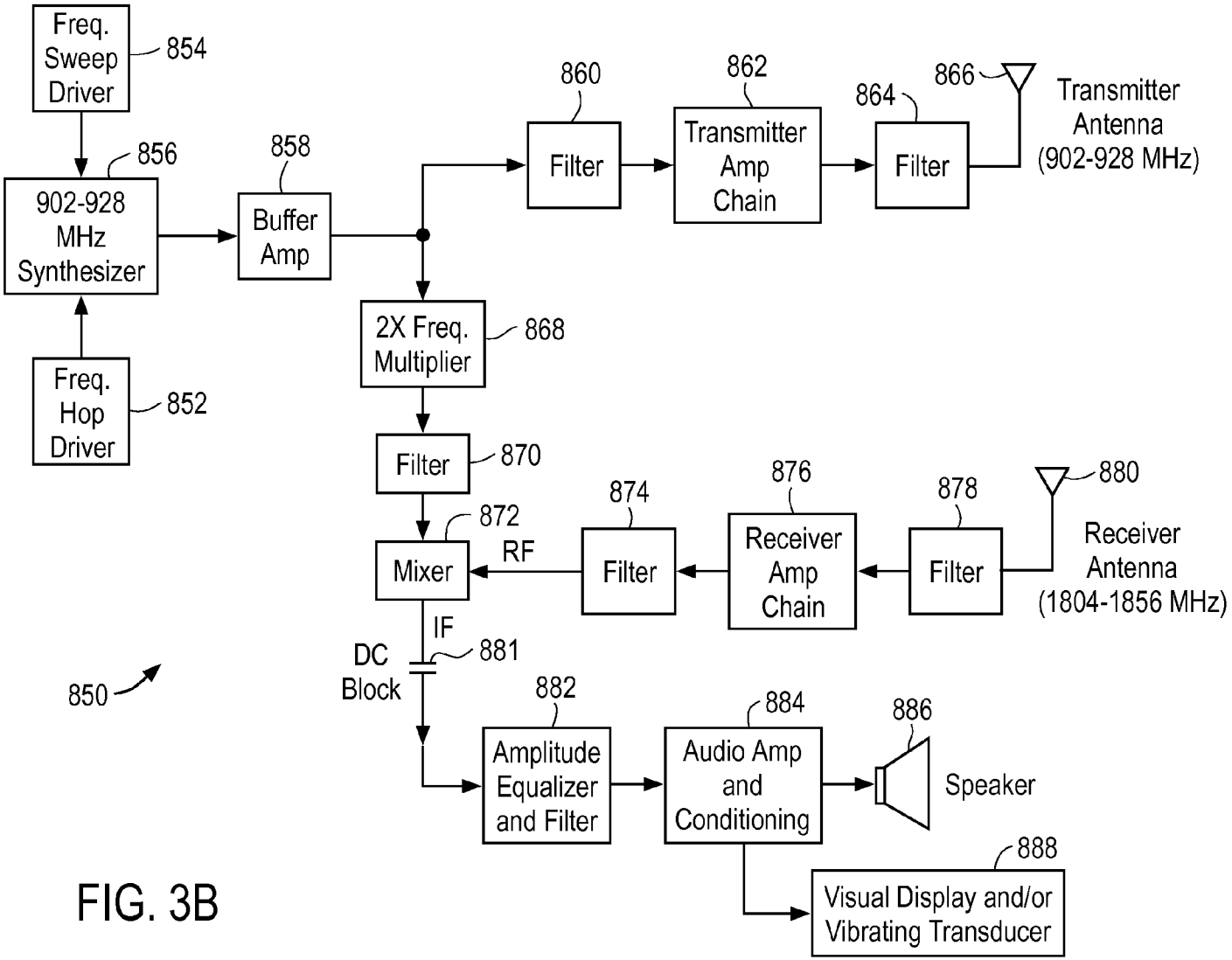
Figure 3C:
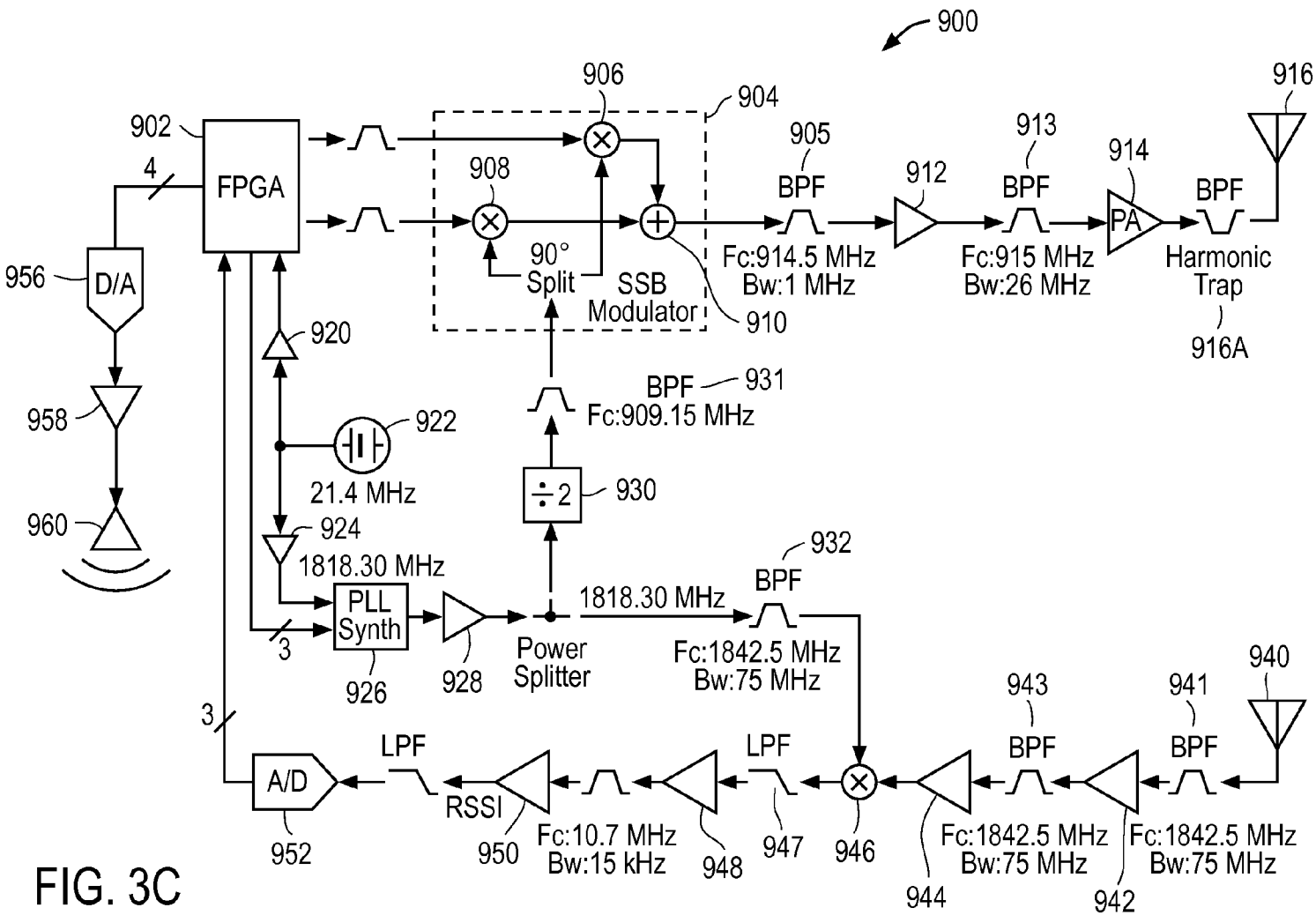

A description of various embodiments of a handheld transmitter/receiver which may be used as the handheld unit 14 of FIG. 1A will now be provided in conjunction with FIGS. 3A, 3B and 3C. In the exemplary embodiments of FIGS. 3A, 3B and 3C, the handheld unit consists of a battery powered transmitter and antenna radiating the radio frequency signal in the 902-928 MHz band, and an antenna and a receiver operating over the 1804-1856 MHz band, and an audio and visual interface to the user of the handheld unit. The audio interface may optionally be an earphone rather than a speaker, and as an option, the handheld unit may utilize a vibrating transducer to alert the user to the presence of a ball. A visual display such as a meter or a string of LEDs may also provide a proximity measure to the user so that the user can tell whether or not the user is getting closer to the ball or further from the ball as the user walks around searching for the ball.

The handheld unit 800 shown in FIG. 3A includes a battery powered transmitter and battery powered receiver and an audio and visual interface. The implementation shown in FIG. 3A uses a frequency-hopping transmitted signal that complies with the Federal Communications Commission Rules Part 15.247 for intentional radiators. The radio frequency transmitted signal originates in the synthesizer 804 which is an oscillator at twice the transmitted frequency which receives a frequency sweeping sawtooth modulation from a sweep driver 806. The synthesizer 804 also receives a control from the hopping-implementing synthesizer driver 802 which causes the synthesizer to hop from frequency to frequency within the band 1804-1856 MHz. The output from the synthesizer 804 is amplified by the buffer amplifier 808 and directed to a divide-by-two divider 810, the output of which is directed to a filter 812. The output from the filter 812 is directed to a transmitter amplifier chain 814 which provides an output to a filter 816 which in turn provides an output to the transmitter antenna 818, thereby transmitting the radio frequency signal in the range of 902-928 MHz. The transmitter antenna is moderately directive and produces the radiated signal which can be reflected by a tag in a lost golf ball. The diode in the tag causes the reflected signal to have double of the frequency of the received signal, which received signal was emitted by the transmitter antenna. The proximity of the handheld unit to the golf ball will in large part determine the magnitude/intensity of the reflected signal which can then be indicated by one of the user interfaces such as the speaker or earphones or visual display or the vibrating transducer in the handheld unit.

The receiver of the handheld unit 800 includes a moderately directive receiver antenna 830 which receives the reflected second harmonic signal produced by the diode in the lost golf ball. This received signal is filtered in filter 828 which provides the filtered output to a receiver amplifier chain 826 which amplifies the filtered signal, which is then outputted to a further filter, filter 824, the output of which is directed to a mixer 822. The mixer 822 also receives the filtered output of the amplifier 808 through the filter 820. The output of the mixer 822 is an audio frequency difference product of the second harmonic of the frequency swept transmitter signal, and the signal received from the frequency-doubling tag within the ball. The audio frequency difference product has a pitch that is determined by the sweeping of the transmitter frequency and the time delay between the transmitted and received signals. Thus, the pitch of the audio frequency difference product provides an indication of the distance between the handheld unit and the lost golf ball. The audio frequency difference product from the mixer is provided through a DC block 831 which provides the output (filtered for DC level) to an amplitude equalizer and filter 832 which provides an output to an audio amplifier and conditioner 834 which drives the speaker 836. A visual display 838 is also coupled to the amplifier and conditioner 834 to provide a visual display of the proximity of the golf ball and then optional handheld vibrating transducer 840 may provide a vibrating output, the intensity of the vibration increasing as the ball approaches the handheld unit. It will be appreciated that any particular handheld unit may have one or more of these indicators. For example, it may have only a speaker or a headphone output or it may have only a visual display or only a vibrating display or it may have two or more of these outputs.

The handheld unit 850 of FIG. 3B is similar in structure and operation to the handheld unit 800 except that the frequency synthesizer 856 operates in the band 902-928 MHz rather than double that frequency as in the case of synthesizer 804. Accordingly, there is no divide-by-two divider in the handheld unit 850 but rather there is a 2× frequency multiplier 868 in the handheld unit 850. The handheld unit 850 is an implementation that uses a frequency-hopping transmitted signal that complies with the FCC Rules Part 15.247 for intentional radiators. The radio frequency transmitted signal originates in the frequency synthesizer 856 which is an oscillator at the transmitted frequency which receives a frequency sweeping sawtooth modulation from a sweep driver 854. The synthesizer 856 is controlled by a frequency hop driver 852. The oscillator output from synthesizer 856 is amplified by the buffer amplifier 858 which provides an output to the filter 860 and an output to the frequency doubler 868. The output from the amplifier 858 is filtered in filter 860 and amplified in the transmitter amplifier chain 862 and then filtered in filter 864 to produce a transmitted signal which is transmitted from the moderately directive transmitter antenna 866 in the band of 902-928 MHz. This transmitted signal may be reflected by a tag, causing a reflected signal at a double harmonic (twice the frequency) of the received signal from the transmitter antenna. The receiving antenna 880 picks up this reflected second harmonic and provides this received signal to the filter 878 which provides an output to a receiver amplifier chain 876 which provides an output to a filter 874. Thus the received signal is filtered and amplified and provided as an RF input to the mixer 872 which also receives a filtered input from the 2× frequency multiplier 868. The mixer 872 produces at its output an audio frequency difference product of the second harmonic of the frequency swept transmitter signal and the signal received from the frequency-doubling tag within the ball. The audio frequency difference product has a pitch that is determined by the sweeping of the transmitter frequency and the time delay between the transmitted and received signals. This audio frequency difference product is output through a DC block 881 to an amplitude equalizer and filter 882 which in turn outputs a signal to the audio amplifier and conditioner 884 which drives the speaker 886. In addition, the amplifier and conditioner 884 provide an output to a visual display and the vibrating transducer 888.

FIG. 3C shows another embodiment for a handheld unit which consists of a battery powered transmitter and an antenna radiating at about 915 MHz, and an antenna and receiver operating at about 1829 MHz. The implementation of FIG. 3C uses a direct sequence spread spectrum radar system which includes the transmitter and a receiver and a control unit, which in this case is a field programmable gate array (FPGA). The basic clock signal for the FPGA 902 is obtained from the local oscillator 922 which provides inputs to the amplifiers 920 and 924 which in turn drive the FPGA 902 and a phase-locked loop synthesizer 926. During a power-on operation, the FPGA 902 programs the phase-locked loop synthesizer 926 to the correct frequency of operation. This occurs through the control lines from the FPGA 902 to the phase-locked loop synthesizer 926. The phase-locked loop synthesizer 926 is used to generate a local oscillator (LO) signal for the receiver. A receiver LO frequency is 1818.30 MHz. A frequency divider 930 is used to generate a 909.15 MHz local oscillator for the transmitter which is filtered by a band pass filter 931 (centered at 909.15 MHz ("FC")). Deriving the transmit local oscillator from the receiver's local oscillator not only eliminates the requirement for a second phase-locked loop synthesizer, but virtually eliminates any frequency error (e.g. frequency drift) between the transmitter and the receiver. The transmit local oscillator is modulated using a Quadrature Modulator circuit. This Quadrature Modulator enables a single circuit to perform all of the following features: (1) it performs a basic On-Off Keyed (OOK) modulation used in radar systems. Operating with OOK modulation not only provides an audio tone for the system but also minimizes the heat generated by the amplifiers and the transmitter, such as amplifiers 912 and 914; (2) the Quadrature Modulator produces a Binary Phase-Shift Keyed (BPSK) modulation of the local oscillator signal and performs what is called a Direct-Sequence Spread Spectrum signaling. This allows the handheld unit to operate in the 915 MHz industrial, scientific and medical (ISM) and as a license-free device operated under FCC Part 15.247; (3) the Quadrature Modulator 904 provides a Single-Sideband translation of the local oscillator input signal to a transmit output frequency of 914.50 MHz. That is, the local oscillator signal is shifted up in frequency by 5.35 MHz. This frequency translation results in a received signal that is offset from the receiver's local oscillator frequency by 10.7 MHz. Having the received frequency that is offset from the receiver's local oscillator reduces the magnitude of unwanted local oscillator leakage into the receiver's high gain amplifier chain, which may include amplifiers 942 and 944 and 948 as shown in FIG. 3C. The output of the Quadrature Modulator 904, which includes multipliers 906 and 908 as well as the mixer 910, is a Direct-Sequence, Spread Spectrum signal containing OOK modulation at a frequency of 914.5 MHz. This signal is filtered by two band pass filters 905 and 913 and amplified by two amplifiers 912 and 914 to approximately 1 watt and is sent to a transmit antenna 916. The transmit antenna also has a harmonic trap 916A, which is used to further reduce any second harmonic distortion, which if radiated, would interfere with the received signal from the tag in a lost golf ball. The Quadrature Modulator 904 is controlled by the FPGA 902 which provides and generates a Pseudo-Random Binary Sequence used for the Direct-Sequence Spread Spectrum signal. The FPGA 902 also provides and produces the OOK control signals to the modulator 904 and generates and provides the In-Phase and Quadrature-Phase signals applied to the Quadrature Modulator 904.

An alternative embodiment for the handheld unit shown in FIG. 3C is to change feature (1) of the Quadrature Modulator to implement 90-degree phase shift keying at the audio tone frequency, instead of On-Off keying. Features (2), Direct-Sequence Spectrum Spreading, and (3), Single-Sideband translation remain the same. The FPGA 902 produces the 90-degree phase shift keyed signal applied to the Quadrature Modulator 904. When the tag in the golf ball doubles the transmitted frequency from 914.5 MHz to 1829 MHz, the tag also doubles the amount of phase shift keying modulation to 180-degree keying. The re-radiated signal is active 100% of the time, instead of nominally half-time for On-Off keying, and the receiver has twice as much signal energy to process in the FPGA, A/D converter, and Post Demodulation processing. Thus the maximum useable range for finding the tag-equipped golf ball is increased, with a related increase in power drain on the battery.

The receiver of the handheld unit 900 operates on the principle that the tag in the golf ball will produce a harmonic reflected signal, which in one embodiment, doubles the transmitted frequency of 914.5 MHz to a reflected signal of 1829 MHz which re-radiates this doubled signal back to the receiver of the handheld unit. When a BPSK signal is squared, the modulation is removed and the energy in the modulated sidebands is collapsed back into a single spur at a frequency twice the carrier frequency. Thus the target (e.g. a tag in a lost golf ball) not only performs frequency doubling (or generating some other harmonic), but in the process, despreads the signal for free, eliminating the requirement for despreading circuitry in the receiver of the handheld unit. Therefore, what is re-radiated from the tag in the golf ball is an OOK modulated signal at 1829 MHz. The receiver receives this re-radiated (reflected) signal at the receive antenna 940 and filters and amplifies this 1829 MHz signal through the amplifiers 942 and 944 and the band pass filters 941 and 943. Thus, the received signal from antenna 940 is filtered in band pass filter 941 which outputs its filtered signal to the amplifier 942 which outputs its filtered signal to the amplifier 942 which outputs an amplified signal to the band pass filter 943 which outputs a filtered signal to the amplifier 944 which outputs a signal to the mixer 946. The other input to the mixer 946 is the received local oscillator signal at a frequency of 1818.3 MHz which is received from the band pass filter 932. The mixer 946 performs a down-conversion to a 10.7 MHz intermediate frequency (IF) by multiplying the amplified 1829 MHz signal received from amplifier 944 by the local oscillator signal of 1818.3 MHz received from the band pass filter 932. This multiplication (also called mixing) produces two signals, one at the sum frequency of 3647.3 MHz and the other at the difference frequency of 10.7 MHz. The sum frequency is filtered out by the 10.7 MHz intermediate frequency filter 947 which provides an output to the amplifier 948. This intermediate frequency filter 947 has a very small bandwidth (15 kHz) that also eliminates most of the received noise and adjacent RF (Radio Frequency) interference. What remains out of the intermediate frequency is a 10.7 MHz, OOK modulated signal that is amplified by amplifier 948 and further amplified by an amplifier 950 which includes a generator circuit 950 that generates a Receive Signal Strength Indicator (RSSI). This RSSI generator is not unlike an amplitude modulation (AM) detector, but with a logarithmic amplitude response. This RSSI function removes the 10.7 MHz carrier, resulting in just the audio tone that was applied to the signal in the transmitter. An 8-bit analog-to-digital (A/D) converter 952 converts the RSSI signal to a sampled digital signal. This digitized signal then undergoes post-demodulation signal processing in the FPGA 902 to further enhance the signal by reducing the noise by as much as 20 dB. This post-demodulation signal processing is performed by a Synchronous Video Generator (SVI) which performs an Exponential Ensemble Average across multiple OOK radar bursts. The FPGA 902 is programmed to include the SVI which is used for the post-demodulation signal processing. The FPGA 902 converts the output of the SVI circuit back to audio, which is amplified by an amplifier 958 which drives a speaker or headphones 960. The digital-to-analog converter 956 may be used in conjunction with the FPGA 902 to convert the digital audio output to an analog output for purposes of driving the speaker 960 or headphones. Optionally, a series of LEDs or a meter driven by the digital-to-analog converter 956 may also provide a visual indication of the proximity of the golf ball to the user of the handheld unit 900.

Figure 3D:
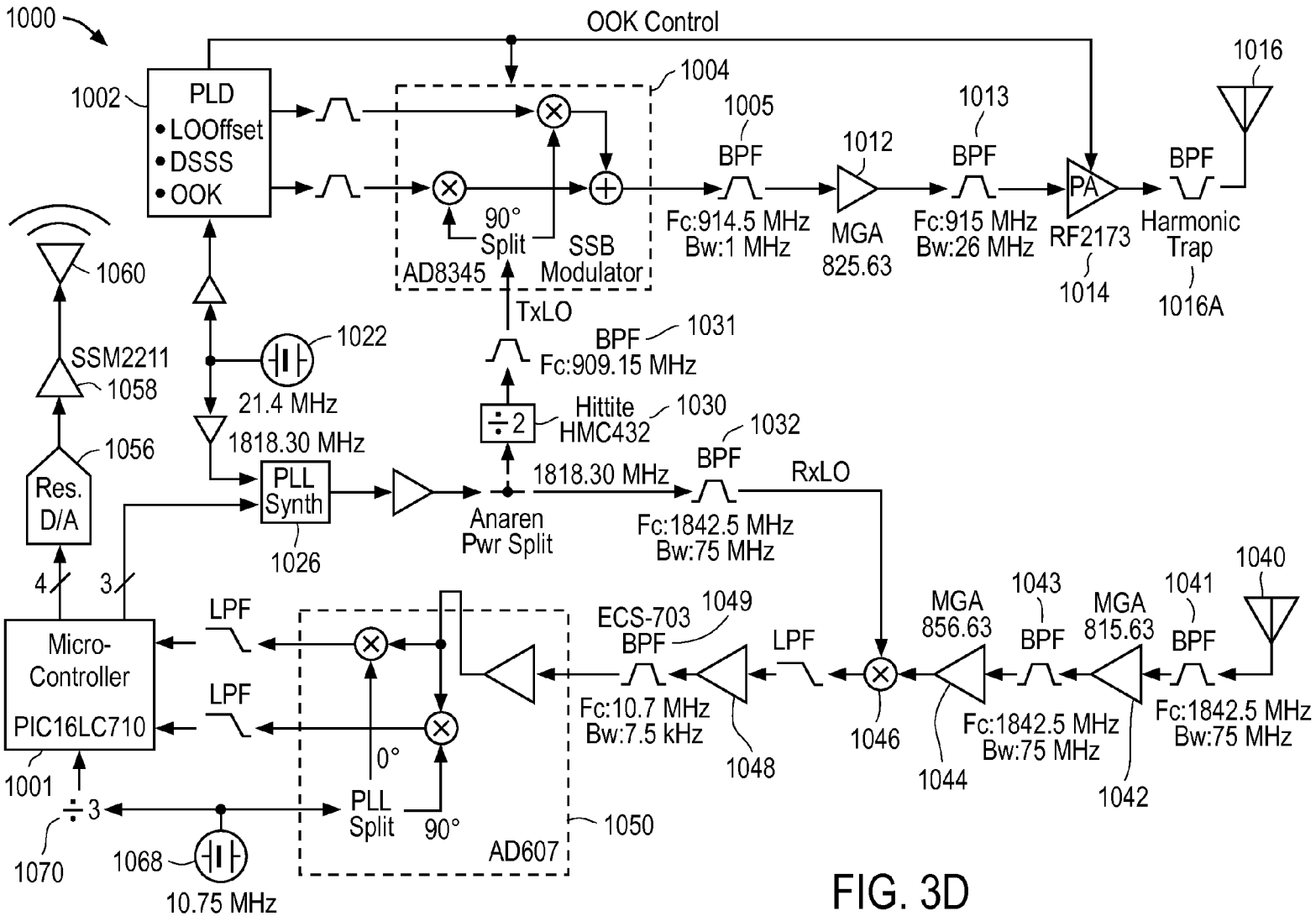

FIG. 3D shows another embodiment for a handheld unit which consists of a battery powered transmitter and an antenna radiating at about 915 MHz and an antenna and a receiver operating at about 1829 MHz. The handheld unit 1000 of FIG. 3D is similar in some ways to handheld unit 900 of FIG. 3C. The handheld unit 1000 includes band pass filters 1005 and 1013 and amplifiers 1012 and 1014 in the transmitter portion of unit 1000. In addition, this transmitter portion includes a transmit antenna 1016 which receives the amplified signal produced by amplifiers 1012 and 1014 through a harmonic trap 1016A. The transmitted signal originates from a crystal oscillator 1022 and phase locked loop synthesizer 1026 which produce a signal at a reference frequency of about twice the transmitted signal. A divide-by-two frequency divider 1030 and a band pass filter (BPF) 1031 provide the transmitter local oscillator signal to signal generator 1004 which is controlled by the PLD (Programmed Logic Device) 1002. The output of the signal generator 1004 drives the amplifiers 1012 and 1014 and the amplifier 1014 is controlled by OOK control from PLD 1002. This OOK control pulses the transmitter on and off, in one embodiment, with an On duty cycle of 50% or less. This will save battery life and minimize heat generated in the transmitter. The transmitter may also include an adaptive power control which could extend battery life (and simplify the handheld's user interface). When no signal is detected and when the receive signal strength is more than adequate for detection, the unit could scale back the transmit power automatically, thus conserving battery power and freeing the user from having to adjust a power transmit control knob. The receiver portion of the handheld unit includes receiver antenna 1040 which is coupled to BPF 1041 which in turn is coupled to amplifier 1042. The output of amp 1042 drives amp 1044 through BPF 1043. The mixer 1046, which receives the output of amp 1044, down converts this output to a 10.7 MHz intermediate frequency signal which is amplified (in amp 1048) and filtered (in BPF 1049) and then processed by amplifier 1050 (which may be an Analog Devices AD 607 amplifier which generates an RSSI signal). The amplitude of the received signal may be measured by a Cordic transform in microcontroller 1001. The RSSI signal is converted by an Analog to Digital converter in the microcontroller 1001 which in turn drives a D/A converter and an amplifier and speaker 1060 (or some other appropriate output device).

Figure 4A:
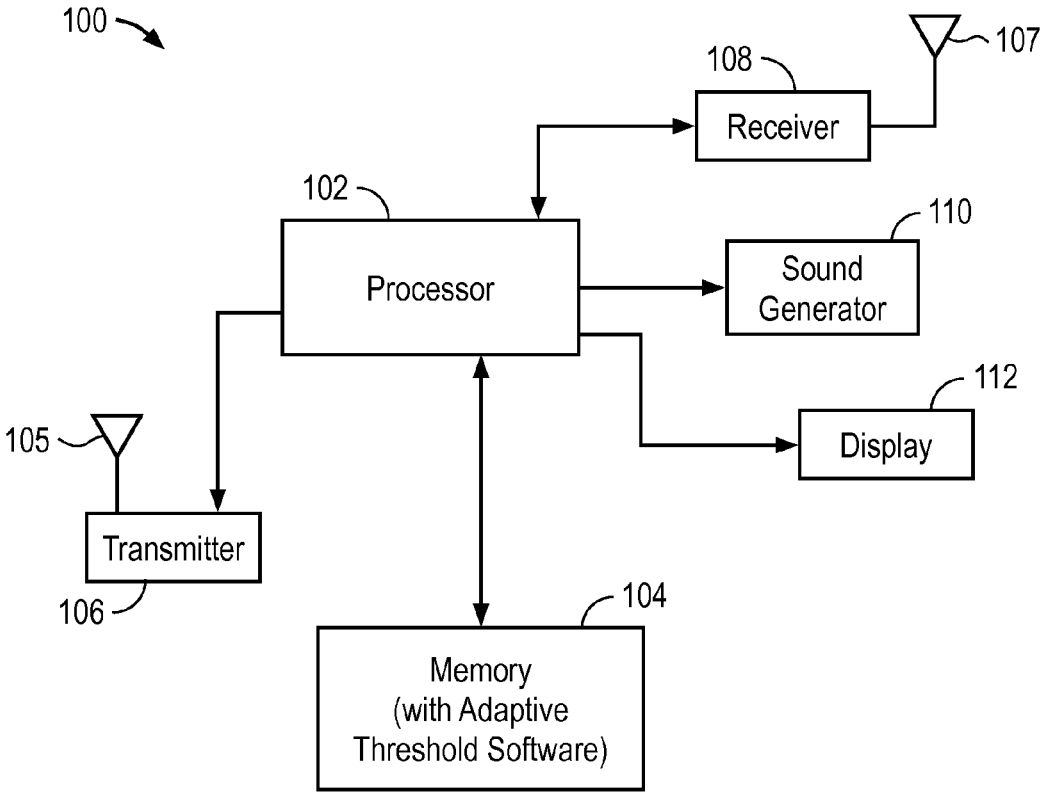
FIG. 4A shows a simplified representation of a handheld golf ball locator which may be used in certain embodiments of the inventions described herein.
Figure 4B:
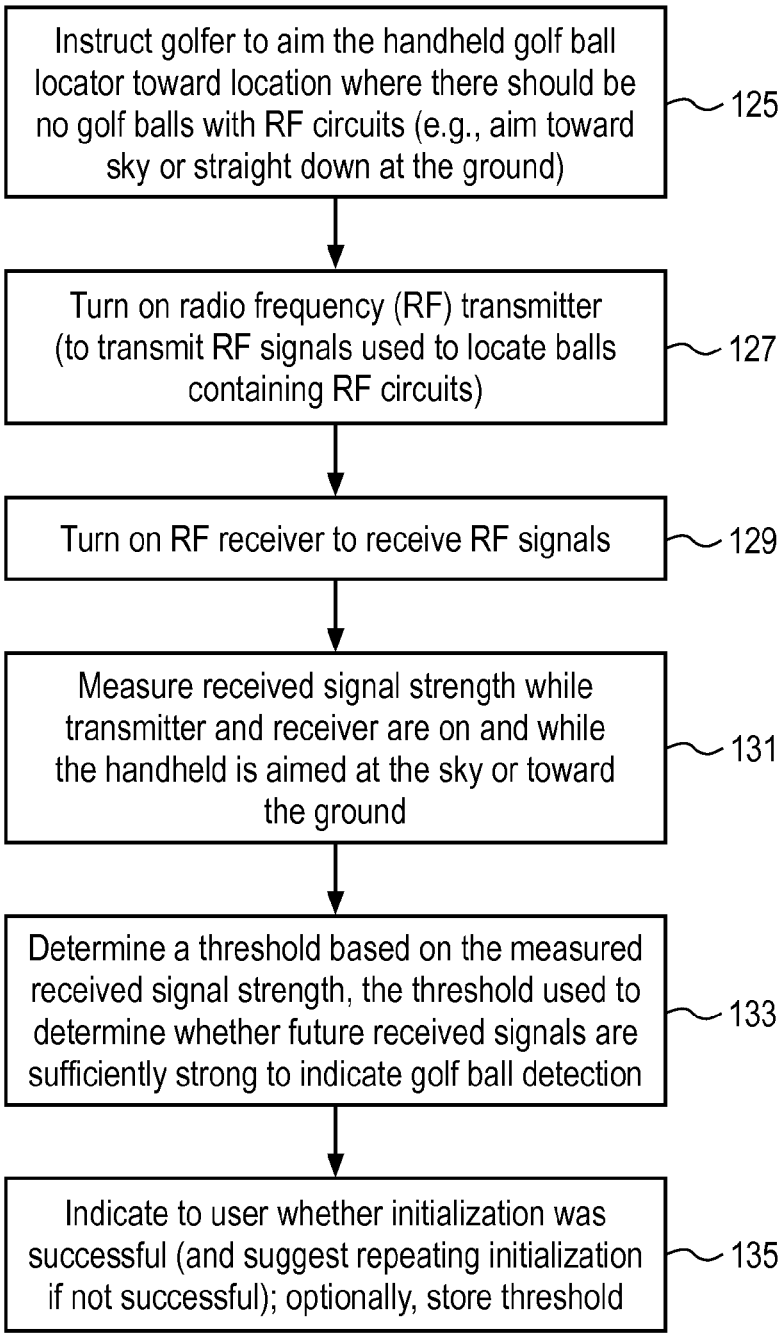
FIG. 4B is a flowchart which illustrates an exemplary method according to certain aspects of the inventions described herein.
Figure 4C:
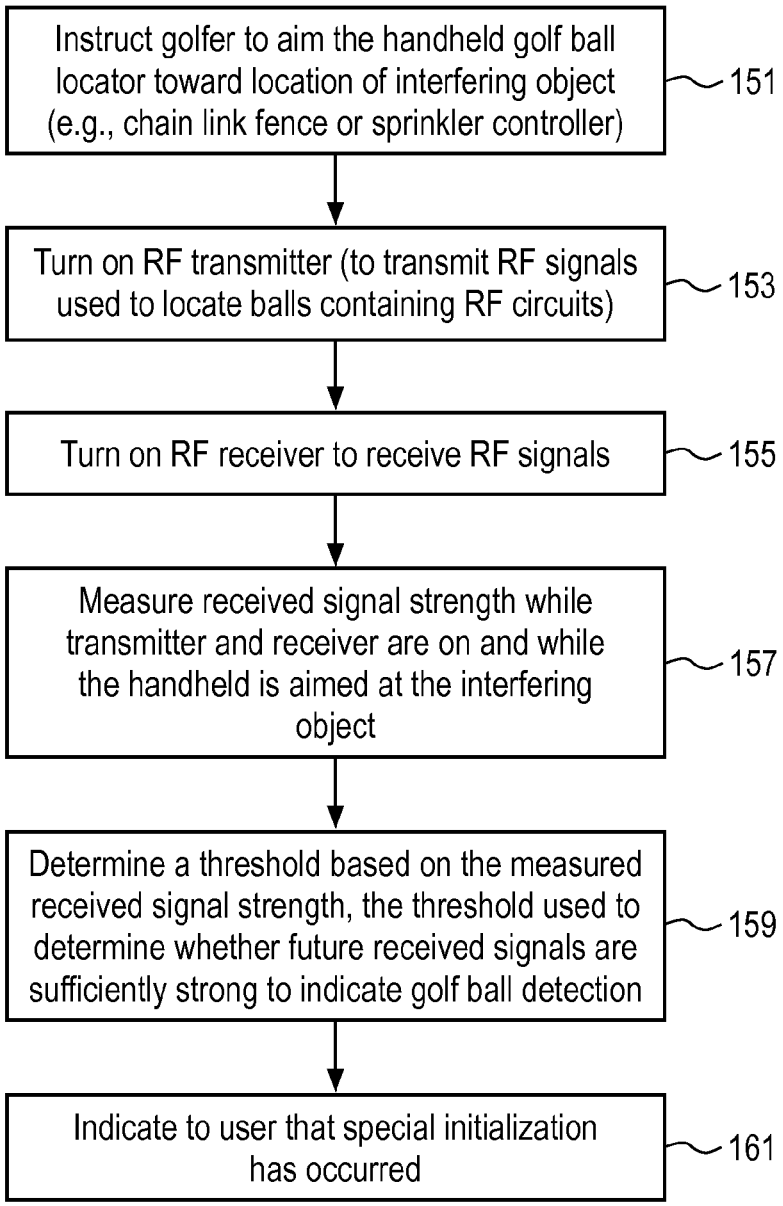
FIG. 4C is a flowchart which illustrates other aspects of certain exemplary embodiments of the inventions described herein.

FIG. 4A shows a simplified block diagram of a handheld golf ball locator which includes the capability of providing an adaptive threshold based upon the environment surrounding the handheld locator as well as the internal characteristics of the handheld locator. It has been determined, through careful testing of various handheld locators, that these locators which employ harmonic radar techniques to locate a golf ball will often accidentally include one or more diode structures with a corresponding antenna which may act like an RF circuit in a golf ball, such as the RF circuit shown in FIG. 2A. In effect, the handheld locator itself appears to include a golf ball with an RF circuit. Further, as the components within a handheld golf ball locator age, or are damaged, this may change the electrical characteristics of the handheld which may add further accidental diodes or taglike structures, further complicating the processing of outputs from the receiver. It has been found that these accidental diodes act as tags and provide false golf ball identifications. In other words, turning on a handheld when no golf balls are present in these circumstances may still produce an indication that a golf ball is present (e.g. a golf ball appears to be at approximately 10 feet or less). By adaptively adjusting the threshold based upon the actual handheld being used, which may change with time, it is possible to remove the effects of the internal interference within the handheld and adjust for variations in handheld performance with the age or condition (a damaged handheld) of the handheld. Two exemplary methods for employing adaptive thresholding are shown in FIGS. 4B and 4C, and both of these figures may implement the system shown in FIG. 4A. These methods contemplate, in a typical embodiment, listening to the environment through the receiver of the handheld while the transmitting subassembly is powered on and transmitting signals. The output from the receiver is processed while the transmitter is functioning and transmitting signals, and this output is used to create a threshold or baseline of detection. Subsequently received signals which are below this threshold are considered to be signals which do not represent the valid detection of a golf ball, and signals which exceed this threshold are considered to be representative of signals that indicate the presence of a golf ball and thus the user is alerted through the user interface to the location (e.g. the distance to) the golf ball.

The system shown in FIG. 4A includes a processor 102, a transmitter 104 and a receiver 108, both of which are coupled to the processor 102. The processor 102 is also coupled to a memory 104 which, in at least certain embodiments, includes adaptive threshold software which causes the processor to perform the methods of FIGS. 4B and 4C in at least certain exemplary embodiments. It will be appreciated that the software may be stored within the processor itself or that the processor may implement the methods of determining adaptive thresholds using hardware circuitry only rather than relying upon software. The transmitter 106 is coupled to a transmit antenna 105 and the receiver 108 is coupled to a receive antenna 107. The user interface of the handheld golf ball locator 100 includes a sound generator 110 which typically includes a speaker and a display 112 which may be a liquid crystal display which can display signal strength by displaying a number of bars which is dependent upon the level of the signal strength. The sound generator may produce beeps at a certain pitch and at a certain rate of repetition to indicate the distance to a golf ball. For example, low pitches at a low rate of repetition may represent a longer distance to the golf ball and a high pitch with a high rate of repetition may represent a shorter distance to the golf ball. The table shown in FIG. 7C gives examples of both pitches for the sounds and the repetition rate (pulse rate) for those sounds.

The adaptive thresholding process described herein may be performed in the factory and never again performed for a handheld device (and the threshold determined at the factory may be stored in the handheld as a default value which can be recalled and used again by a golfer if the threshold was changed from the default value). However, in at least certain embodiments, it is desirable to allow the user to be able to perform the initialization process at least once and potentially multiple times, each time upon command from the user (e.g. a special command which is different than the normal power-up operation of the handheld, and which causes the handheld to initialize itself as described herein). In yet another embodiment, the handheld may perform this initialization operation every time it is powered up. FIG. 4B shows a flowchart of a representative initialization process which may be performed every time that the handheld golf ball locator is powered up for use. In order to save battery power, the handheld golf ball locator may include an automatic off circuit which turns the handheld locator off after 5 minutes of non-use. In such a system, the golf ball locator will automatically turn itself off after 5 minutes of non-use or it may turn itself off after 5 minutes from initial powering up. In either case, upon powering the system up again, the user will cause the method of FIG. 4B to be performed. This method begins in operation 125 in which the golfer is instructed to aim the handheld golf ball locator toward a location where there should be no golf balls with RF circuits. This location may be the sky or directly below the golfer. The instruction of operation 125 may be displayed on the handheld's display device (e.g. the display 112) or it may be printed in an instructional manual or otherwise provided in some instruction material to the golfer. By aiming the handheld locator toward the sky or straight down toward the ground, there should be presumably no golf balls with RF circuits present. In this manner, the only "golf balls" present should be those accidental "tags" contained within the handheld locator. In operation 127, the system turns on the transmitter, which causes the transmitter to transmit the normal RF signals used to locate the balls containing RF circuits. In operation 129, the system also turns on the radio frequency receiver to receive signals from the golf balls. The sequence of operations 127 and 129 may be reversed. In operation 131, the output from the receiver is processed by, in this example, measuring the received signal strength (e.g. through an RSSI circuit) while the transmitter and receiver are on (in other words, operations 127 and 129 continue while the received signal strength is measured) and also while the handheld is aimed toward the sky or toward the ground where there should be no golf balls with RF circuits. Then in operation 133, a threshold is determined based upon the measured received signal strength, and this threshold is used to determine whether future received signals are sufficiently strong to cause the system to indicate a golf ball detection at a certain location (e.g. distance). The threshold may be the combination of the measured received signal strength and a buffer value (of additional signal strength) which is added to the measured received signal strength. The method may optionally indicate (e.g. by generating an appropriate sound) to the user whether initialization was successful and may optionally store this threshold (for use as the threshold in subsequent powering ups of the handheld) in instances where initialization is not automatic upon every powering up of the system. If the initialization was not successful, the handheld device may optionally suggest repeating of the initialization (e.g. by displaying a suggestion on a display device or by generating a sound which indicates that initialization should be repeated). The handheld device may determine that initialization was not successful by determining that a measured received signal strength was too strong (e.g. the environment surrounding the handheld is too "noisy" in RF signals). For example, if the measured received signal strength (measured during an initialization as shown in FIG. 4B or even in FIG. 4C) exceeds a predetermined level which is considered too strong, then the handheld determines that the initialization was unsuccessful and provides an indication to the golfer.

FIG. 4C shows an alternative embodiment in which the initialization process is used for a special case where the golfer purposely seeks to initialize the golf ball detector in the presence of an external interfering object. In this circumstance, the golfer is typically attempting to remove the effect of the external interfering object from the process of detecting and locating the golf ball. This will often result in the reduction of the detection range of detectable balls; for example, rather than being able to detect balls at 40-50 feet, it may only be possible to detect balls which are at most 20 feet away after the handheld has been intentionally initialized in the presence of an external interfering object. However, the ability to provide this type of initialization process does allow the golfer to remove the effect of an interfering object which may be a chain-link fence on the golf course or a sprinkler controller on the course or other types of apparatuses commonly found on golf courses. In other words, the interfering object will be ignored (e.g. a detection signal will not be generated by the presence of the interfering object) when the golfer points the transmitter at such object, allowing for detection of a ball near such object. In operation 151, the system instructs the golfer to aim the handheld golf ball locator toward the location of the interfering object. This instruction may occur by displaying a message on the display device of the handheld locator or by providing instruction material, such as a manual, to the golfer. In operations 153 and 155, the transmitter is turned on to transmit signals which are used to locate the golf balls containing RF circuits and the receiver is turned on to receive signals from the RF circuits of the golf balls. While the transmitter and receiver are both on, the system measures received signal strength (e.g. −95 dBm) while the handheld is continued to be aimed at the interfering object in operation 157. Then in operation 159, the system determines a threshold based on the measured received signal strength (which was measured while the receiver was receiving RF signals from the interfering object, such as reflected RF signals), and this threshold is used to determine whether future received signals are sufficiently strong to cause the system to indicate the detection and location of a golf ball. In operation 161, the system optionally indicates to the user, through the user interface, that the special initialization has occurred.

Figure 3E:
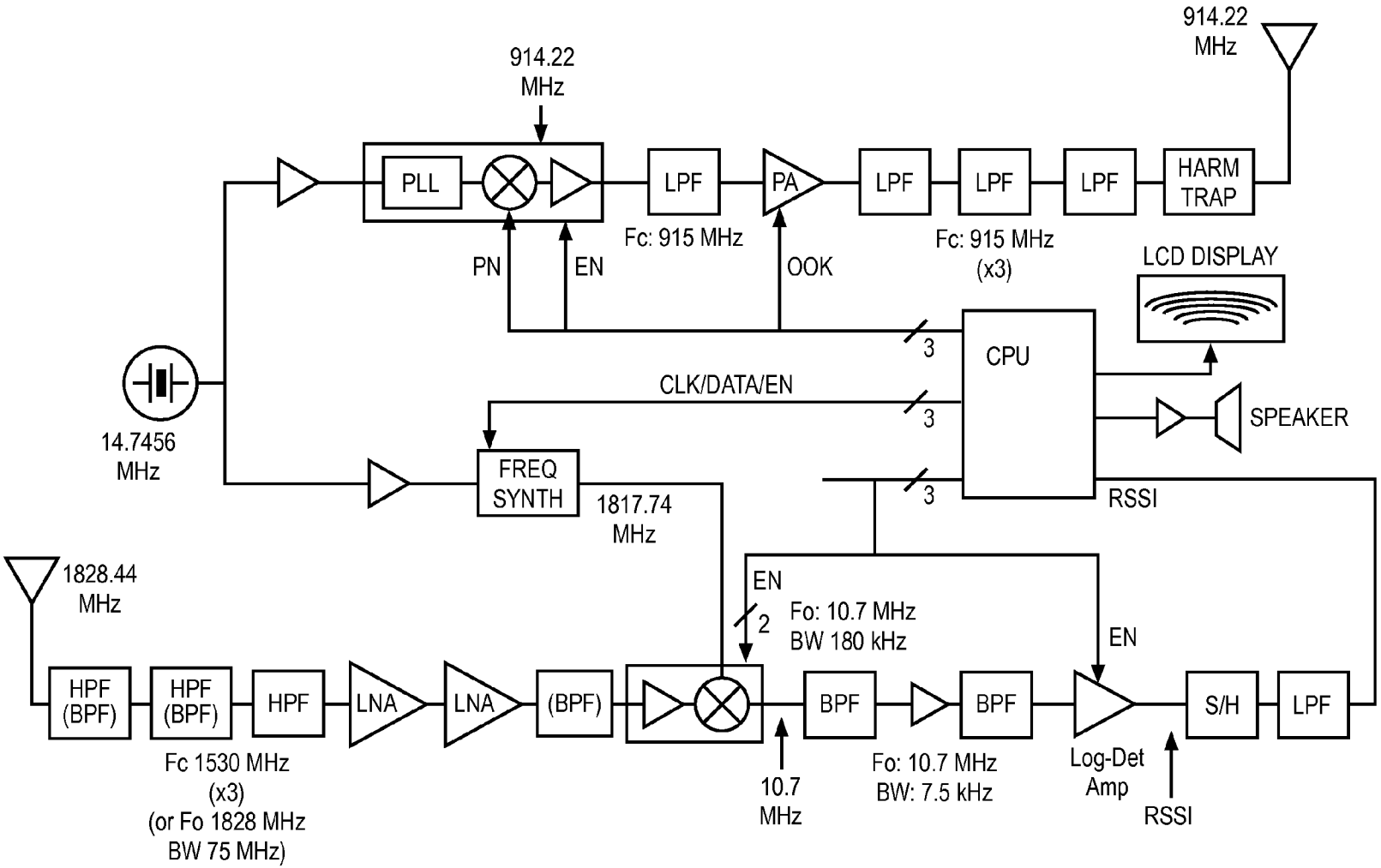
Figure 5:
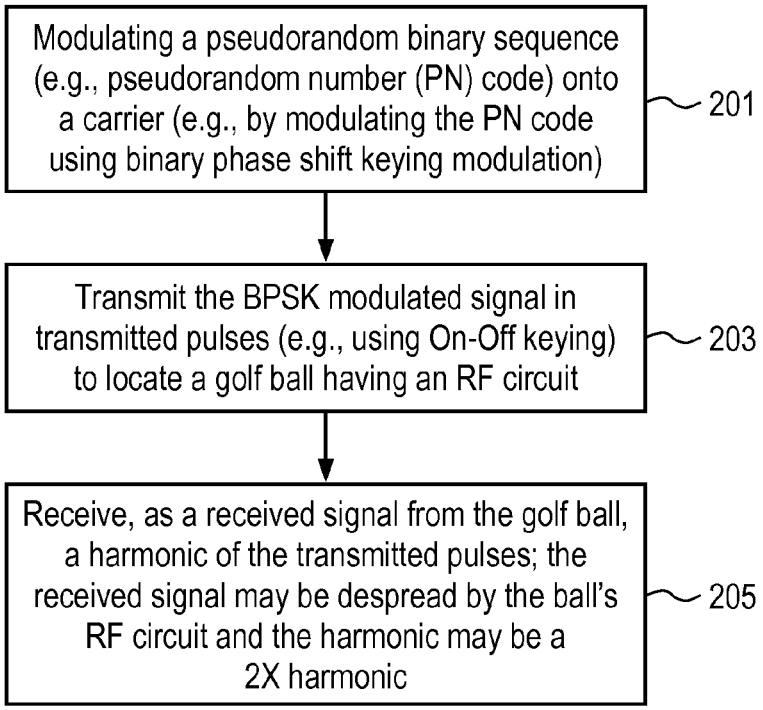
FIG. 5 is a flowchart illustrating one exemplary method of operating a handheld golf ball locator according to certain aspects described herein.

FIG. 5 shows an exemplary method for operating a handheld golf ball locator which involves certain types of modulation. The type of modulation described in FIG. 5, including the use of a pseudorandom binary sequence, increases the sensitivity of the receiver by reducing noise from other handhelds and also by allowing for a very narrow bandwidth operation within the receiver. Different handhelds may utilize different pseudorandom binary sequences. This sequence, which is often referred to as a PN code, is modulated onto a carrier in operation 201. This modulation may be through the use of binary phase shift keying modulation or through the use of other modulation techniques, such as frequency modulation. The resulting modulated signal, which may be a BPSK modulated signal, is transmitted in certain exemplary embodiments, in transmitted pulses rather than continuous transmissions of the signals. These pulses may be produced using on-off keying (OOK) as is known in the art. In operation 205, the receiver of the handheld locator receives, as a received signal from the golf ball, a harmonic of the transmitted pulses. The received signal may be despread by the ball's RF circuit and the harmonic may be a 2× harmonic as described herein. FIG. 3E shows an example of a handheld golf ball locator which may operate in a manner which is similar to the method of FIG. 5. The handheld ball locator of FIG. 3E uses a single crystal oscillator as a generator of a reference frequency from which both the transmit and receive frequencies are derived. The receive frequency is generated with a frequency synthesizer, and the transmit frequency is generated with a frequency multiplier in a phase-lock loop (PLL).

Figure 6:
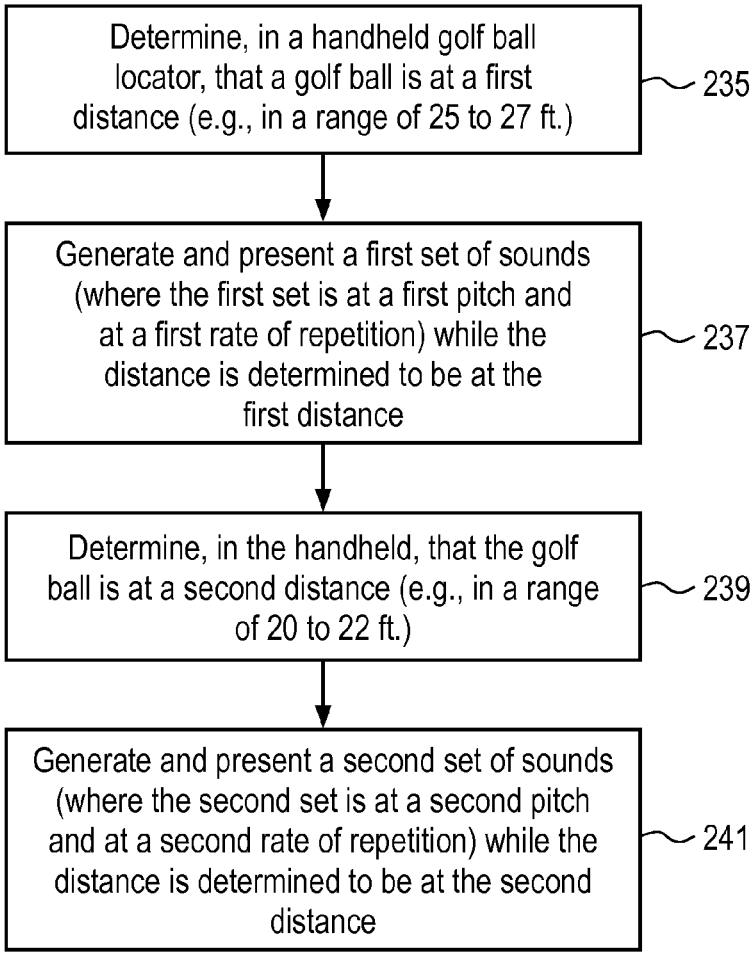
FIG. 6 is a flowchart which illustrates an exemplary method for providing a user interface to a user of a handheld golf ball locator.

FIG. 6 shows a flowchart which illustrates an exemplary method for providing a user interface for a golf ball locator. This method may begin in operation 235 by determining, in the handheld locator, that a golf ball is at a first distance, such as the golf ball appears to be in a range of about 25-27 feet. The handheld locator then generates, in operation 237, a first set of sounds while the distance is determined to be at the first distance. The first set of sounds are presented through a speaker which is part of the handheld locator, and these sounds are at a first pitch and at a first rate of repetition. For example, the pitch may be 400 hertz and the rate of repetition may be 8 beeps per second, each of the beeps being at 400 hertz. In operation 239, the handheld determines that the golf ball is now at a second distance (e.g. the golf ball has been determined to be in a range of about 20-22 feet). The change in distance typically occurs as a result of the golfer walking toward the stationary golf ball. In operation 241, the handheld locator generates and presents a second set of sounds while the distance is determined to be at the second distance. The second set of sounds are at a second pitch and at a second rate of repetition. For example, the second set of sounds may be 12 beeps per second, each beep being at 460 hertz. The user interface provided by the method of FIG. 6 allows a golfer to look at the field of play and search visually for the ball without having to look at the handheld device, and still be able to get audible feedback from the handheld device, where the audible feedback clearly provides sufficient indications of the distance to the golf ball by using both the pitch and the rate of repetition of the sound at a particular pitch.

Another aspect of the inventions described herein relates to a user interface which has a rate of change which is not constant. The variation in the rate of change of the user interface parameter, such as the pitch of a sound or the rate of repetition of the sound or the combination of the pitch and the repetition rate, provide additional feedback to the user with respect to locating the ball. For example, it may be desirable to provide a greater rate of change for a user interface parameter when the golfer is originally setting out to look for the golf ball. Typically, the golfer will be further away from the golf ball than desired, and the golfer may not know the exact orientation (e.g. in azimuth). Small changes in azimuth can greatly change the received signal strength from a golf ball. Without knowing the exact azimuth orientation of the ball relative to the handheld, the golfer would prefer to identify the orientation at least to an approximate level before proceeding to walk off in what the golfer believes is the direction of the golf ball. If the golfer incorrectly identifies the orientation, the golfer may head off in a trajectory which is not toward the ball. Thus, a user interface which has a rate of change at longer distances (or smaller received signal strength indications) which is greater than a rate of change of the user interface at a shorter distance (higher received signal strength) may be desirable.

Figure 7A:
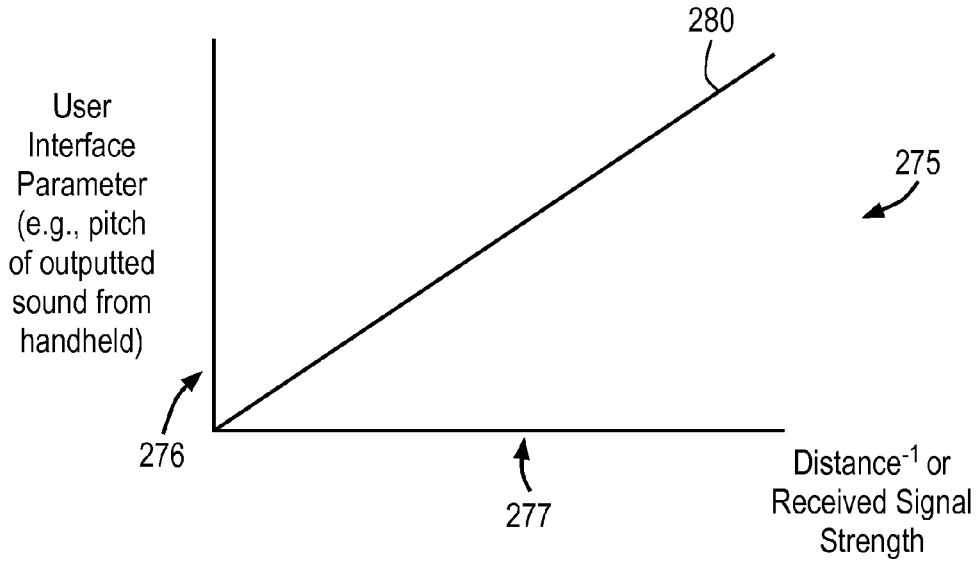
FIG. 7A is a graph which illustrates one type of user interface which may be implemented in a handheld golf ball locator.

FIG. 7A represents an example where the user interface parameter has a constant rate of change. In the graph 275, the user interface parameter shown in the Y axis 276 increases linearly relative to the inverse of distance or to received signal strength shown on axis 277. This is shown by the line 280 which represents the user interface parameter at a given distance or received signal strength. The rate of change of the user interface parameter is of course the slope of the line 280, which is constant.

Figure 7B:
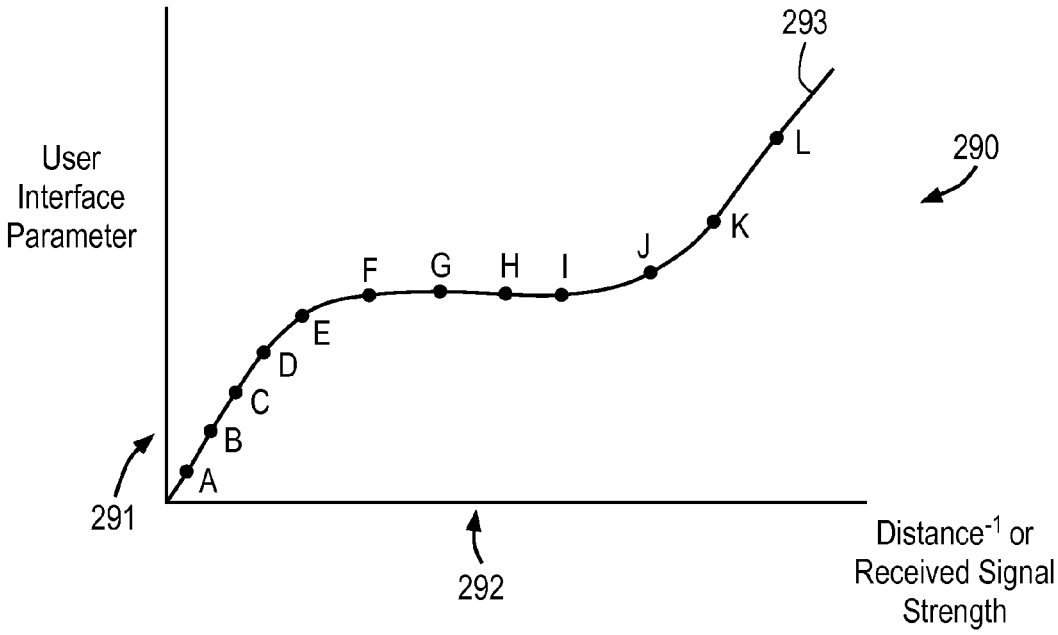
FIG. 7B is a graph which illustrates an exemplary embodiment of a user interface implementation of the inventions described herein.
Figures 7C, 7D:
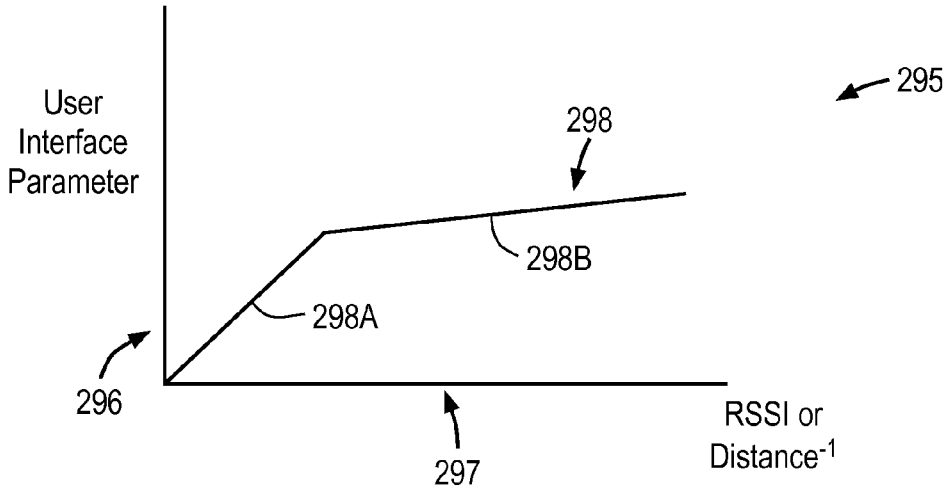
FIG. 7C is a table which is based upon the curve on the graph of FIG. 7B, which table may be implemented as a lookup table in the memory used by a processor within a handheld golf ball locator as described herein.
FIG. 7D is a graph which shows another exemplary embodiment of a user interface which may be implemented with certain of the inventions described herein.

FIG. 7B shows an exemplary embodiment in which the rate of change of a user interface parameter is not constant. In the case of FIG. 7B, the curve 293 shown in the graph 290 has a plurality of points A-L, each representing a particular pitch and pulse rate as shown in the table of FIG. 7C. Each point has a corresponding received signal strength indicator (RSSI) which is shown on axis 292. Axis 291 represents the user interface parameter such as pitch or pulse rate of the sound. It can be seen that the rate of change of the user interface parameter along the portion of the curve having points A-E is greater than the rate of change of the user interface parameter along the points F-I. The rate of change of the user interface parameter again increases on the curve along the points J-L. This is also shown in the table of FIG. 7C which provides exemplary values along those points on the curve 293. The advantage of a user interface implemented using the curve or table of FIGS. 7B and 7C, respectively, is that the user is given more helpful feedback from the user interface at the onset of the search process when the distance is farthest or the received signal strength is weakest. This will tend to prevent the user from going off in a direction which is away from or tangential to the golf ball's location. For example, the rate of change of the pitch is significantly higher at the farthest distances than the rate of change of the parameter at intermediate distances. The curve 293 has three regions, each with at least one rate of change of the user interface parameter. The curve 298 shown in FIG. 7D is an example of a user interface parameter which has two rates of change over two portions of the curve 298. In particular, the graph 295 shows that the user interface parameter changes at two rates represented by the two portions 298*a* and 298*b* of the curve 298. This curve is plotted on the graph where the Y axis represents the user interface parameter 296 and the X axis represents the received signal strength 297 or the inverse of the distance.

It will be appreciated that the different rates of change of the user interface parameter may be implemented by storing a lookup table in a memory which is accessed by the processor which causes the presentation of the user interface to the golfer. For example, the memory 104 shown in FIG. 4A may also include a lookup table which is similar to the table shown in FIG. 7C, and the processor 102 uses this lookup table to present the user interface. The processor may perform the method shown in FIG. 7F, for example.

Figure 7E:
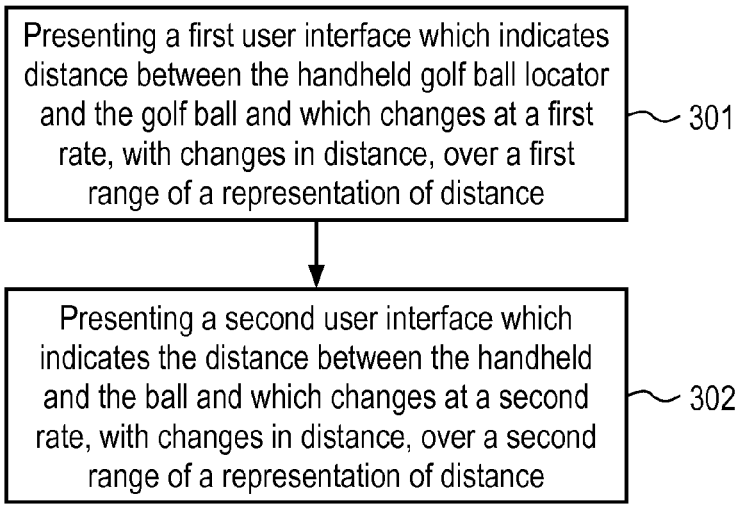
FIG. 7E is a flowchart which illustrates an exemplary method for providing a user interface according to certain aspects of the inventions described herein.

A method for providing a user interface in which the rate of change of the user interface parameter is not constant is shown in FIG. 7E. In operation 301, the handheld device presents a first user interface which indicates a distance between the handheld locator and the golf ball and which changes at least at a first rate, with changes in distance, over a first range of a representation of distance. FIG. 7B shows an example where the user interface changes at a first rate along points A-D which is over a first range of a representation of distance. In operation 302, the system presents a second user interface which indicates the distance between the handheld and the ball and which changes at a second rate, with changes in distance, over a second range of a representation of distance. The curve 293 of FIG. 7B shows the second user interface between points F-I which changes at a second rate, with changes in distance over a second range of a representation of distance. In the particular example shown in FIG. 7B, the first rate exceeds the second rate. However, it will be appreciated that in alternative embodiments, the first rate may be lower than the second rate, etc.

Figure 7F:
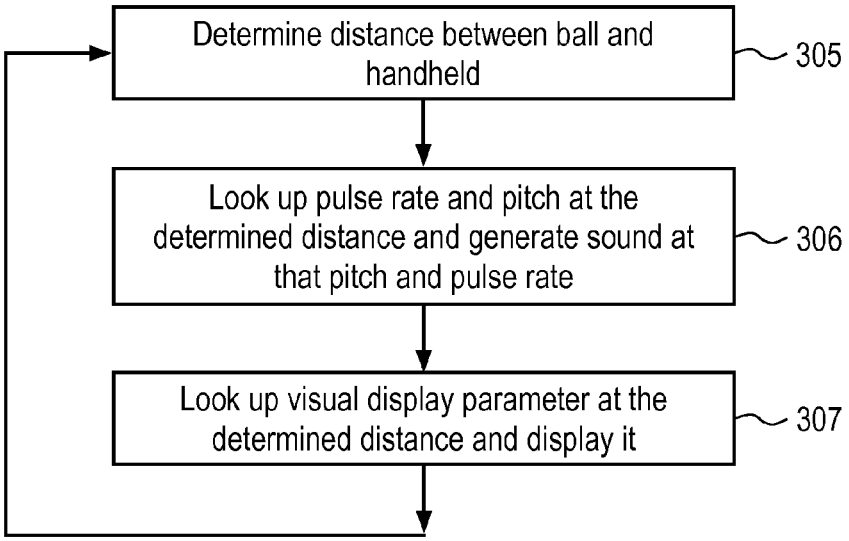
FIG. 7F is another flowchart which illustrates a method of providing a user interface according to certain aspects of the inventions described herein.

The method of FIG. 7F shows that the handheld system may use a lookup table to present the sounds and to also present a visual indicator of distance and this lookup table may include different rates of change for the user interface parameter. In operation 305, the processor within the handheld determines the distance between the ball and the handheld. This distance may be determined by a received signal strength or by a ranging determination which is based upon the time of travel of signals between the ball and the handheld. Then in operation 306, the processor looks up, in the lookup table, a pulse rate and pitch at the determined distance and generates sounds at that pitch and pulse rate. Further, the processor in operation 307 looks up a visual display parameter (e.g. the number of bars to display on a display device) at the determined distance and displays that particular visual display parameter. The processor repeats operations 305, 306 and 307 as the user continues to move toward the ball and as the distance grows shorter as a consequence of moving toward the stationary ball.

Another aspect of the inventions described herein is shown in FIGS. 8A-8D and will now be described. This aspect relates to methods for processing signals received from the RF circuit of the golf ball. In one exemplary embodiment of this method, the output from a receiver in the handheld locator is processed at times that are separated by time periods between the processings, where the time periods are either different or random in length. The receiver's processing of the output is typically synchronized with the transmission pulses which may also be random (e.g. at random times) or in a non-random repeating pattern.

Figure 8A:
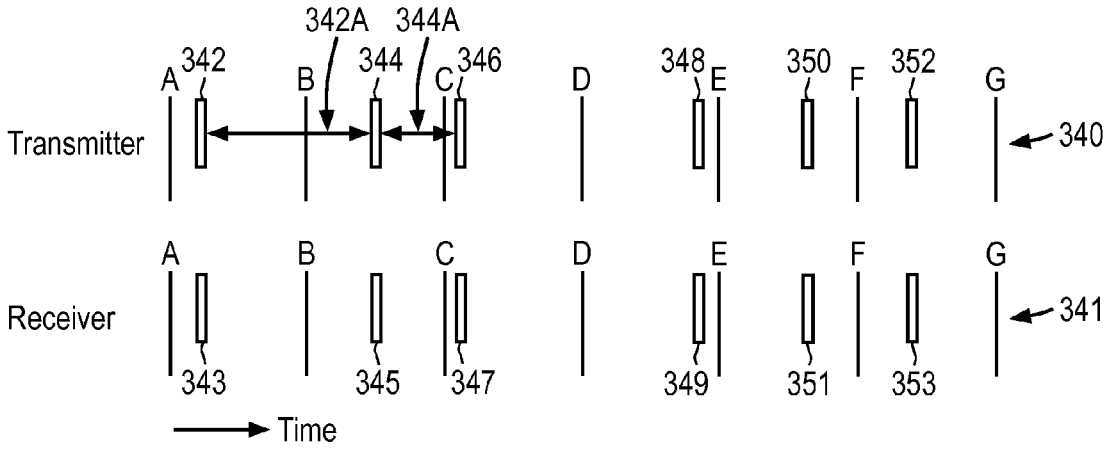
FIG. 8A is a timing diagram which illustrates the relationship between randomized transmission pulses which are synchronized with receiver processing operations which process the output from the receiver in synchrony with the transmitted pulses. Typically, the processing of the output of the receiver for the purpose of locating the ball is performed only at the same time as the transmission pulses.

FIG. 8A shows one example of this method. The timing diagram in FIG. 8A shows transmission activity 340 and receiving activity 341, which includes processing of the receiver's output, along the same timeline. Both the transmitter and the receiver operate within time intervals which are separated at the designated markings A-G. Hence, the transmitter transmits a pulse 342 during the time interval A to B and transmits another pulse 344 in the time interval between B and C. The receiver is synchronized with the transmitter such that the output from the receiver is processed during the time 343, which is a period of time which substantially matches the period of time of the pulse 342 of the transmitter as shown in FIG. 8A. Similarly, the receiver's processing time during the interval defined by B and C is the same as the transmitter pulse time 344. The transmitter's pulses may be randomly timed and thus the time intervals between the transmission pulses (and the corresponding intervals between the processing times in the receiver) may be different or random. This is also shown in FIG. 8A. For example, time interval 342*a* between transmitter pulses 342 and 344 is different than time interval 344*a* which exists between transmitter pulses 344 and 346. The random transmitter pulses may be controlled by a processor which provides a signal to both the transmitter and receiver in order to synchronize transmission and processing of received signals even though the transmission pulses are at random times during each time interval. This synchronization can be seen by comparing the transmission pulses 342, 344, 346, 348, 350 and 352 relative to the receiver processing times 343, 345, 347, 349, 351 and 353 as shown in FIG. 8A.

Various different architectures may be utilized to implement the controlled timing for both the transmitter and the receiver as shown in FIG. 8A. For example, the block diagram representation of a handheld golf ball locator shown in FIG. 8B includes a processor 358 which is coupled to both the transmitter 360 and the receiver 359. This handheld golf ball locator 357 also includes an accumulator or summation device 363 in the processor 358 and an on-off keying pulse control 361 in the processor 358. The on-off keying pulse control 361 provides an OOK signal control to both the transmitter 360 and the receiver 359. This control signal is received by the sample and hold circuit 362 in the receiver 359, which circuit provides an output to the summation device 363. The OOK signal synchronizes both the transmitter and the receiver so that the transmission pulses from the transmitter 360 are synchronized with the capture of received signals through the sample and hold circuit 362. The output from the sample and hold circuit 362 is provided to the summation device 363 which accumulates a series of received signal strength indicators over several time intervals, such as the six time intervals shown in FIG. 8A. It will be appreciated that the OOK signal provided to the sample and hold circuit 362 may be slightly delayed through delay logic relative to the OOK signal provided to the transmitter 360. This slight delay accommodates the delay caused by the propagation of the signals from the handheld's transmitter to the golf ball and back from the golf ball to the receiver 359. Typically, the output from the receiver is processed only during selected time periods which typically overlap in time with the transmission pulses as shown in FIG. 8A. For example, during the time interval between time markers A and B, the output from the receiver is processed to determine the RSSI only during the duration 343 shown in FIG. 8A. By synchronizing the transmission pulses with the receiver's processing of the received signal strength and by making the transmission pulses random, improved performance for a harmonic radar golf ball locator may be provided in RF environments where there is signal interference due to other RF devices, such as cellular telephones. An example where a cellular telephone may interfere with a handheld golf ball locator is in the Philippines where the GSM cellular telephone frequencies may interfere with the handheld locator's ability to receive signals from golf balls containing RF circuits. By randomly transmitting the pulses and synchronizing those randomly transmitted pulses with the processing of received signals, the handheld locator should have improved performance relative to a handheld system which consistently generates pulses at the same time within a time interval across a plurality of time intervals. It will be appreciated that the processor 358 may randomly or pseudorandomly generate a time for the transmission pulse within each time interval, which in turn causes the OOK pulse control 361 to generate the OOK signal to simultaneously or substantially simultaneously cause the transmitter to transmit a pulse and the receiver to process received signals.

Figure 8B:
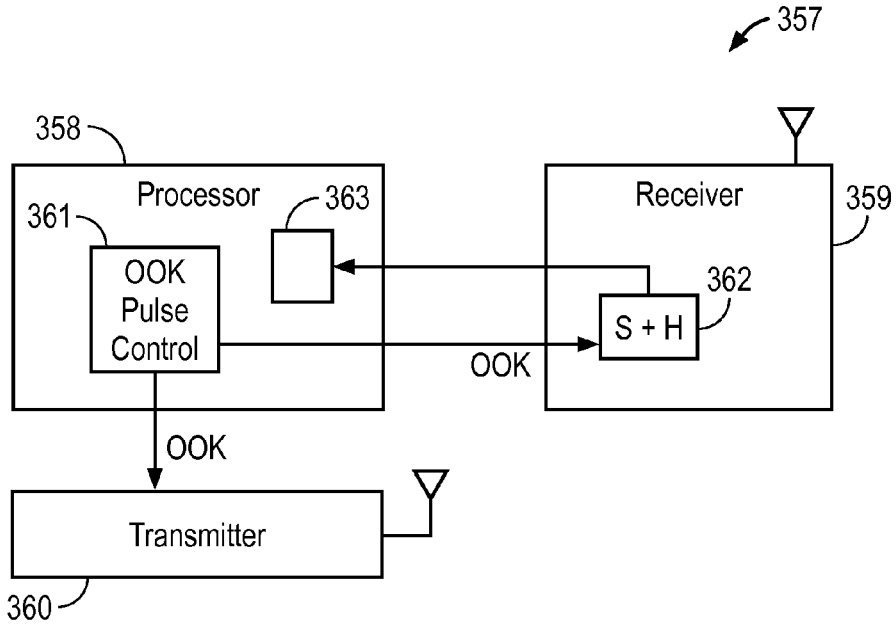
FIG. 8B shows a simplified block diagram of a handheld transceiver for locating a golf ball which may be employed with the aspects of the invention shown in FIGS. 8A, 8C and 8D.
Figure 8C:
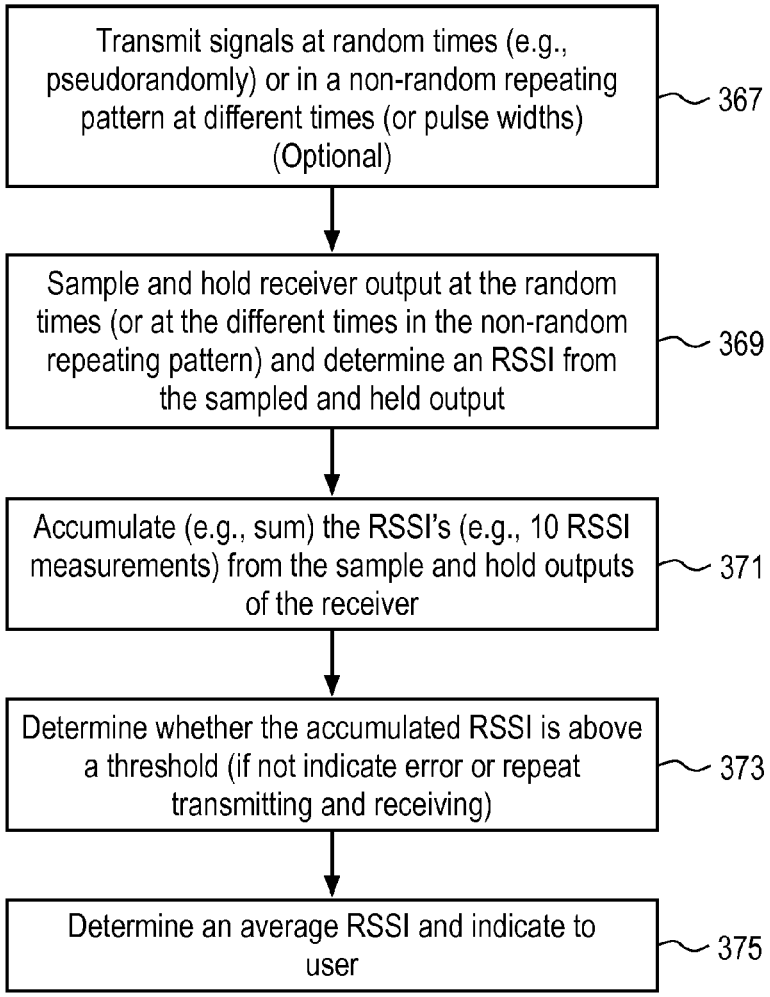
FIG. 8C is a flowchart which illustrates an exemplary method of operating a handheld transceiver for locating a golf ball according to the aspect of the inventions shown in FIGS. 8A, 8B and 8D.

FIG. 8C shows an exemplary method of operating the handheld 357 of FIG. 8B. This method may produce the transmission and processing patterns shown in FIG. 8A or the transmission and processing patterns shown in FIG. 8D. In operation 367, the system transmits signals at random times (e.g. pseudorandomly) or in a non-random repeating pattern at different times. As a further alternative, the pulse widths of the transmissions may vary either randomly across a plurality of time intervals or in a non-random repeating pattern across a plurality of time intervals. In operation 369, the sample and hold circuit of the receiver captures the receiver's output at the random times in synchrony with the transmission (or alternatively at the different times in the non-random repeating pattern) and the RSSI is determined from the sampled and held output. The transmitted signals may be generated by the modulation method described relative to FIG. 5 or they may use other modulation techniques. Operation 367 and 369 are shown in FIG. 8A. For example, the transmission pulse 342 is at a random time within the time interval A-B and the receiver samples and holds a receiver's output at the same random time 343 during the time interval A-B. Similarly, during the time interval B-C, the transmitter pulse 344 randomly occurs during the time interval B-C and this coincides in time with the processing time 345 in which the receiver's output is sampled and held in order to determine an RSSI. Several such RSSI's may be accumulated or summed over several different time intervals. This is shown in operation 371. This will tend to improve the noise rejection of the receiver by accumulating over several time intervals the result of the receiver processing, which in this case is an RSSI level for each time interval. For example, ten RSSI measurements over ten different intervals, generated from ten randomly timed transmitter pulses during those ten time intervals, will generate an accumulated RSSI. In operation 373, it can be determined whether this accumulated RSSI is above a threshold. This accumulated RSSI may be compared to an adaptive threshold as described herein in order to further compensate for signal interference from other RF devices, such as cellular telephones in the local signal environment (e.g. using the handheld on a golf course in the Philippines). If the accumulated RSSI in operation 373 is below the threshold, then the system may indicate an error or repeat transmitting and receiving to attempt to locate a golf ball. If the accumulated RSSI is above the threshold, then in operation 373, an average RSSI is determined by the processor and presented to the user through a user interface, such as the user interfaces described herein.

Figure 8D:
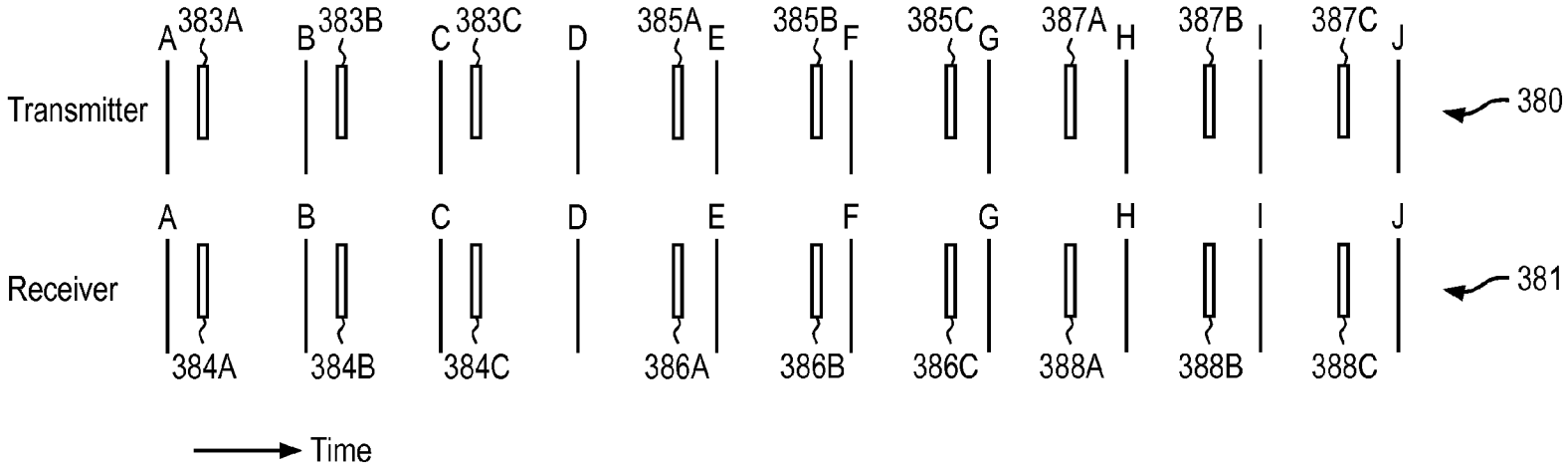
FIG. 8D is a timing diagram which illustrates another exemplary embodiment in which transmitting pulses and receiver processing operations are synchronized and wherein the transmission occurs over a number of repeated cycles and wherein the transmission may be random from one cycle to the next or there may be a non-random repeating pattern as described below.

Several alternatives and variations of this method may be implemented. For example, in addition to transmitting at variable times within several time intervals, the pulse widths themselves may be varied either randomly or in a non-random repeating pattern or the transmissions may occur in a non-random repeating pattern. For example, the transmission pulses shown in FIG. 8A in the six time intervals may be non-random but repeating. If the pattern is long enough (e.g. over many time intervals) it may have the same effect as transmitting the pulses randomly. FIG. 8D shows an alternative embodiment in which the pulses may be generated randomly for a set of intervals. In the case of FIG. 8D, the set of intervals is three intervals. In other words, a transmission pulse is randomly timed during the first of the three intervals and then repeated at the same time for the second and third intervals of the first set and then a new random time is generated for the next interval and repeated for the next two intervals. The receiver's processing is synchronized as shown in FIG. 8D such that the receiver's processing will have the same random time for the first time interval in a set and repeat that random time in the second and third intervals and then move on to a new random time which corresponds to the new transmission pulse time in the first interval of the set of three intervals.

Figure 9:
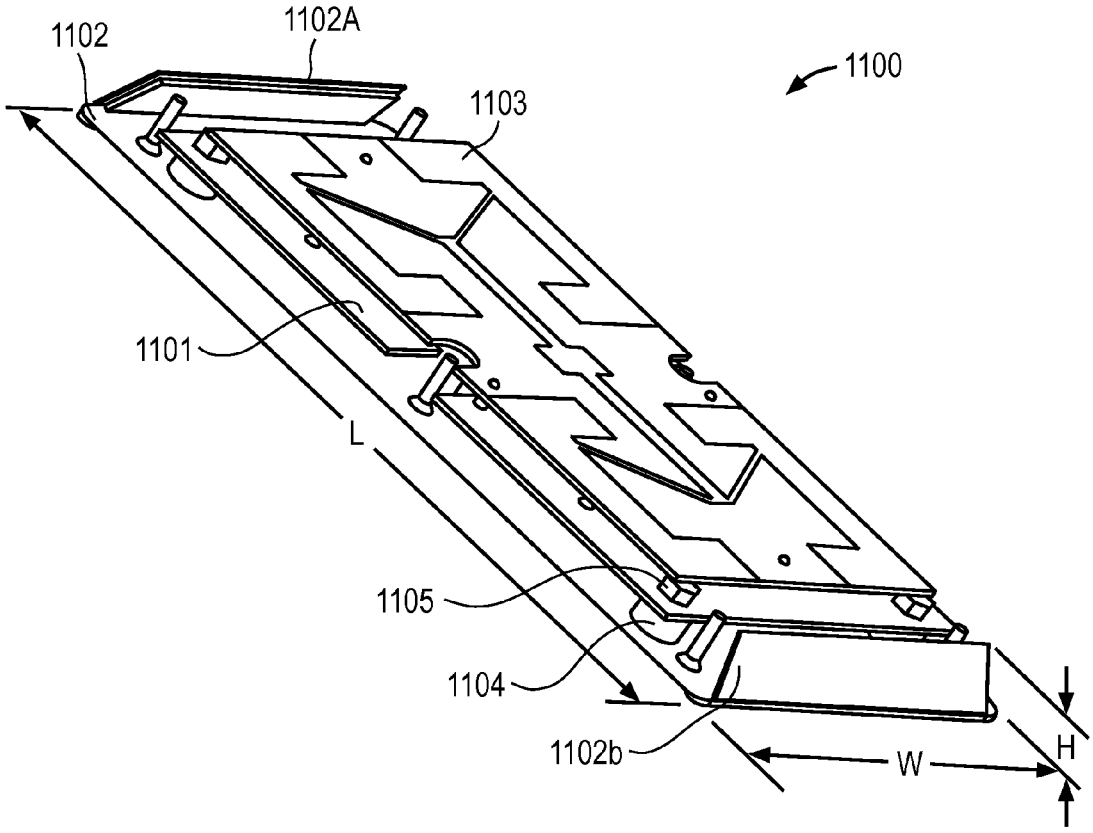
FIG. 9 illustrates an exemplary antenna assembly according to one embodiment of the inventions described herein.

FIG. 9 illustrates the antenna assembly 1100 in one embodiment. The antenna assembly may include a transmit antenna 1101, a ground plane or parasitic reflector 1102, and a receive antenna 1103 in a stacked configuration. In one embodiment, antenna assembly 1100 may operate at a fundamental frequency of approximately 915 MHz and may occupy a volume less than 135 cubic centimeters. Antenna assembly 1100 may have a length (L) no greater than 15 cm, a width (W) no greater than 9 cm and a height (H) no greater than 1 cm.

In one embodiment, transmit antenna 1101 may be a planar antenna tuned and fed to have a radiation pattern with a maximum transmission gain (maximum radiation intensity) in a direction (boresight) that is substantially perpendicular to the plane of transmit antenna 1101. In one embodiment, the transmit antenna may be a patch antenna as illustrated in FIG.

Figure 10:
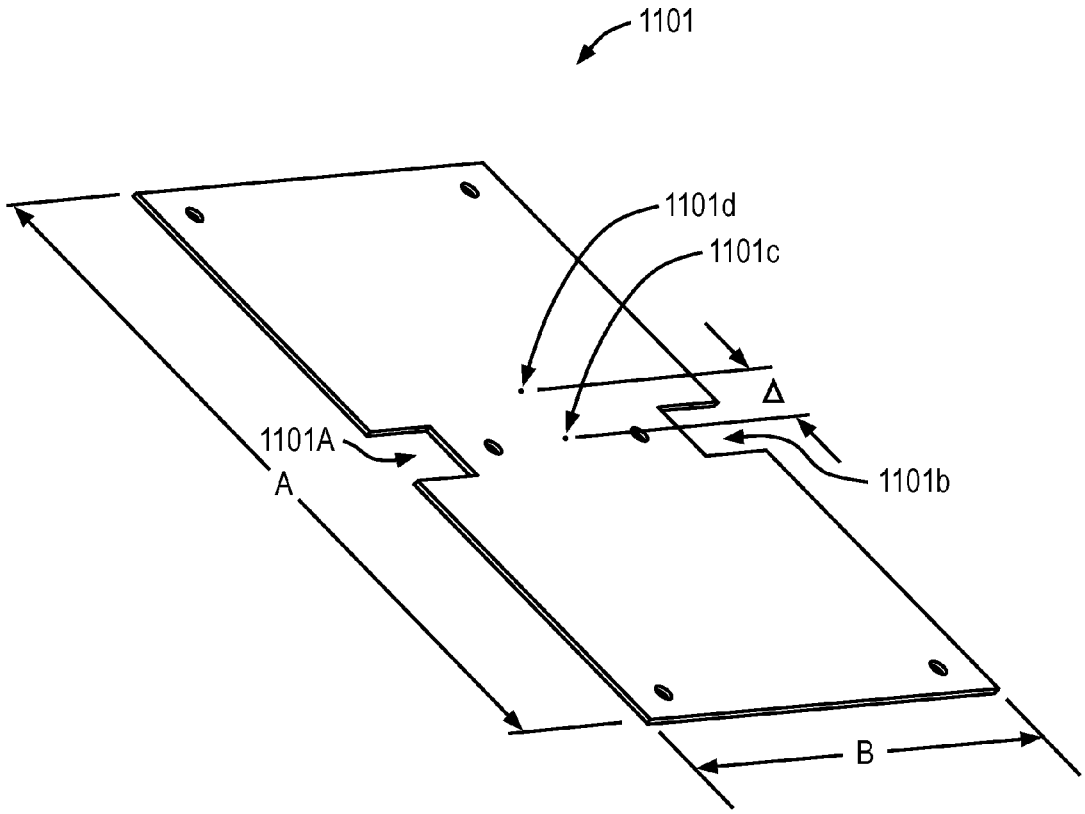
FIG. 10 illustrates an exemplary embodiment of a transmit antenna which may be a patch antenna.

10. Transmit antenna 1101 may operate at approximately 915 MHz and may have a length A of approximately 12 centimeters (cm) and a width B of approximately 8 cm. Transmit antenna 1101 may have notches 1101*a* and 1101*b* as illustrated in FIG. 10 to inductively load transmit antenna 1101 (i.e., to increase its electrical length) and cause antenna 1101 to resonate at or near 915 MHz. Transmit antenna 1101 may have a gain in the range of approximately 5 dB to 12 dB relative to an isotropic radiator (i.e., 5-12 dBi). Transmit antenna 1101 may also be driven at an off-center feedpoint 1101*c* at a distance Δ from the centerline of transmit antenna 1101 to achieve a driving point impedance that matches a desired characteristic impedance (e.g., 50 ohms or 75 ohms). In one embodiment, for example, Δ may be approximately less than or equal to one-quarter wavelength at the transmit frequency. Techniques for loading and impedance matching antennas are known in the art and, accordingly, are not described in detail.

In one embodiment, transmit antenna 1101 may be fabricated from a piece of metallized dielectric material such as 0.031 inch thick G10/FR-4 fiberglass-epoxy laminate material with rolled or plated copper, for example. Alternatively, transmit antenna 1101 may be fabricated from a sheet metal such as copper, aluminum, brass or the like. Metallic portions of transmit antenna 1101 may be plated or otherwise coated to prevent corrosion as is known in the art.

Ground plane 1102 may be disposed substantially parallel to transmit antenna 1101 and spaced from transmit antenna 1101 by one or more insulating spacers 1104. Ground plane 1102 may be approximately 15 cm long by 9 cm wide. Ground plane 1102 may be fabricated from sheet metal as described above and may have flanges 1102*a* and 1102*b* to facilitate beam forming as described below.

Ground plane 1102 may perform at least two functions with respect to transmit antenna 1101. First, the spacing of ground plane 1102 from transmit antenna 1101 may be selected to control the impedance of transmit antenna 1101 and/or the shape of the radiation pattern of transmit antenna 1101. In one embodiment, the spacing between transmit antenna 1101 and ground plane 1102 may be approximately 5 mm. Second, ground plane 1102 functions as a shield to limit radiation from transmit antenna 1101 in the direction opposite to the direction of maximum radiation intensity, thereby increasing the front-to-back ratio of transmit antenna 1101 as described in greater detail below.

Receive antenna 1103 may be a planar antenna array disposed substantially parallel to transmit antenna 1101, and spaced from transmit antenna 1101 by one or more insulating spacers 1105. In one embodiment, receive antenna 1103 may operate approximately at the second harmonic of the transmit antenna frequency. In other embodiments, receive antenna 1103 may operate at the third harmonic of the transmit antenna frequency. Receive antenna 1103 may be approximately 11 cm long by 7 cm wide. In one embodiment, receive antenna 1103 may be tuned and fed to have a reception pattern with a maximum reception gain (maximum receiving sensitivity) in a direction (boresight) that is substantially the same as the direction of maximum transmission gain of transmit antenna 1101 (i.e., substantially perpendicular to the plane of transmit antenna 1101) and may have a gain in the range of approximately 7 to 14 dBi at the second harmonic of the transmit antenna frequency. In other embodiments, receive antenna 1103 may be operated at the third harmonic of the transmit frequency.

Figure 11:
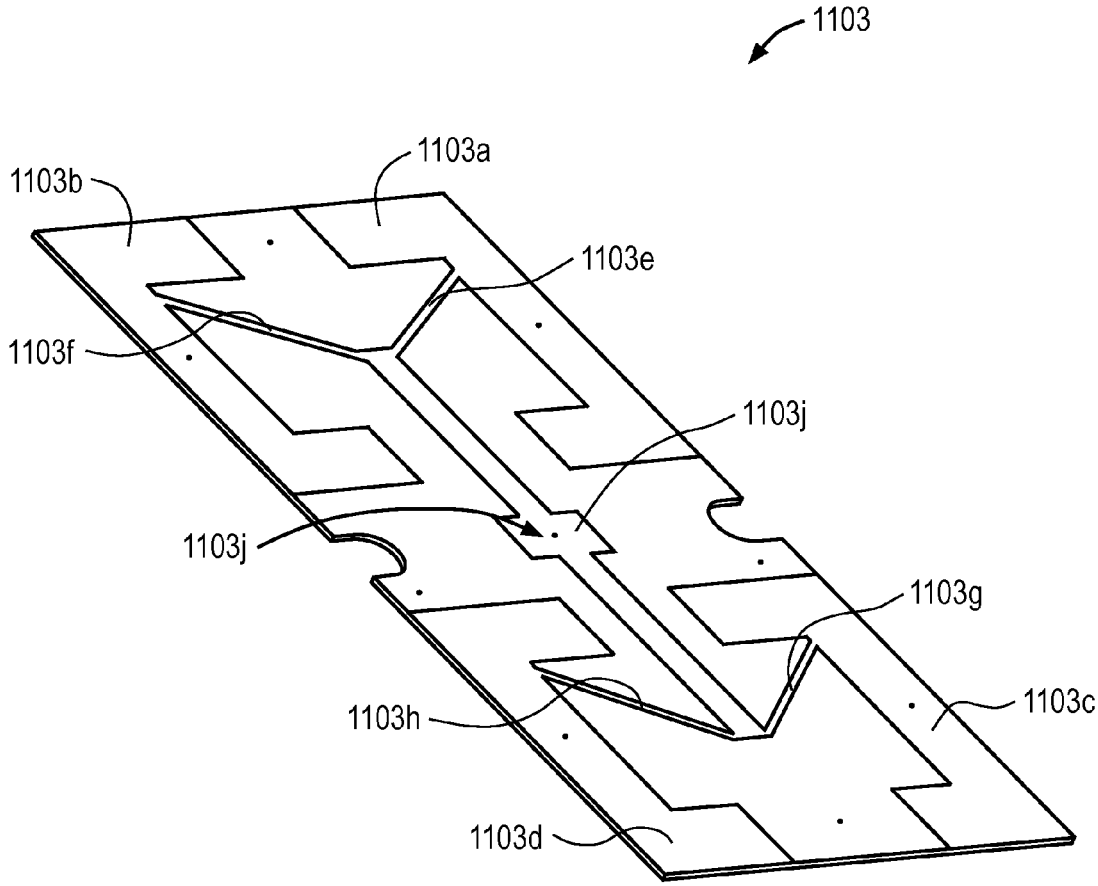
FIG. 11 illustrates an exemplary embodiment of a receive antenna.
Figure 12:
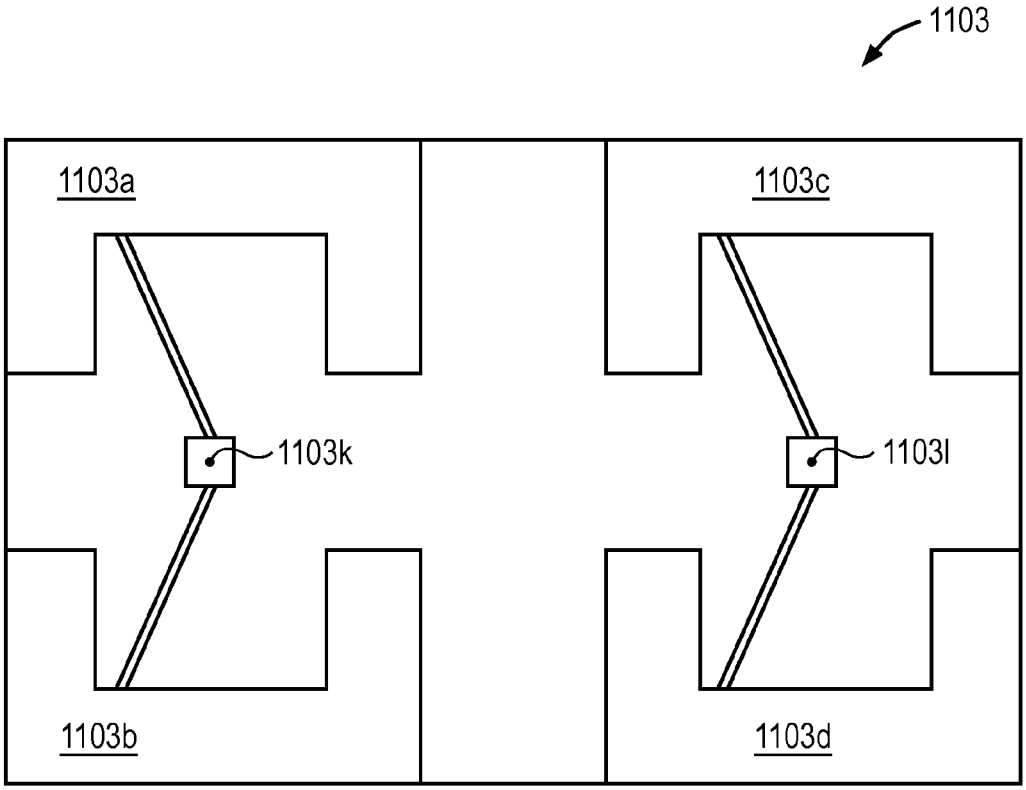
FIG. 12 illustrates another exemplary embodiment of a receive antenna.

In one embodiment, as illustrated in FIG. 11, receive antenna 1103 may include four folded dipoles 1103*a*-1103*d* arrayed around the perimeter of receive antenna 1103, which may be fed from a common feedpoint 1103*j* by an impedance matching network consisting of lengths of transmission line 1103*e*-1103*i* of various impedances to match receive antenna 1103 to a desired impedance (e.g., 50 ohms or 75 ohms). Antenna impedance matching is know in the art and, accordingly, is not described in detail. In other embodiments, as illustrated in FIG. 12 and described in greater detail below, the folded dipoles 1103*a*-1103*d* may be matched as pairs of dipoles (e.g., pair 1103*a* and 1103*b*, and pair 1103*c* and 1103*d*) and fed separately from feedpoints 1103*k* and 11031 to create desirable antenna pattern effects.

The electrical length of each folded dipole may be approximately one-half wavelength at the operating frequency of the receive antenna. Receive antenna 1103 may be fabricated from a metallized dielectric material or from sheet metal as described above in the case of the transmit antenna 1101.

Transmit antenna 1101 may function as a ground plane or parasitic reflector with respect to receive antenna 1103, in a manner analogous to ground plane 1102 with respect to transmit antenna 1102. That is, the spacing between transmit antenna 1101 and receive antenna 1103 may be selected to control the impedance of receive antenna 1103 and/or the shape of the reception pattern of receive antenna 1103. In one embodiment, the spacing between the transmit antenna 1101 and the receive antenna 1103 may be approximately 3 mm. In addition, transmit antenna provides a shield to limit the reception of receive antenna 1103 in the direction opposite to the direction of maximum reception gain, thus increasing the front-to-back ratio of receive antenna 1103 as described below.

It will be appreciated that a point at approximately the center of each folded half-wave dipole 1103*a*-1103*d* of receive antenna 1103 will represent a voltage null at the receive frequency. Therefore, those points may be electrically connected to transmit antenna 1101, as described in greater detail below, without disturbing the performance of receive antenna 1103, at least to a first order effect. In contrast, the electrical connections between the receive antenna 1103 and the transmit antenna 1101 may not correspond to voltage nulls on the transmit antenna at the transmit frequency. Therefore, the folded dipoles 1103*a*-1103*d* may function as driven elements of the transmit antenna 1101, which may be used to improve the impedance characteristics and/or shape the radiation pattern of transmit antenna 1101.

Figure 13:
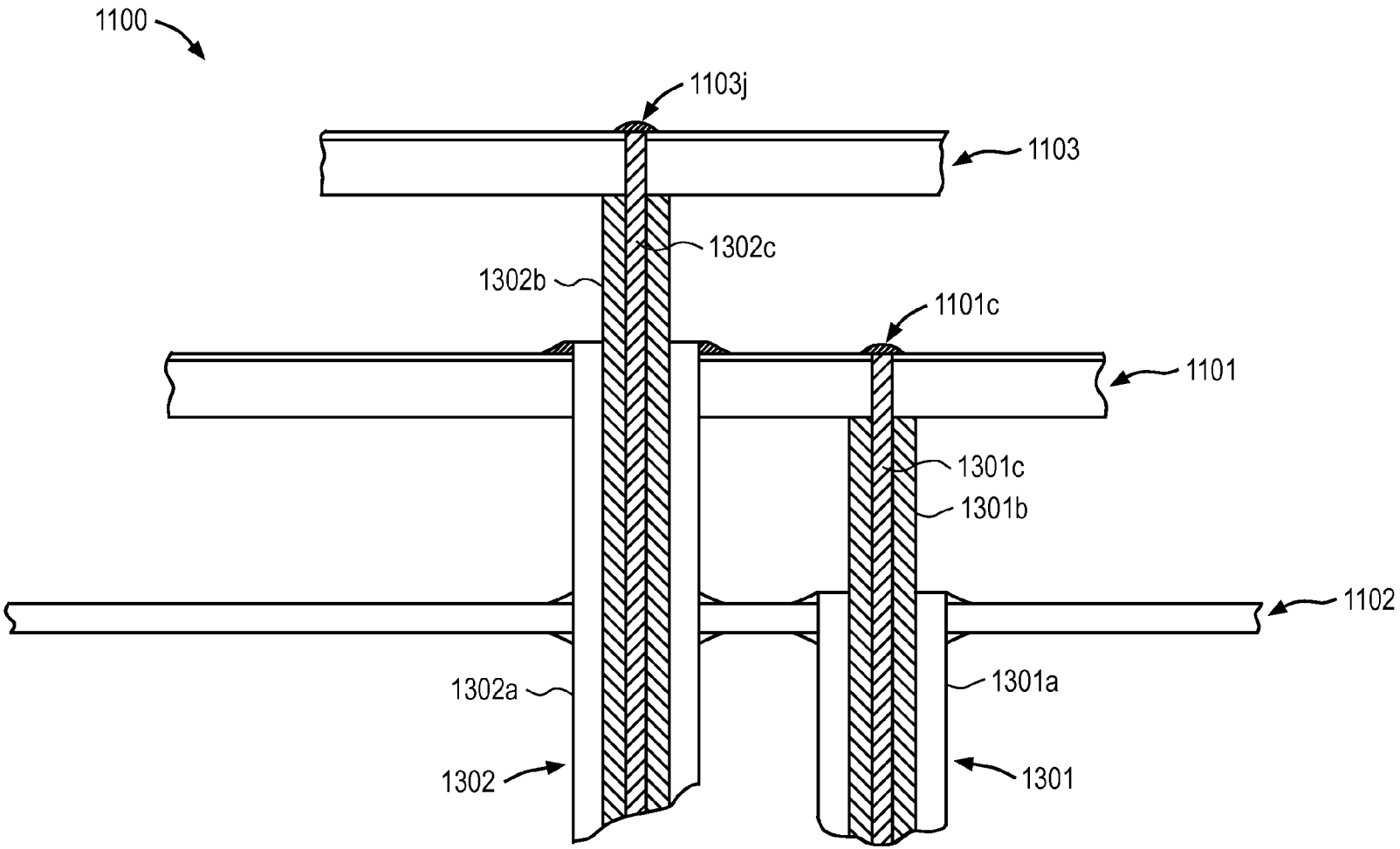
FIG. 13 illustrates a cross-sectional view of an antenna assembly showing a transmit antenna, a ground plane, and a receive antenna, and their relationship.

FIG. 13 illustrates a cross-sectional view through the centerline of the long axis of antenna assembly 1100 showing how transmit antenna 1101, ground plane 1102 and receive antenna 1103 may be interconnected in one embodiment. In FIG. 13, a coaxial cable 1301 includes an outer conductor 1301*a*, a dielectric insulator 1301*b* and a center conductor 1301*c*. Coaxial cable 1301 may be, for example, a semi-rigid coaxial cable, conformable coaxial cable or the like. The center conductor 1301*c* of coaxial cable 1301 may be soldered (or otherwise conductively bonded) to transmit antenna 1101 at feedpoint 1101*c*. The outer conductor 1301*a* of coaxial cable 1301 may be soldered (or otherwise conductively bonded) to ground plane 1102. Thus, transmit frequency return currents in outer conductor 1301*a* which correspond to transmit frequency signal currents in center conductor 1301*c* will be coupled to ground plane 1102 and ground plane 1102 will act as a ground plane for transmit antenna 1101.

In FIG. 13, a second coaxial cable 1302 includes an outer conductor 1302*a*, a dielectric insulator 1302*b* and a center conductor 1302*c*. The center conductor 1302*c* of coaxial cable 1302 may be soldered (or otherwise conductively bonded) to receive antenna 1103 at feedpoint 1103*j*, for example. The outer conductor 1302*a* of coaxial cable 1302 may be soldered (or otherwise conductively bonded) to transmit antenna 1101 at the centerpoint 101*d* of transmit antenna 1101, and also soldered to ground plane 1102. Thus, receive frequency return currents in outer conductor 1302*a,* which correspond to receive frequency signal currents in center conductor 1302*c,* will be coupled to transmit antenna 1101 which will act as a ground plane for receive antenna 1103. Recalling that transmit antenna 1101 is designed to resonate at the transmit frequency, it will be appreciated that centerpoint 101*d* of transmit antenna 1101 may be located at a voltage null on transmit antenna 1101. Therefore, the direct connection of outer shield 1302*a* between transmit antenna 1101 and ground plane 1102 will have no effect on the current distribution in transmit antenna 1101, at least to a first order approximation.

The performance of antenna assembly 1100 may be closely related to the symmetry of the distribution of currents in the ground planes and active elements of transmit antenna 1101, receive antenna 1103 and ground plane 1102. The symmetry of the currents can be disturbed by mechanical asymmetries in the antenna assembly. To maintain mechanical symmetry, both coaxial cable 1301 and coaxial cable 1302 should be perpendicular to the short axis (W dimension) of antenna assembly 1100 and ground plane 1102, transmit antenna 1101 and receive antenna 1103. By extension, ground plane 1102, transmit antenna 1101 and receive antenna 1103 should be mutually parallel (e.g. rigidly fixed to maintain a consistent and uniform distance of separation between the antennas and ground plane and any radome).

Figure 28:
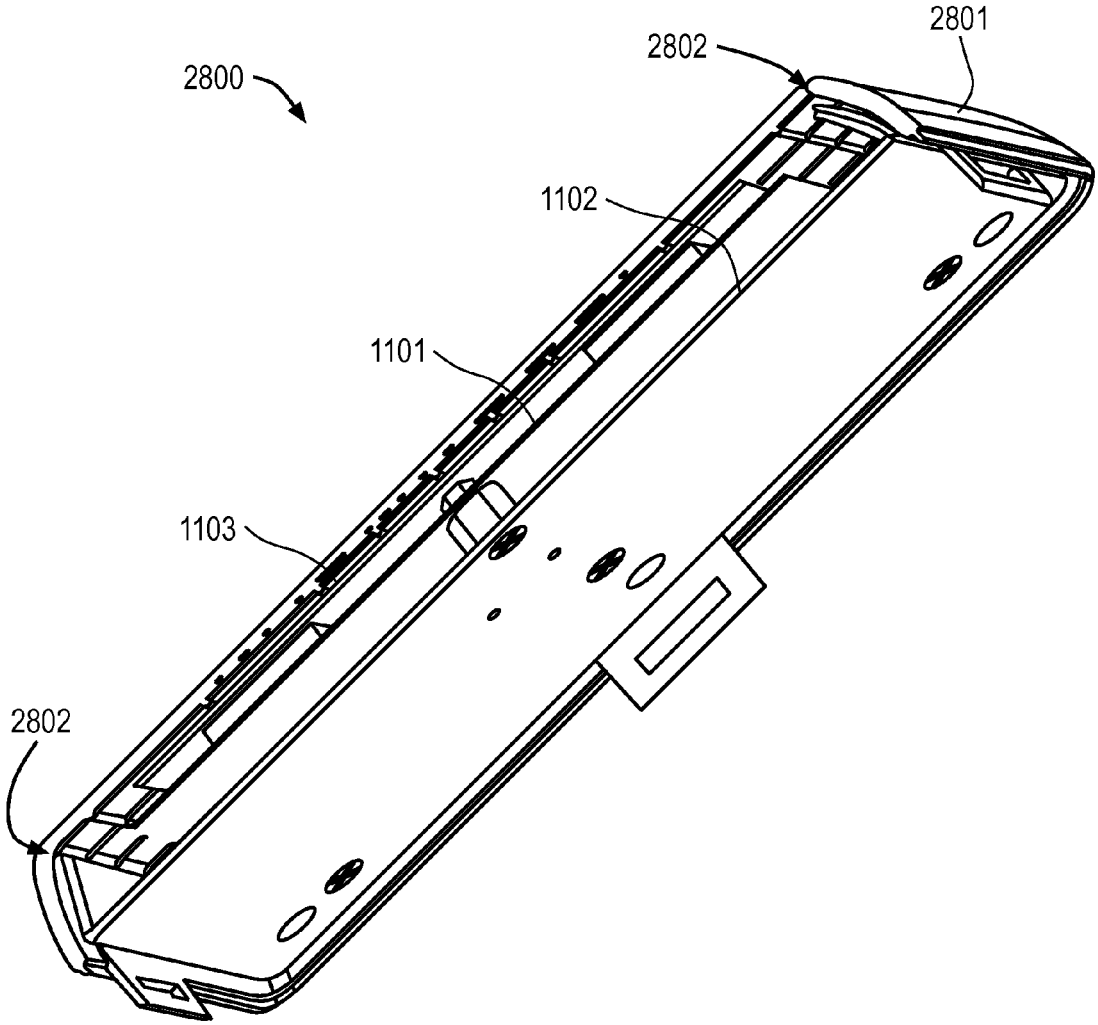
FIG. 28 illustrates a radome assembly in one embodiment of the inventions described herein.

The location of the antenna assembly 1100 should be relatively fixed with respect to any antenna radome that covers the antenna assembly 1100 to minimize unintentional phase and/or amplitude noise due to relative motion between the radome and the antenna assembly 1100. FIG. 28 illustrates a cross-sectional view of an exemplary radome assembly 2800. Radome assembly 2800 includes a radome 2801 that may be mechanical attached and/or indexed to antenna assembly 1100 (ground plane 1102, transmit antenna 1101, and receive antenna 1103) using methods known in the art. Radome 2801 may have indexing ledges 2802 or other similar features which may be used to align and fix the position of antenna assembly 100 with respect to radome 2801.

Figure 29A:
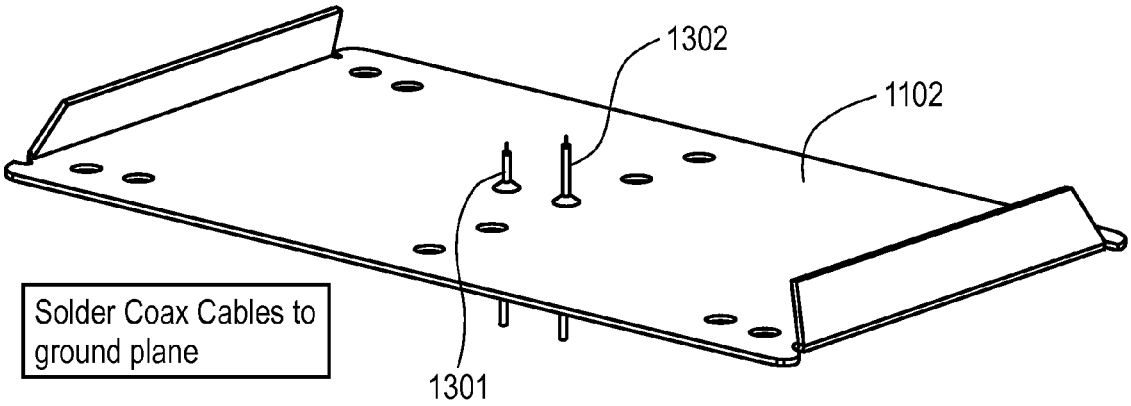
FIGS. 29A-29G illustrate assembly details of the exemplary antenna assembly of FIG. 9.
Figure 29B:
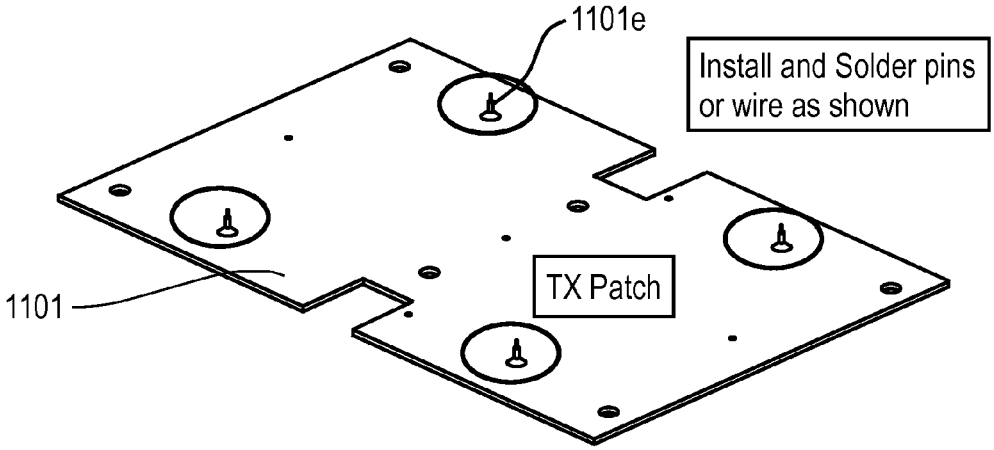
Figure 29C:
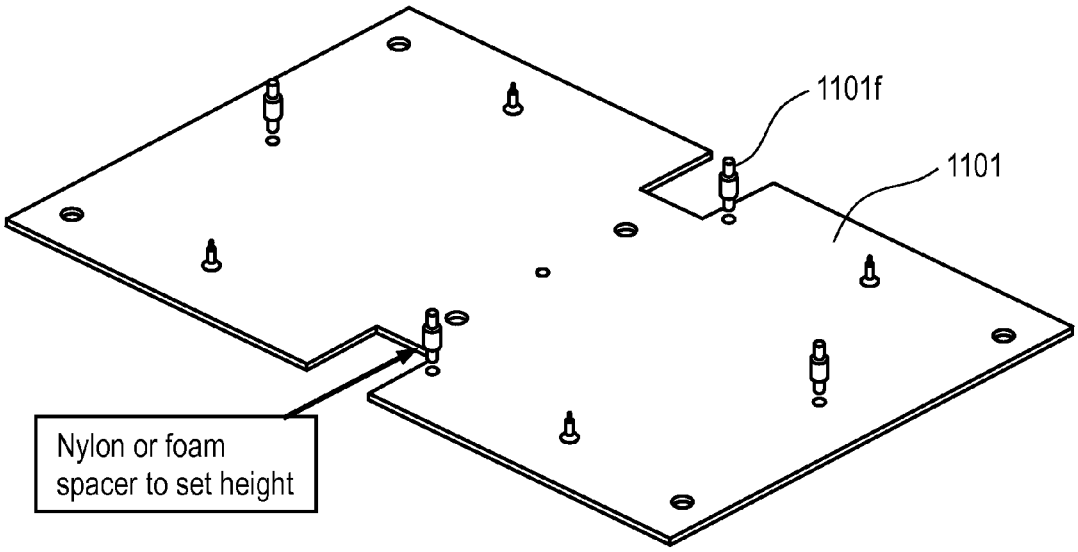
Figure 29D:
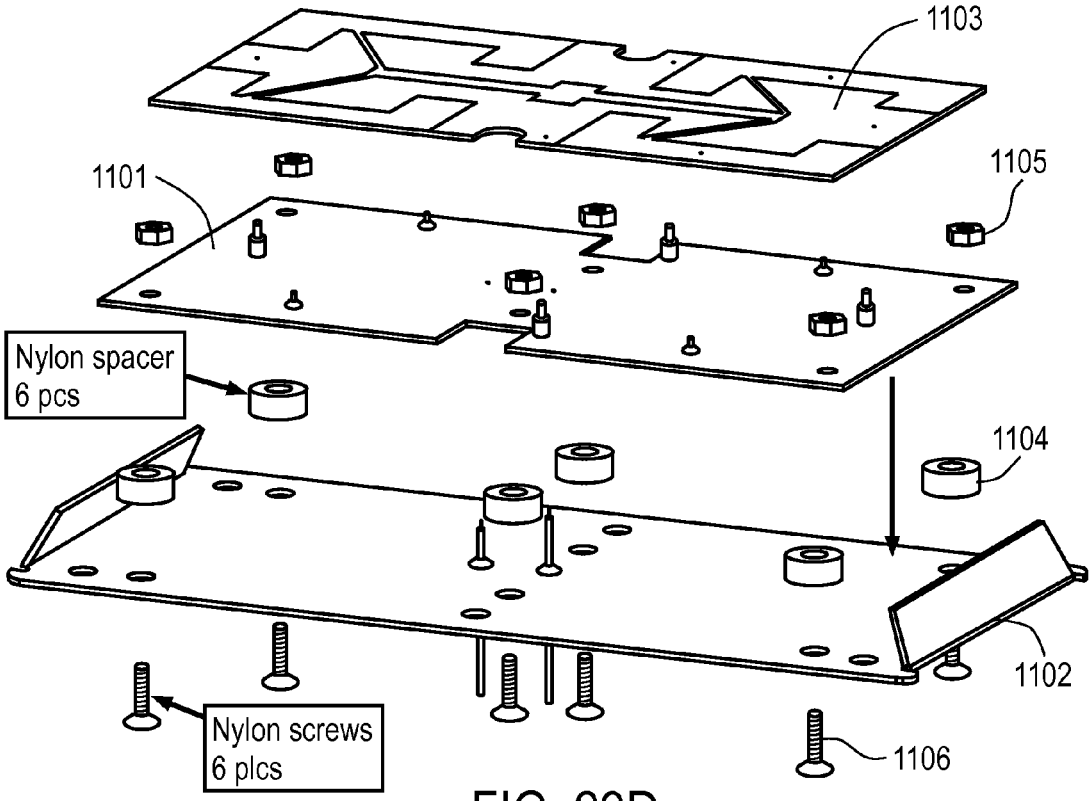
Figure 29E:
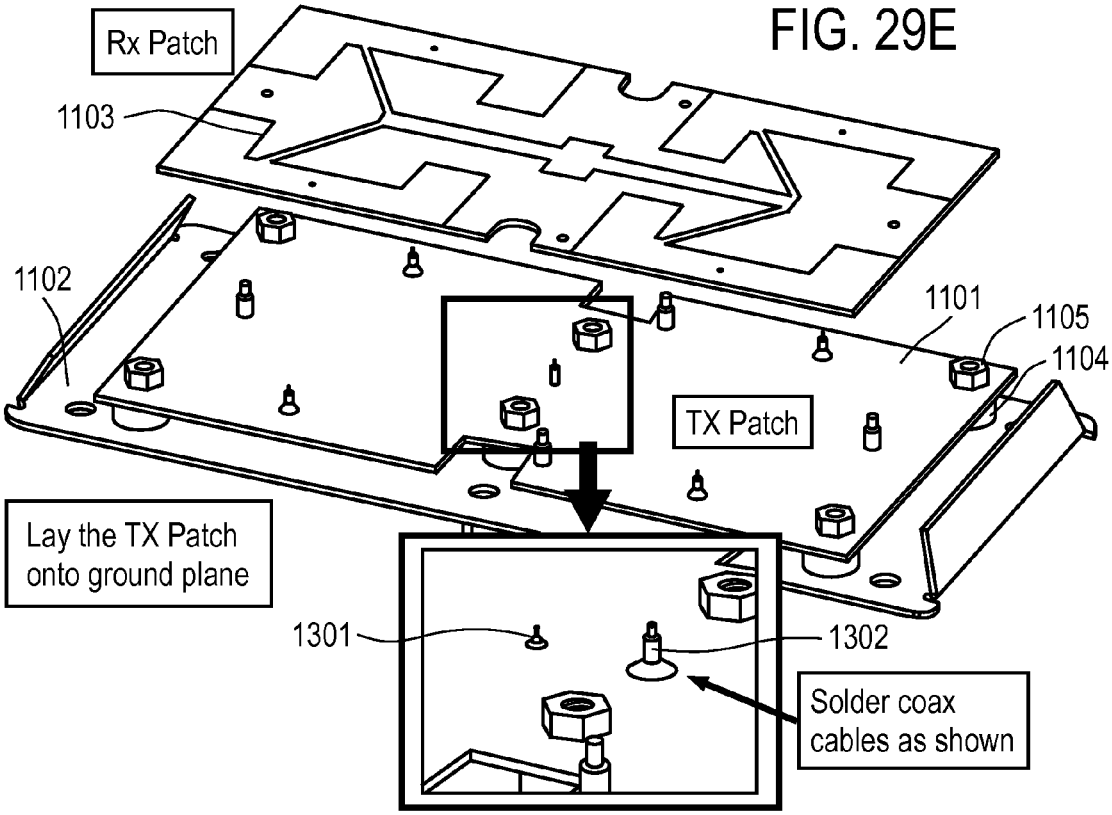
Figure 29F:
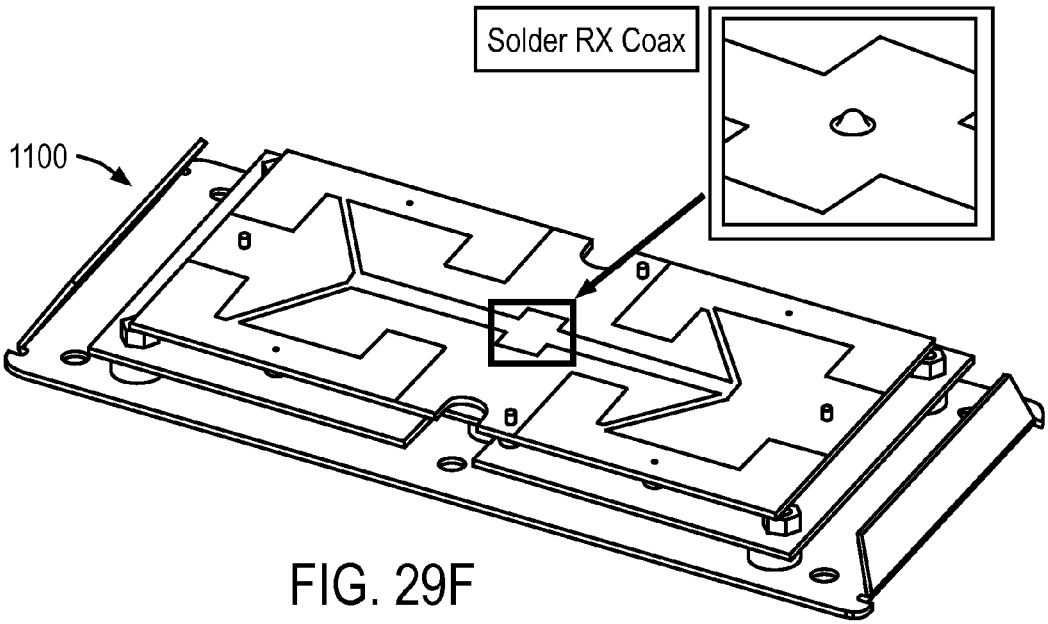
Figure 29G:
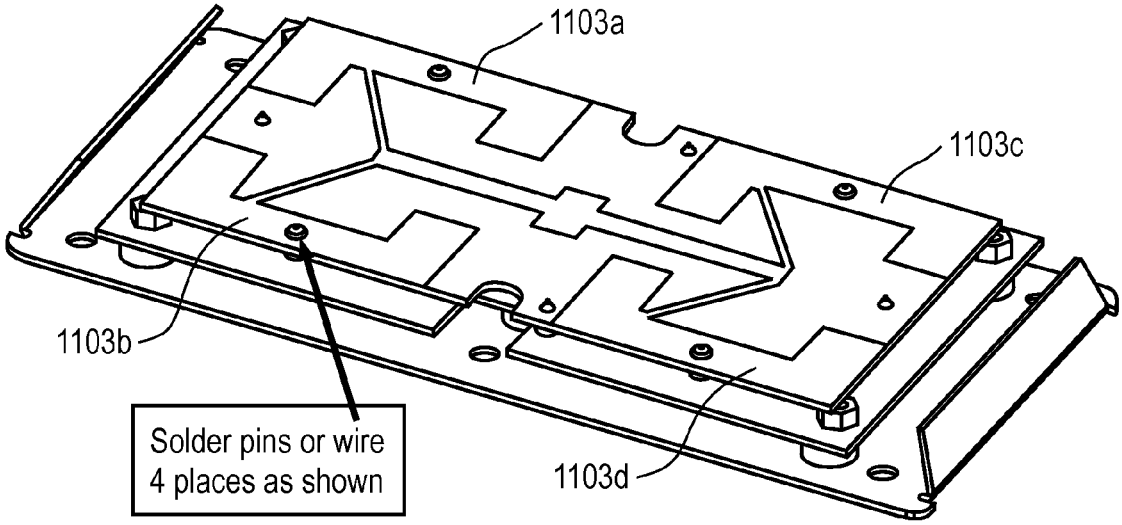

FIGS. 29A-29G illustrate assembly details of antenna assembly 1100 in one embodiment. In each of the assembly operations described below, it will be appreciated that assembly fixtures and tools, known in the art, may be used to facilitate the assembly. FIG. 29A illustrates how coaxial cables 1301 and 1302 may be soldered to ground plane 1102, perpendicular to ground plane 1102 in one embodiment. FIG. 29B illustrates how conductive pins or wires 1101*e* may be soldered to transmit antenna 1101, which may be used to connect transmit antenna 1101 to receive antenna 1103 as described above. FIG. 29C illustrates how insulating spacers (e.g., nylon or foam or the like) 101*f* may be placed in transmit antenna 1101 to subsequently control the spacing between transmit antenna 1101 and receive antenna 1103. FIG. 29D illustrates an exploded view of the antenna elements 1101, 1102 and 1103, and of the assembly hardware which may include: insulating screws (e.g., nylon or the like) 1106; insulating spacers 1104 to control the spacing between the transmit antenna 1101 and the ground plane 1102; and insulating nuts 1105 to secure the transmit antenna 1101 to the ground plane 1102. FIG. 29E illustrates how the inner conductor of coaxial cable 1301 and the outer conductor of coaxial 1302 may be soldered to transmit antenna 1101 after transmit antenna 1101 is secured to ground plane 1102. FIG. 29F illustrates how the center conductor of coaxial cable 1302 may be soldered to receive antenna 1103 after receive antenna 1103 is seated on insulating spacers 1101*f.* Finally, FIG. 29G illustrates how conductive pins 1101*e* may be soldered to receive antenna 1103 at the centerpoints of folded dipoles 1103*a*-1103*d* as described above.

Figure 14A:
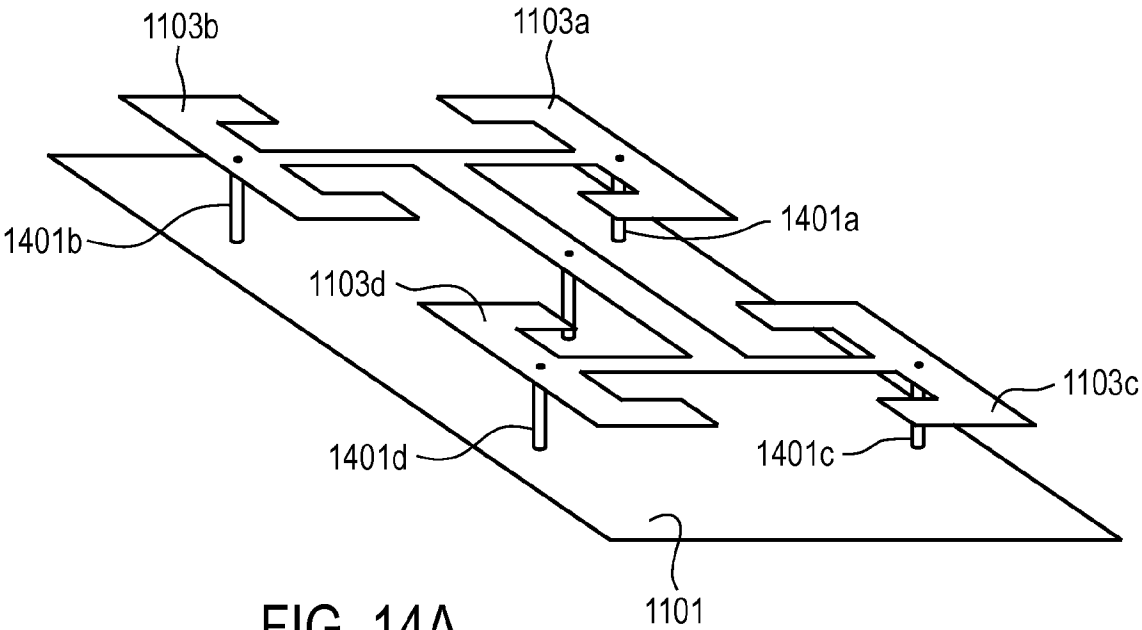
FIG. 14A shows in perspective view one exemplary embodiment in which portions of the receive antenna may be coupled with portions of the transmit antenna.
Figure 14B:
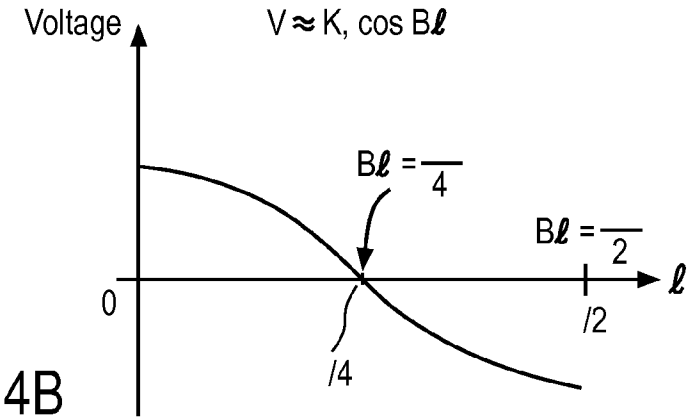
FIG. 14B illustrates the voltage distribution of elements of the receive antenna shown in FIG. 14A.

In one embodiment, as illustrated in FIG. 14A, the half-wave dipole elements 1103*a*-1103*d* of receive antenna 1103 may be additionally coupled with transmit antenna 1101 and function as active elements of transmit antenna 1101 without otherwise disturbing the performance of receive antenna 1103 (at least to a first order approximation). In FIG. 14A, conductive coupling wires (e.g., solid wires or the outer conductors of coaxial cables) 1401*a*-1401*d* may be connected between transmit antenna 1101 and the respective half-wave dipole elements 1103*a*-1103*d* of receive antenna 1103. In one embodiment, the point of connection on the respective dipole may be chosen to be the electrical center of the dipole at the receive frequency. FIG. 14B illustrates the voltage distribution on a half-wave dipole, such as dipoles 1103*a*-1103*d,* at resonance. In FIG. 14B, $\beta$ is the propagation constant in the medium of the dipole and is equal to $2\pi/\lambda$, where $\lambda$ is the wavelength in the medium. The voltage at any point on the resonator is proportional to $\cos(\beta 1)$, where 1 is the distance from one end of the resonator. Thus, if the electrical length of the dipole is $\lambda/2$, then the voltage is zero at $\frac{1}{2}=\lambda/4$. As a result, placing conductors between the transmit antenna 1101 and dipole resonators such as dipoles 1103*a*-1103*d* has no effect (at least to a first order approximation) on the performance of receive antenna 1103.

In contrast, at the transmit frequency (which may be one half the receive frequency as noted above), each of the dipoles 1103*a*-1103*d* have a non-zero voltage and a non-zero driving point impedance. Therefore, dipole elements 1103*a*-1103*d* may be used, for example, to modify the driving point impedance of transmit antenna 1101 and/or to control the radiation pattern of transmit antenna 1101 (e.g., conform the radiation pattern of transmit antenna 1101 to the receive pattern of receive antenna 1103).

Figure 15A:
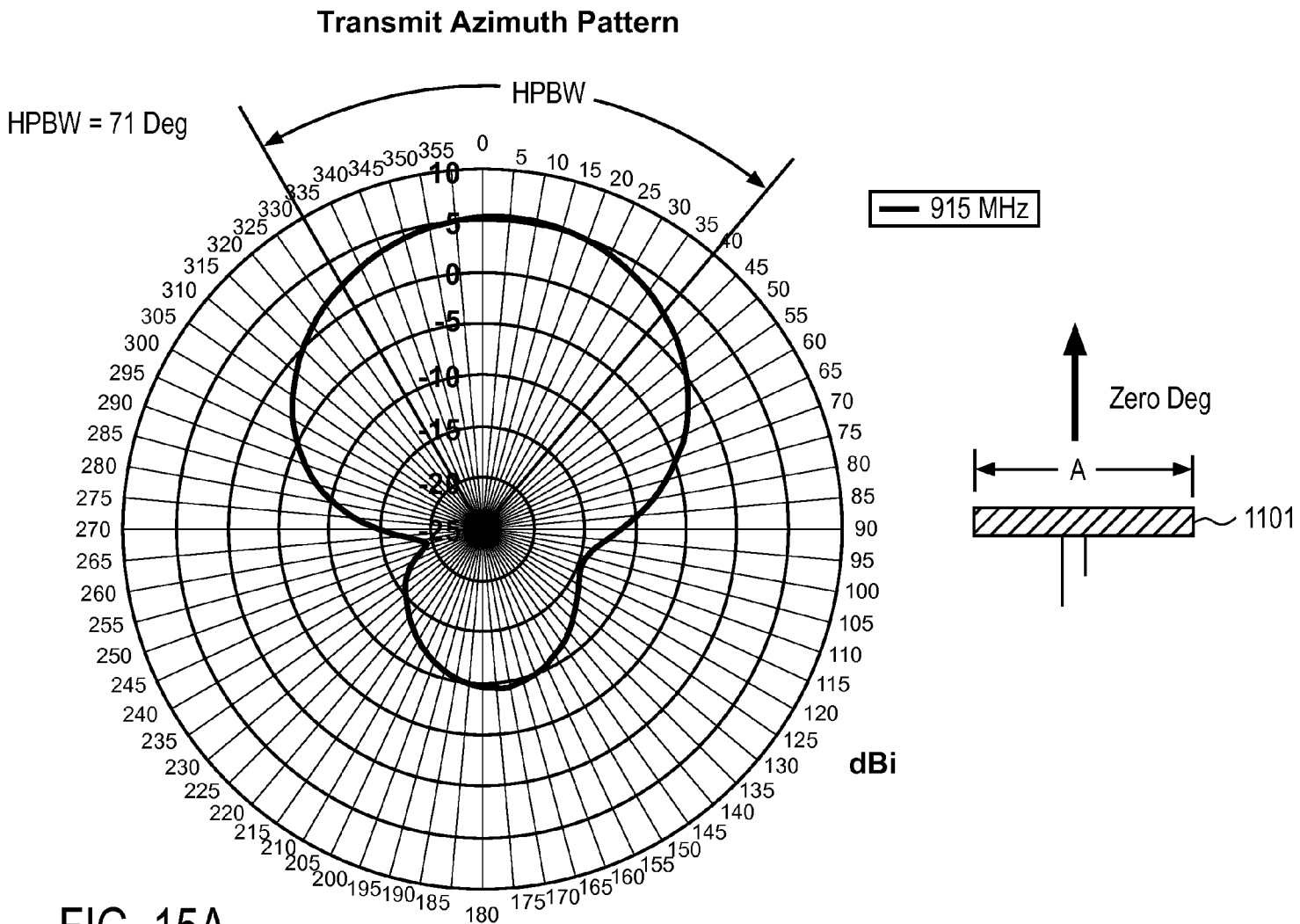
FIGS. 15A, 15B and 15C illustrate exemplary azimuth antenna patterns for the transmit antenna, the receive antenna, and the combination of these antennas, respectively, at certain frequencies as described herein.
Figure 15B:
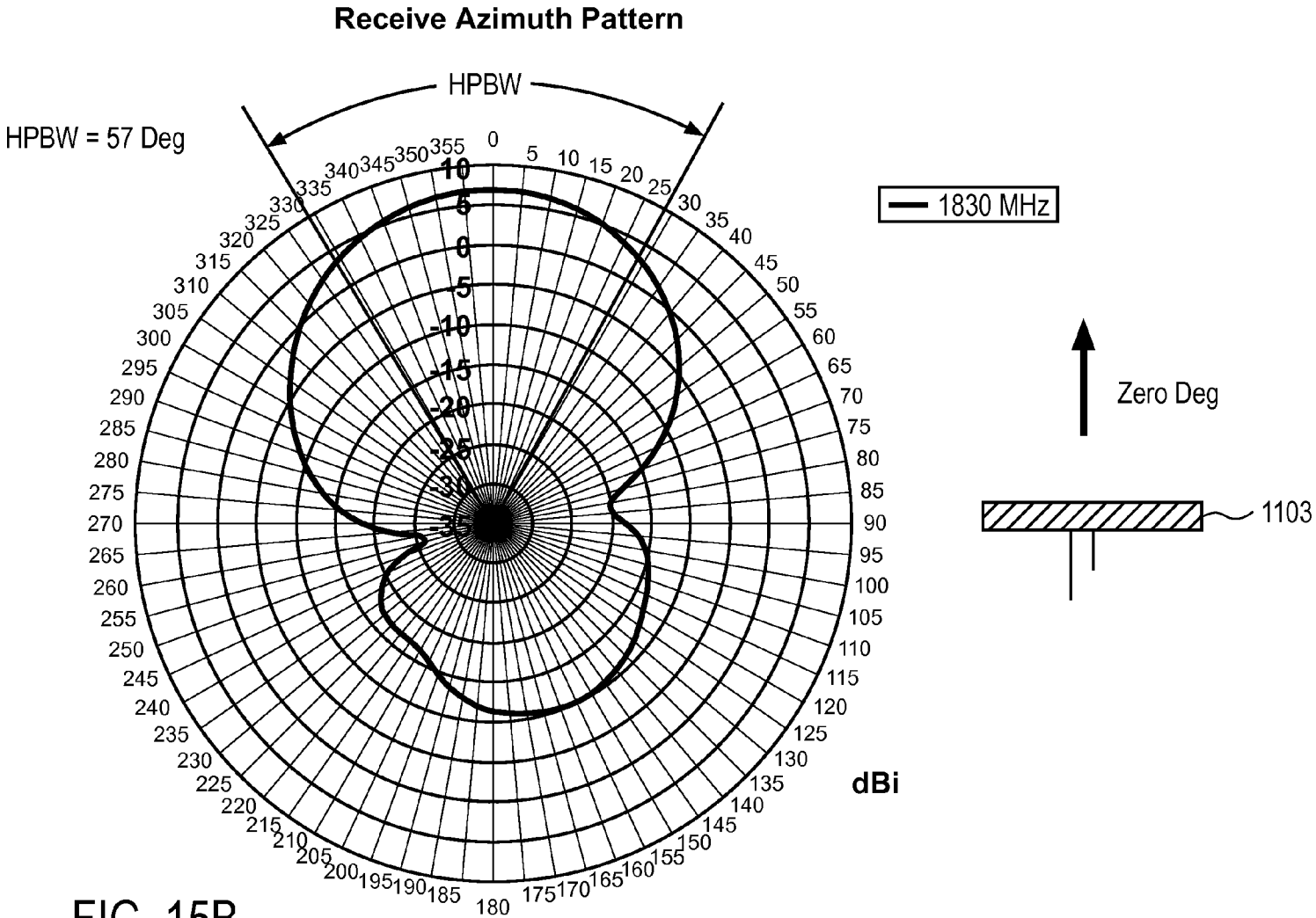
Figure 15C:
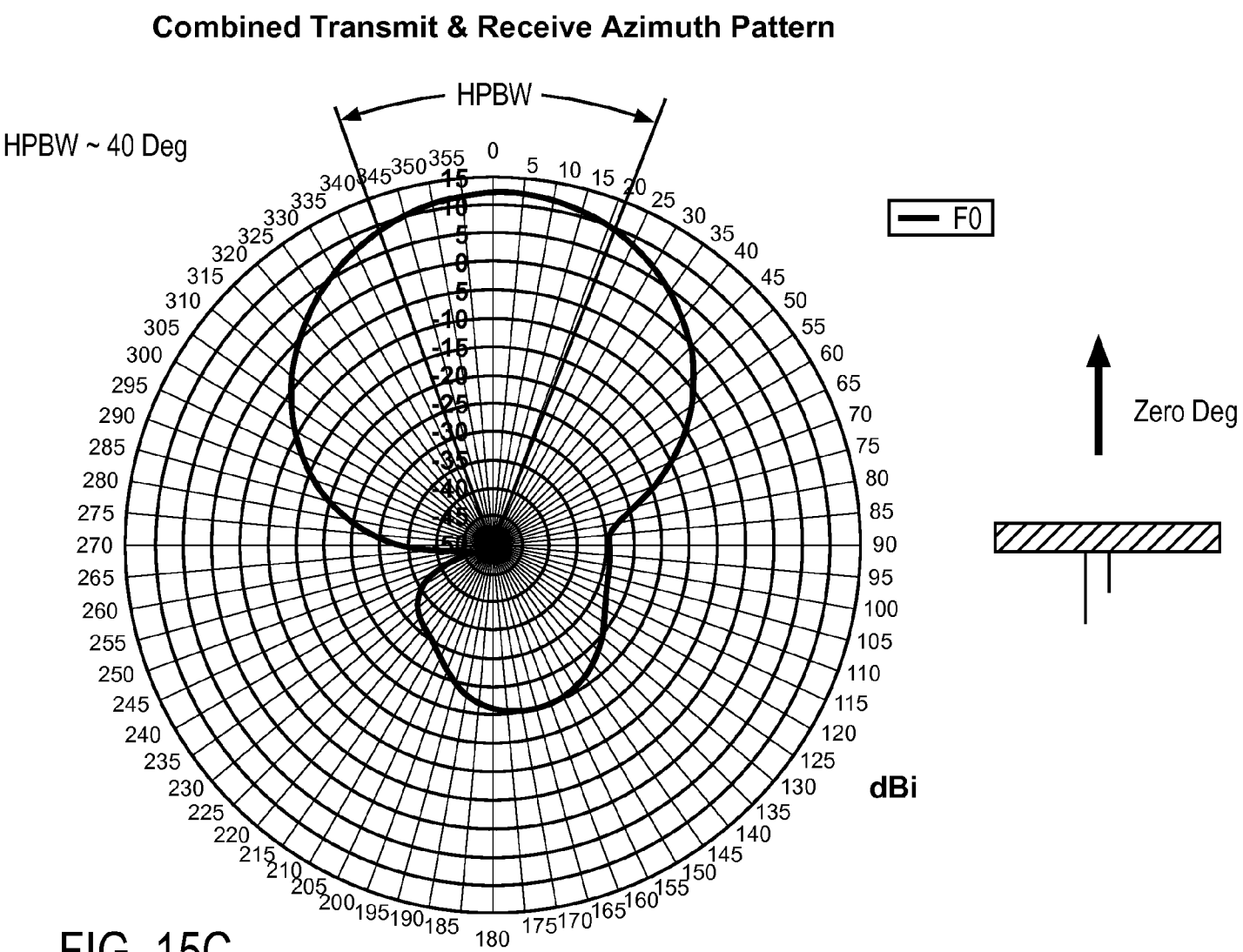

FIGS. 15A, 15B and 15C illustrate exemplary azimuth antenna patterns for transmit antenna 1101, receive antenna 1103 and the combination of transmit antenna 1101 and receive antenna 1103, respectively, for a design transmit frequency of 915 MHz and a receive frequency of 1830 MHz.

In FIG. 15A, zero degrees in azimuth corresponds to a direction approximately perpendicular to the plane of transmit antenna 1101. Transmit antenna 1101 may have a maximum gain in azimuth at approximately zero degrees in azimuth, a half-power beamwidth (HPBW) of approximately 70 degrees or less and a front-to-back ratio (ratio of forward lobe to backward lob) of approximately 4 dB or greater.

In FIG. 15B, zero degrees in azimuth corresponds to a direction approximately perpendicular to the plane of receive antenna 1103. Receive antenna 1103 may have a maximum gain in azimuth at approximately zero degrees in azimuth, a half-power beamwidth of approximately 60 degrees or less and a front-to-back ratio of approximately 4 dB or greater.

Figure 16A:
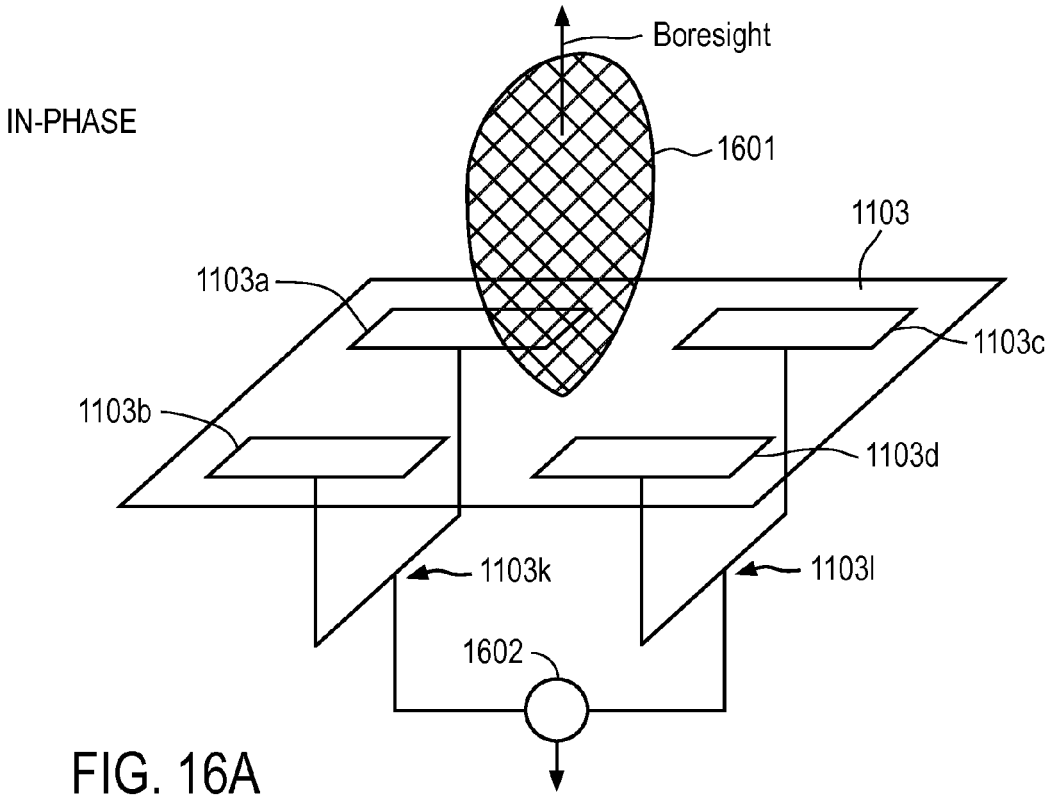
FIG. 16A shows an exemplary embodiment in which signals from receive antenna components are combined.

The antenna pattern illustrated in FIG. 15B is representative of receive antenna 1103 when the signals received by the individual elements 1103*a*-1103*d* are combined in phase. This configuration is illustrated schematically in FIG. 16A, where a signal combiner 1602 combines the signals from elements 1103*a* and 1103*b* at feedpoint 1103*k,* with the signals from elements 1103*c* and 1103*d* at feedpoint 11031. Signal combiner 1602 may be a resistive or reactive power combiner or any other type of RF signal combiner as is known in the art. The in-phase signals combine to yield an antenna pattern 1601 with a maximum gain in the direction of the boresight of the antenna, and a relatively broad HPBW (e.g., 60 degrees). This antenna pattern may be used to scan for a return signal from a golf ball which is configured to receive a signal from the transmit antenna 1101 and to return a signal at the receive frequency of the receive antenna. The broad beamwidth will produce a relatively constant response over a substantial range of azimuth angles, which is useful for acquiring the return signal and providing a relative indication of range. However, the broad beamwidth will not provide precise directional information because the strength of the received signal will be relatively insensitive to angular displacements of the receive antenna.

FIG. 15C illustrates the combined azimuth antenna patterns of transmit antenna 1101 and receive antenna 1103. In one embodiment, the combined patterns may have a maximum gain in azimuth of approximately 12.5 dBi, a half-power beamwidth of approximately 40 degrees or less and a front-to-back ratio of approximately 8 dB or greater.

Figure 16B:
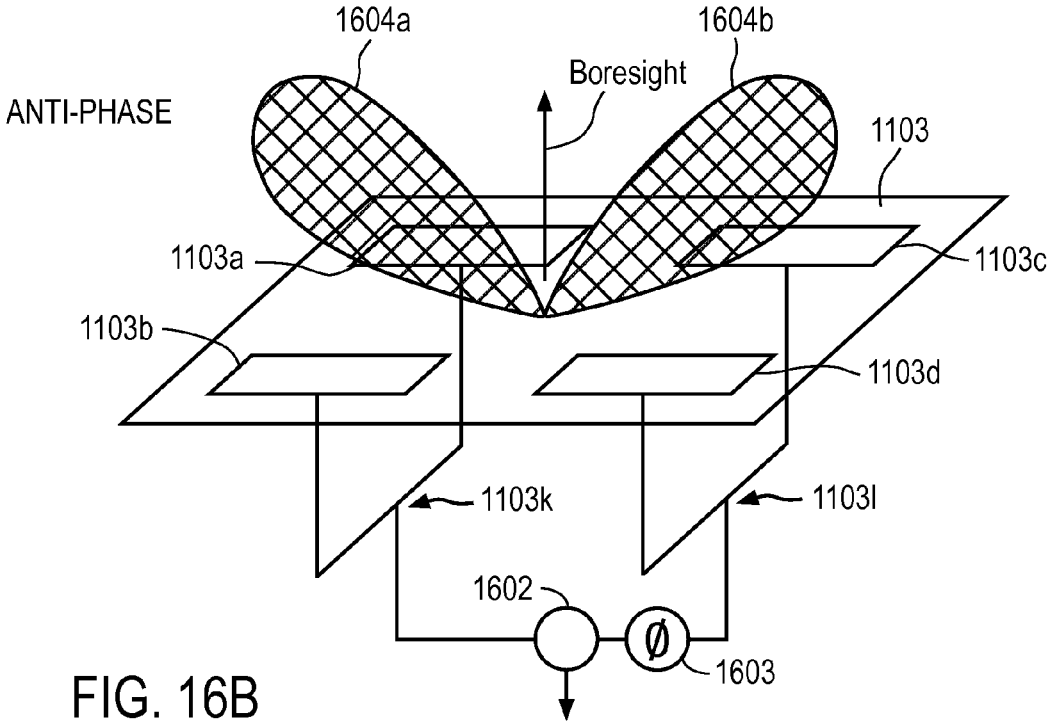
FIG. 16B shows an embodiment in which the antenna pattern of the receive antenna is modified by the use of a phase shifter.
Figure 17A:
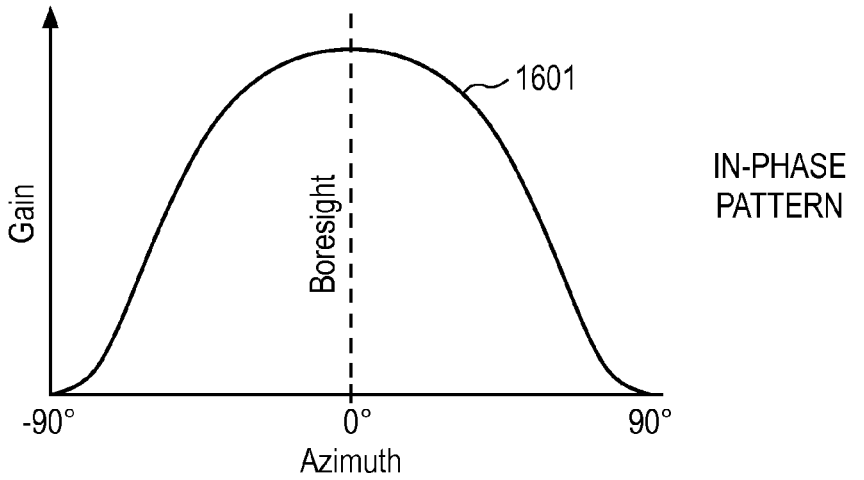
FIGS. 17A, 17B, and 17C illustrate, in graphs, effective antenna gain relative to azimuth angle as described further below.
Figure 17B:
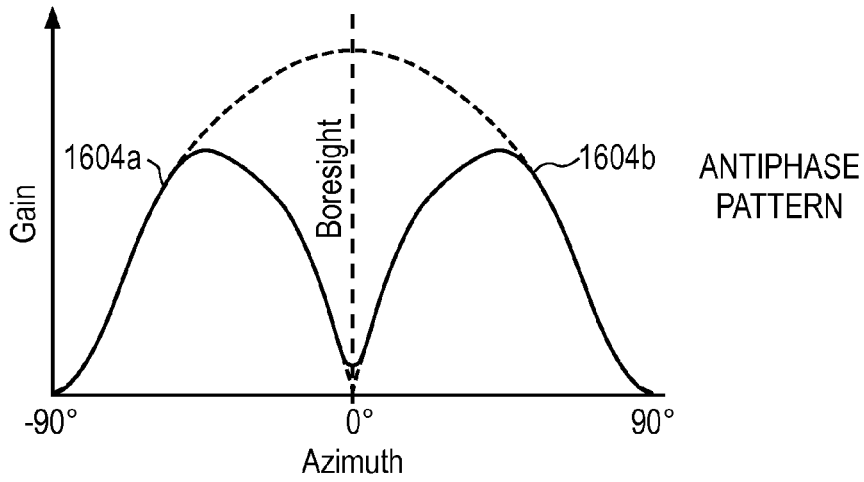
Figure 17C:
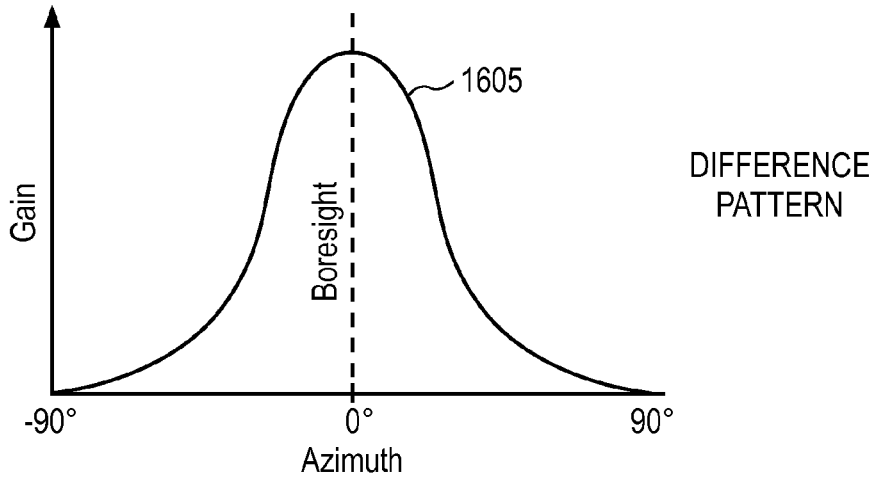
Figure 18:
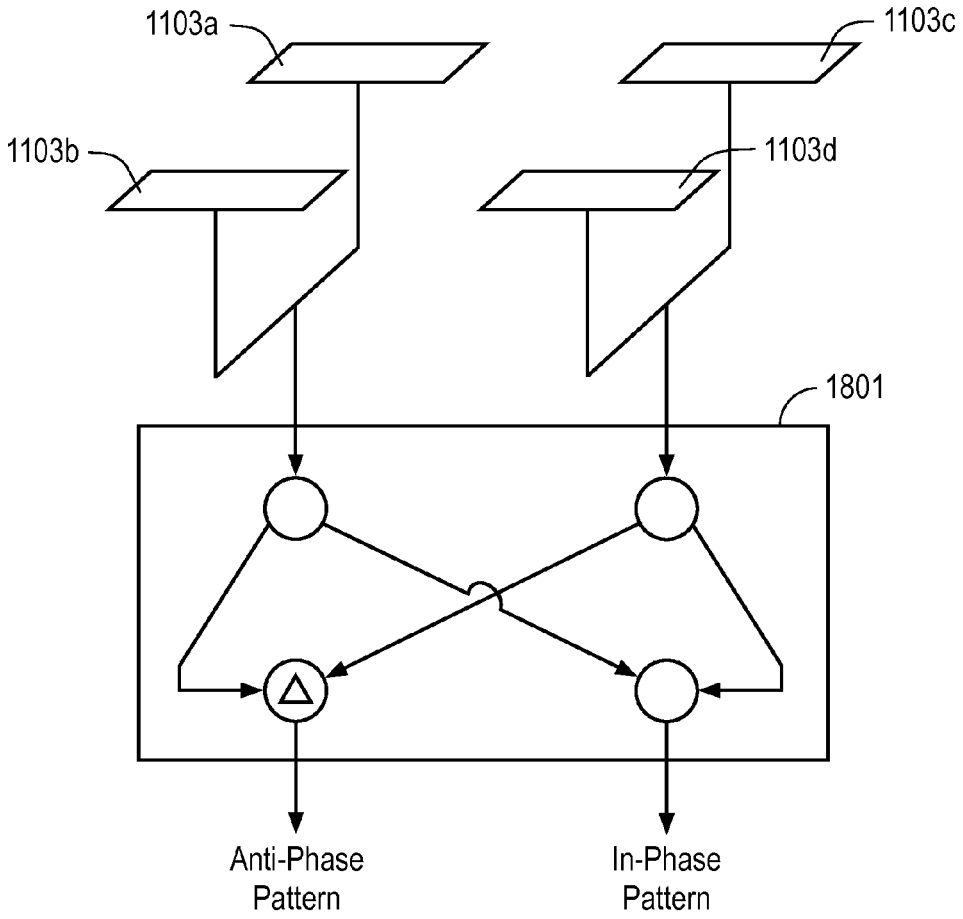
FIG. 18 shows an exemplary embodiment in which a six-port hybrid is used to generate in-phase and anti-phase signals simultaneously from the receive antenna.

In one embodiment, the antenna pattern of the receive antenna may be modified, as illustrated in FIG. 16B, by adding a 180 degree phase-shifter 1603 in the signal path from one pair of antenna elements, such as 1103*c* and 1103*d*, for example. Phase shifters are known in the art and, accordingly, will not be described in detail. The signals from the two pairs of elements may then be combined in signal combiner 1602 to yield an antenna pattern having two lobes 1604*a* and 1604*b* and a gain null in the direction of the boresight of the receive antenna. It will be appreciated that the pattern of receive antenna 1103 may be switched between the pattern 1601 and patterns 1604*a* and 1604*b* by switching phase shifter 1603 in and out of the signal path of antenna elements 1103*c* and 1103*d*. The resulting output of signal combiner 1602 will alternate between the two configurations. The alternating signals may then be detected and processed. In particular, the signal information from the configuration of FIG. 16B (anti-phase configuration) may be subtracted (e.g., in software) from the signal information from the configuration of FIG. 16A (in-phase configuration) to yield a difference signal with a desirable narrow beamwidth to facilitate direction finding. This process is illustrated schematically in FIGS. 17A-17C, where effective antenna gain is plotted against azimuth angle. FIG. 17A illustrates antenna pattern 1601 in the in-phase configuration of FIG. 16A. FIG. 17B illustrates antenna patterns 1604*a* and 1604*b* in the anti-phase configuration of FIG. 16B. FIG. 17C illustrates a difference pattern 1605 representing the subtraction of patterns 1604*a* and 1604*b* from pattern 1601. Alternatively, in one embodiment as illustrated in FIG. 18, a modified six-port hybrid 1801 may be used to generate the in-phase and anti-phase signals simultaneously. Six-port hybrids are known in the art and, accordingly, will not be described in detail.

In practice, the boresight null of the anti-phase configuration illustrated in FIG. 17B may have a non-zero value (e.g. due to phase-shift errors or slight physical differences between the pairs of antenna elements). As a result, the difference pattern 1605 may have a boresight gain that is less than the boresight gain of pattern 1601 and have a correspondingly shorter detection range. Thus, pattern 1601 may initially be used to locate a target golf ball, and difference pattern 1605 may be used subsequently for direction finding after the range to the target golf ball has been closed.

Figure 19:
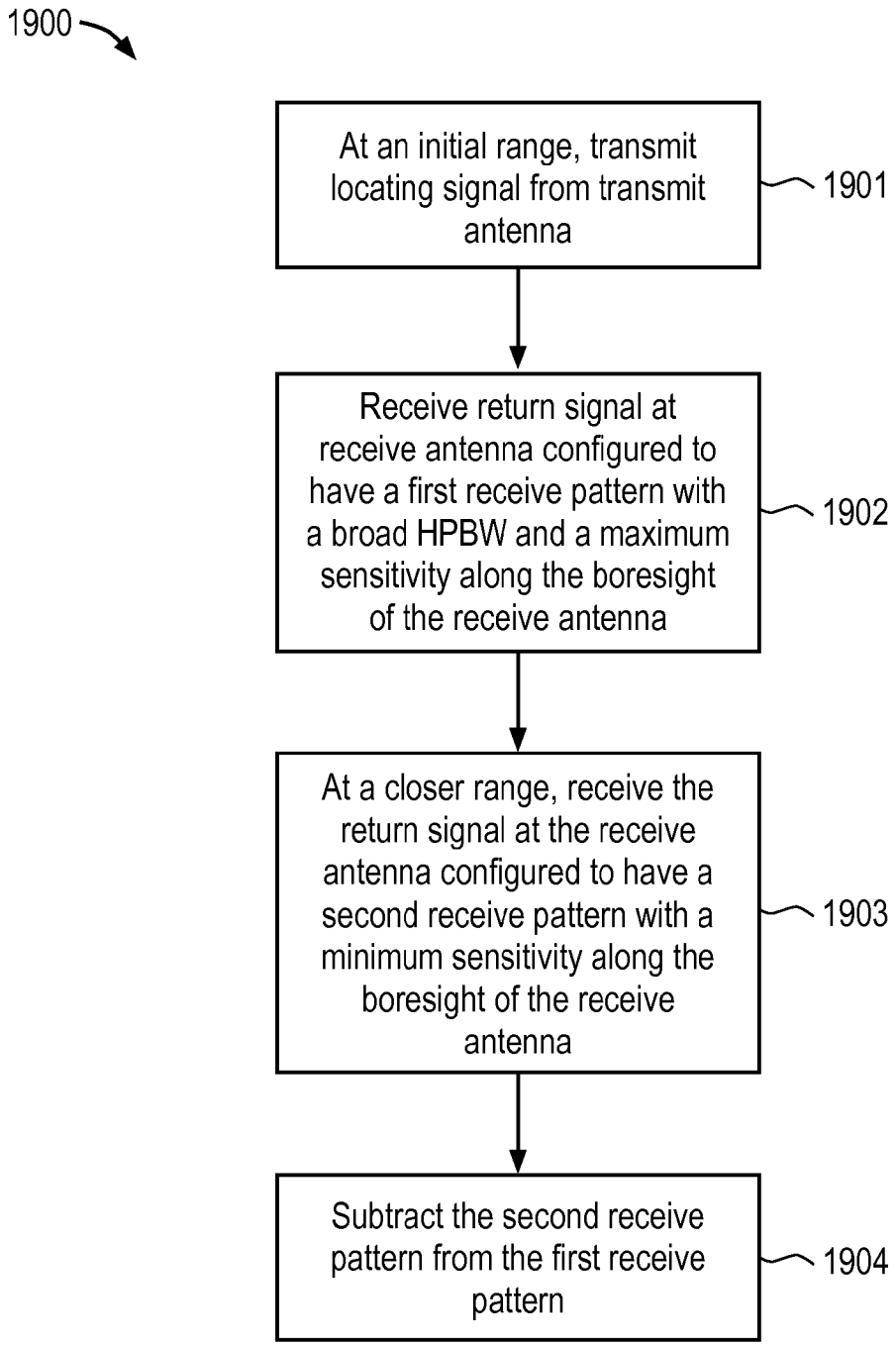
FIG. 19 is a flowchart which illustrates a method for locating a golf ball according to certain exemplary embodiments described herein.

Thus, in one embodiment illustrated in FIG. 19, a method 1900 for locating a golf ball may include: at an initial range, transmitting a locating signal at the transmit frequency from transmitting antenna 1101 having a maximum radiation intensity in a direction corresponding to the boresight of transmit antenna 1101 (step 1901); receiving a return signal at the receive frequency at the receive antenna 1103 configured to have a directional receiving pattern 1601 with a maximum receiving sensitivity in a direction corresponding to the boresight of the receive antenna 1103 and a relatively broad beamwidth (step 1902); at a subsequent range less than the initial range, receiving the return signal at the receive frequency at the receive antenna 1103 configured to have a directional receiving patterns 1604*a* and 1604*b* with a minimum receiving sensitivity in the direction corresponding to the boresight of the receiving antenna 1103 (step 1903); and subtracting the directional receiving patterns 1604*a* and 1604*b* from the directional receiving pattern 1601 to obtain a difference receiving pattern 1605, where the difference receiving pattern 1605 has a half-power beamwidth less than the half-power beamwidth of receiving pattern 1601 (step 1904).

Figure 20:
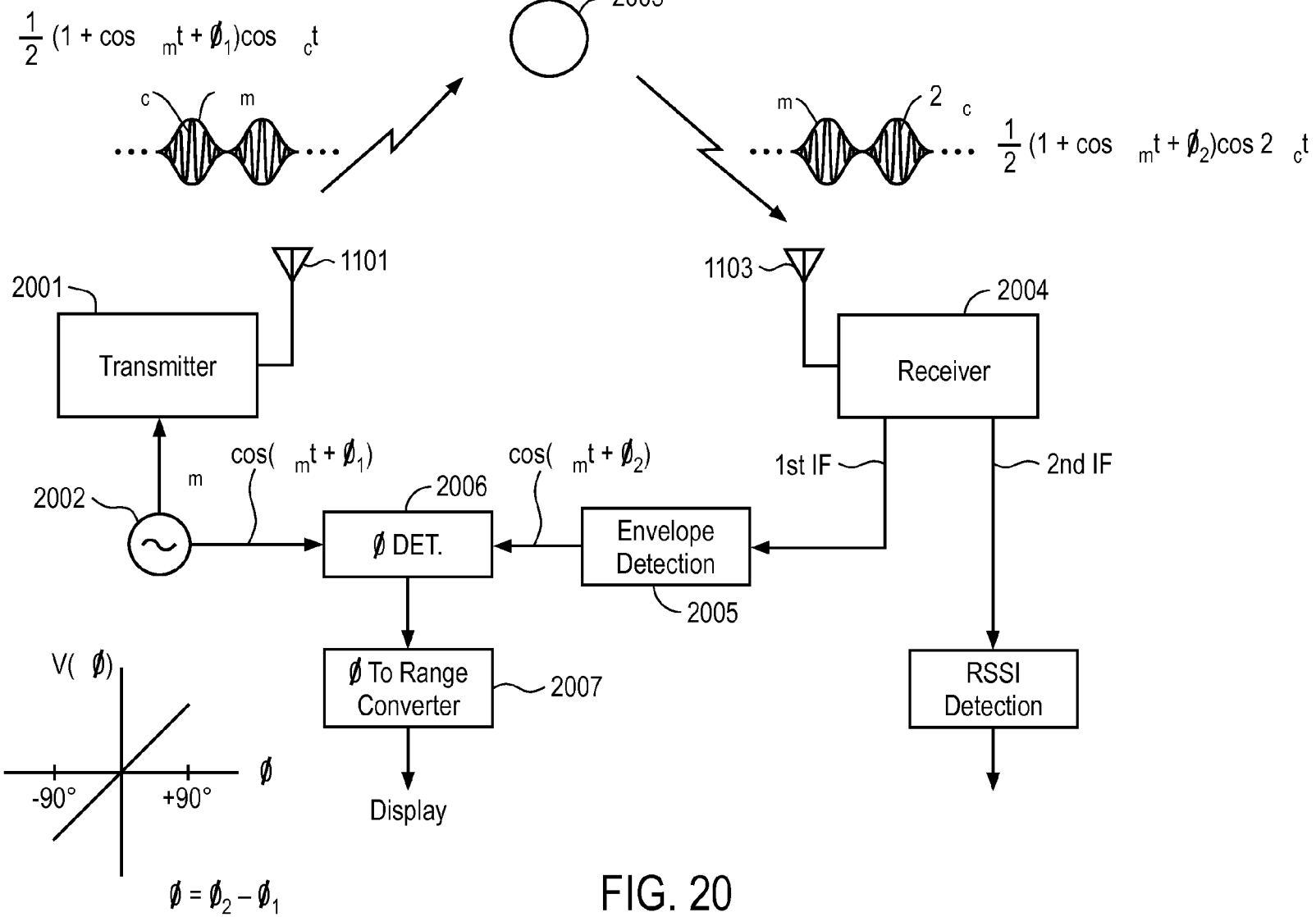
FIG. 20 illustrates one exemplary embodiment for implementing range finding functionality based upon signal transmission time between the ball and the handheld locator.

In addition to the received signal strength indication described elsewhere, the ball locator system may be configured to measure the distance from the handheld transceiver to the target golf ball by adding range-finding components to embodiments of the handheld transceiver system (e.g., system 800) described above. FIG. 20 illustrates one embodiment of a range-finding configuration 2000. In FIG. 20, the transmitter 2001 may be amplitude modulated by a sinusoidal signal source 2002. The sinusoidal amplitude modulation may be in addition to the pulse modulation (OOK modulation) and the pseudonoise (PN) modulation previously described. In the following description, the OOK modulation and the PN modulation are ignored for clarity of explanation. It will be appreciated by one having ordinary skill in the art, however, that the overall modulation may be obtained by convolving the time domain functions of the OOK and PN modulations with the sinusoidal amplitude modulation described here.

The radian frequency of the sinusoidal amplitude modulation, $\omega_m$, may be selected so that many cycles of modulation can be impressed on the RF carrier of radian frequency $\omega_c$ during each period of OOK pulse modulation. In one embodiment, for example, the RF carrier frequency may be 915 MHz and the OOK pulse width may be approximately 200 microseconds (μs). The frequency of the sinusoidal modulation may be selected to be 5 MHz, and thus have a period of 200 nanoseconds (ns) so that each carrier pulse will contain 1000 cycles of the sinusoidal modulation. Ignoring the OOK modulation, the amplitude modulated carrier signal will be of the form $$[\tfrac{1}{2}+\tfrac{1}{2}\cos(\omega_m t+\phi_1)]\cos\omega_c t.$$

assuming 100% modulation, where $\phi_1$ is the initial phase of the modulation. This signal may be transmitted by transmit antenna 1101 to a golf ball equipped with a square-law transducer (described elsewhere). The ball 2003 will generate an amplitude modulated return signal with a carrier frequency $2\omega_c$ including a term of the form $$[\tfrac{1}{2}+\tfrac{1}{2}\cos(\omega_m t+\phi_2)]\cos 2\omega_c t.$$

where $\phi_2$ is the phase of the modulation in the return signal. That is, the return signal will contain the sinusoidal amplitude modulation, but the modulation will be shifted in phase.

The return signal will be received by receive antenna 1103 and the modulated carrier will be downconverted by receiver to a first IF (intermediate frequency, e.g., 100 MHz) by a mixer or multiplier, for example. Downconversion techniques are known in the art and, accordingly, will not be described in detail. The return signal may also be downconverted to a second IF where it may be used for received signal strength indication (RSSI), as described in detail elsewhere, when the sinusoidal modulation is not employed for range-finding.

The first IF signal may be coupled to an envelope detector 2005 as is known in the art to extract the sinusoidal modulation from the downconverted return signal, yielding an envelope signal proportional to $\cos(\omega_m t+\phi_2)$. This envelope signal may be compared to a sample of the original modulating signal $\cos(\omega_m t+\phi_1)$ from modulator 2003, using a phase detector 2006. Phase detector 2006 produces a voltage which is proportional to a phase difference $\Delta\phi=\phi_2-\phi_1$. It will be appreciated that the phase difference $\phi_2-\phi_1$ *will* be a function of the distance between the golf ball 2003 and the transmitter 2001 and/or receiver 2004. For example, if the frequency of the sinusoidal modulation is 5 MHz, one cycle (360 degrees of phase shift) of the modulation will have a period of 200 ns, as noted above. The free space velocity of RF energy is approximately one foot per nanosecond. Therefore, 360 of phase shift would be equivalent to a round trip distance of approximately 200 feet, or a range of 100 feet. A practical and inexpensive phase detector 2006, as is known in the art, may be able to resolve a phase difference $\Delta\phi$ equal to approximately 3 or 4 degrees. Therefore, it may be possible to achieve a range resolution of approximately 1 foot.

Radio frequency transmissions may be limited by regulatory authorities such as the Federal Communications Commission (FCC). In particular, the peak power of a radio frequency transmission may be limited. It will be appreciated by those skilled in the art that the modulation scheme described above may maintain the peak power of the unmodulated carrier signal, but reduce the average power of the transmitted signal. Therefore, the modulation-based range finding described above may be employed as part of a two-part range-finding approach. Initially, a carrier signal may be transmitted without sinusoidal modulation to maximize average RF power and maximize detection range using the RSSI previously described. Then, once the golf ball return signal is acquired, and the distance to the golf ball is reduced, the modulation-based range-finding scheme may be employed.

Figure 21:
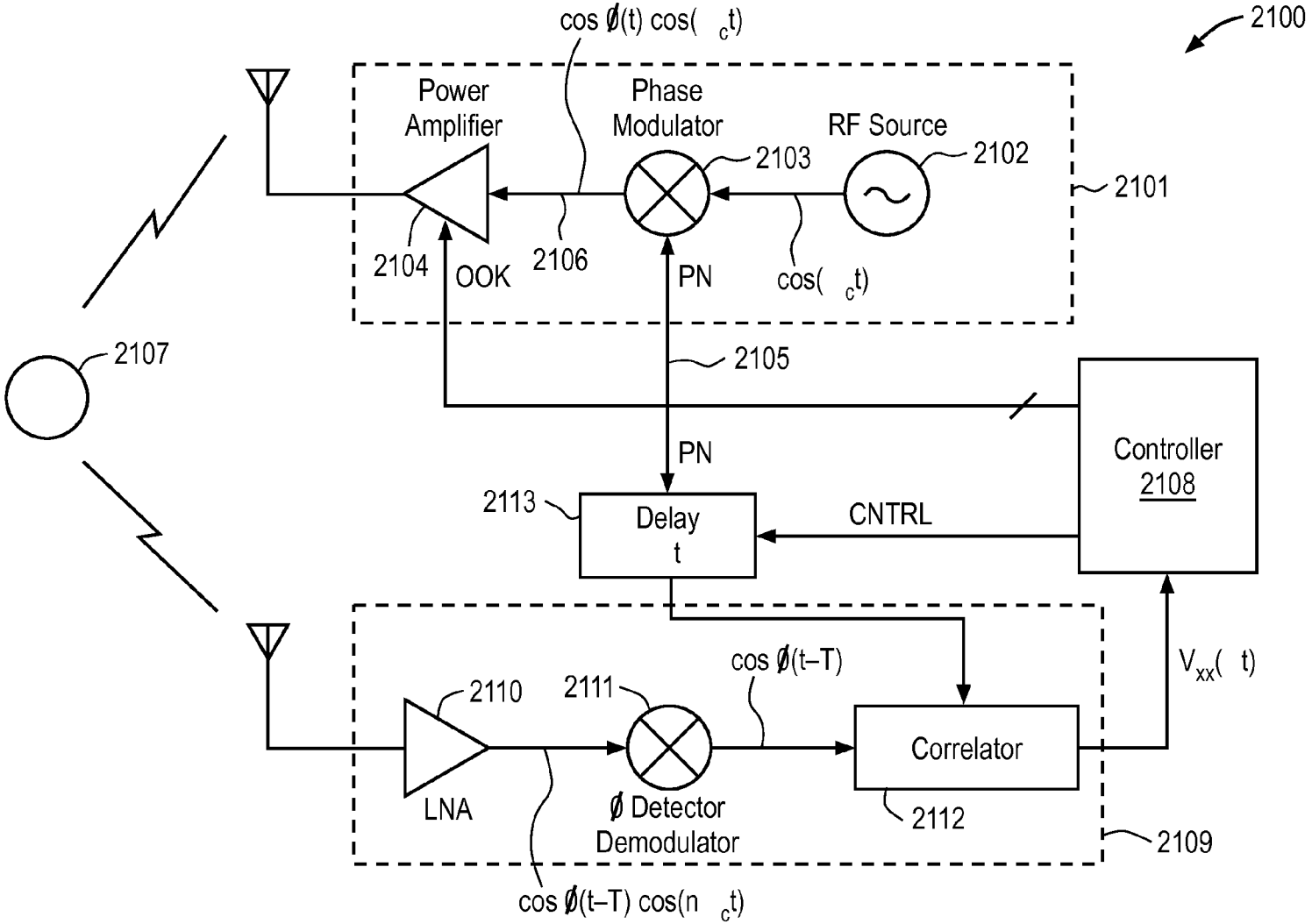
FIG. 21 is a block diagram illustrating one exemplary embodiment of a handheld transceiver according to certain aspects of the inventions described herein.

In one embodiment, as illustrated in FIG. 21, a handheld transceiver 2100 may include a transmit chain 2101, which may include a radio frequency (RF) signal source 2102, a phase modulator 2103 and a power amplifier 2104. RF signal source 2102 may generate an RF carrier with a radian frequency $\omega_c$. Phase modulator 2103 may apply a phase modulation code 2105 to the RF carrier to produce a phase modulated carrier (locating signal) 2106 which may be amplified by power amplifier 2104 and transmitted to a golf ball 2107 equipped with a harmonic transducer as described below. The phase modulation code may be a maximal length pseudorandom binary code (pseudo noise, or PN code) as is known in the art. In one embodiment, the modulation code may be a 255 chip maximal length PN code generated by a processor 2108. Processor 2108 may be any kind of general purpose processing device (e.g., microprocessor, microcontroller or the like) or any type of special purpose processor (e.g., ASIC, FPGA, DSP or the like).

Figure 22:
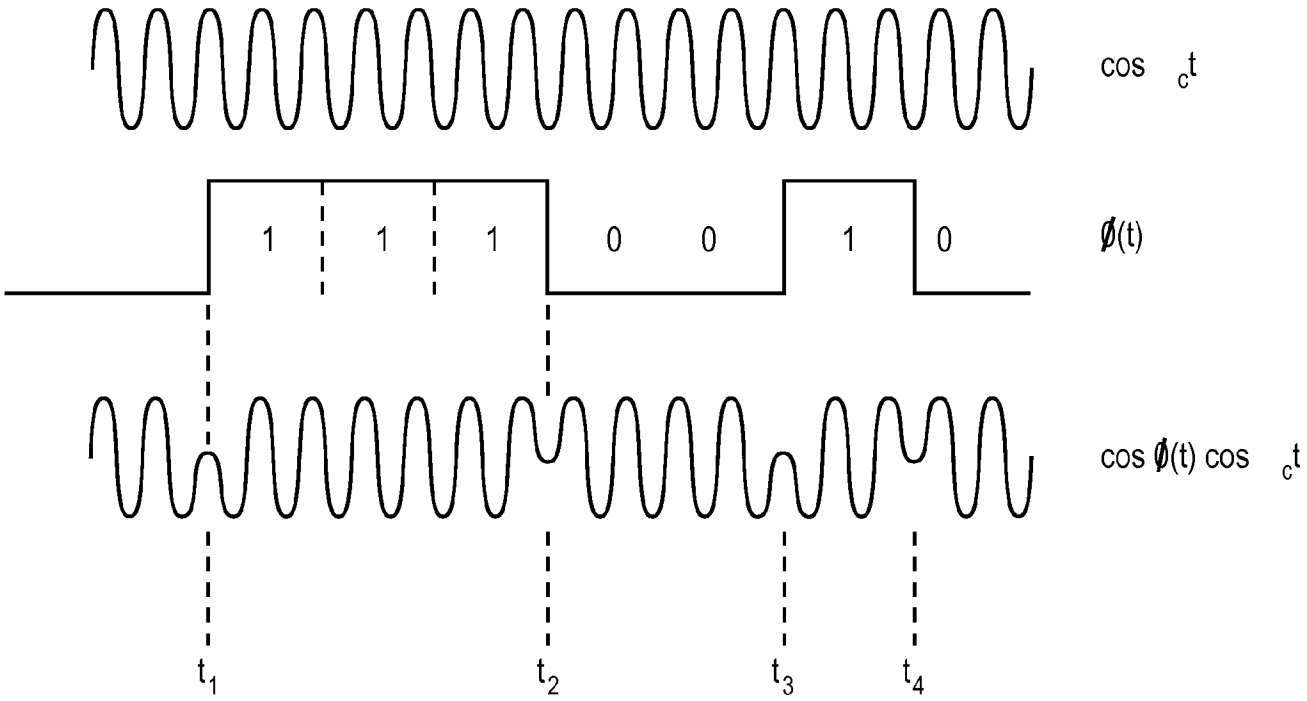
FIG. 22 illustrates signal modulation in one embodiment of the inventions described herein.

In one embodiment, phase modulator 2103 may be a bi-phase modulator configured to reverse the phase of the RF carrier signal when the PN code changes from 1 to 0 or from 0 to 1. FIG. 22 illustrates the effect of bi-phase modulation if the PN code begins with the binary sequence 11100110, for example. When the PN code transitions from 0 to 1 (e.g., at $t_1$ and $t_3$), the phase of the carrier is shifted 180 degrees, effectively multiplying the carrier by −1. When the PN code transitions from 1 to 0 (e.g., at $t_2$ and $t_4$), the phase of the carrier is returned to its original phase (i.e., multiplied by +1). Thus, the modulated carrier may be treated as a sinusoidal function ($\cos \omega_c t$) multiplied by a function $\cos \phi(t)$, where $\phi(t)$ takes the value 0 radians when the PN code value is 0, and the value $\pi$ radians (180 degrees) when the PN code value is 1. In one embodiment, the bi-phase PN code modulation may be combined with on-off keying (OOK) modulation, as described above, which may be implemented by amplitude modulating power amplifier 2104 with an OOK signal from controller 2108.

As noted above, a golf ball 2107 configured to operate with the handheld transceiver 2100 may be equipped with a harmonic transducer as described in U.S. published Application No. 20050070375 or in co-pending U.S. patent application Ser. No. 11,248,766, filed Oct. 11, 2005. In one embodiment, for example, the harmonic transducer may be a diode having an exponential voltage-current characteristic. As described in detail in Appendix B, when such a transducer receives a bi-phase modulated signal as described above, it can generate return signals at harmonics of the signal it receives. Return signals at even harmonics (e.g., second harmonic) contain no modulation because the bi-phase modulation function is raised to an even power and even powers of both −1 and +1 equal +1. In contrast, return signals at odd harmonics (e.g., third harmonic) retain the bi-phase modulation because odd powers of +1 equal +1 and odd powers of −1 equal −1.

Thus, an odd harmonic return signal from the golf ball 2107 may be received by a receiver chain 2109 in handheld transceiver 2100. Receiver chain 2109 may include a low noise amplifier (LNA) 2110, a phase detector/demodulator 2111, and a correlator 2112. LNA's, phase detector/demodulators, and correlators are known in the art and, accordingly, are not described in detail. It will be appreciated that phase-detector/demodulator 2111 may extract the PN code from the modulated return signal and that the extracted PN code will be the same code as the transmitted code with a time delay equal to the round trip time from the transmitter to the golf ball and from the golf ball to the receiver. The RF signal travels at the speed of light, which is approximately one foot per nanosecond (ns). If the distance between the transceiver 2100 and the golf ball 2107 is 50 feet, for example, the time delay between the transmitted signal and the return signal will be approximately 100 ns.

Figure 23:
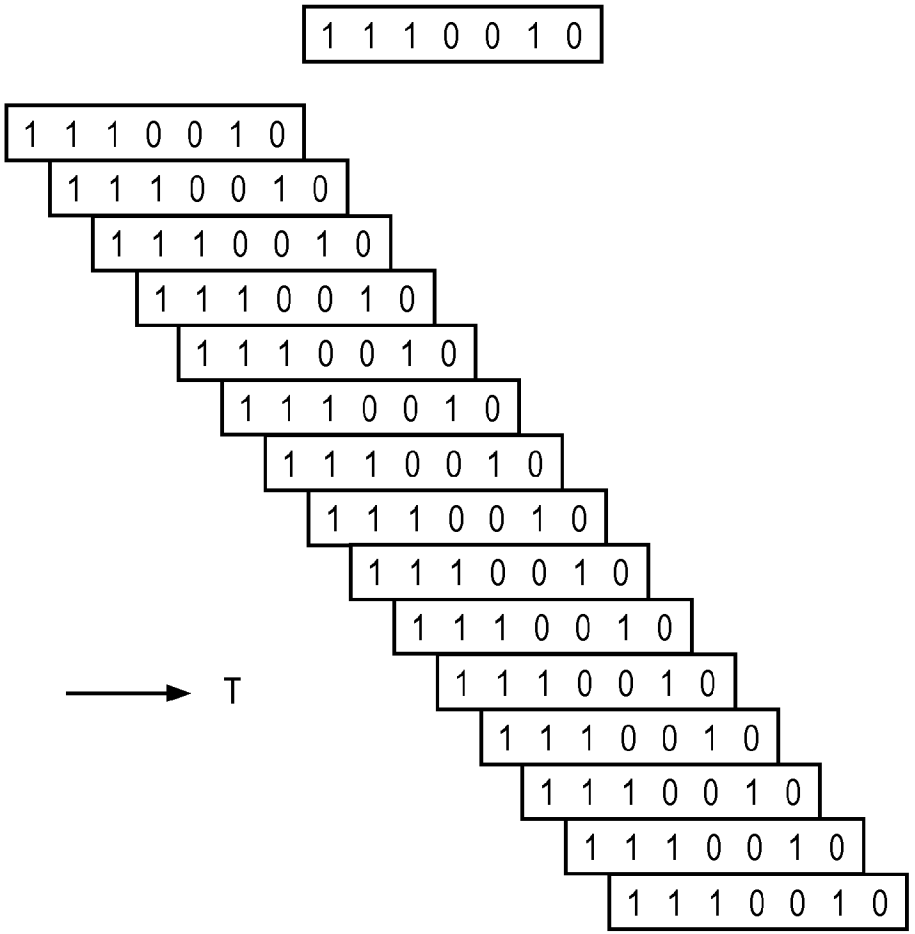
FIG. 23 illustrates signal correlation in one embodiment of the inventions described herein.

In one embodiment, the PN code extracted from the return signal may be compared with the PN code from the locating signal to determine the distance between the handheld transceiver 2100 and the golf ball 2107. FIG. 23 illustrates how the PN code from the return signal may be correlated with a sample of the PN code from the locating signal. In FIG. 23, the correlation of an exemplary seven bit (seven chip) PN code in a return signal is illustrated. As the delay between the locating signal and the return signal is changed by integral numbers of chips, the number of bits in the overlapping codes that agree and the numbers of bits in the codes that disagree may be compared to yield an effective correlation coefficient. The correlation model may be extended to a continuous range of time delays by selecting a sampling interval within each chip to perform the comparison. Such sampling methods are known in the art and, accordingly, are not described in detail here. It will be appreciated that when the transmitted and received modulation codes are completely aligned, the effective correlation coefficient will be a maximum equal to the number of bits (chips) in the PN code, and that when the transmitted and received modulation codes are misaligned by one or more bits, the effective correlation coefficient will be significantly reduced. In particular, for the case of a maximal length PN code, as illustrated in FIG. 23, the effective correlation coefficient may be 0 or −1 for misalignment between the transmitted and received codes.

In one exemplary embodiment, a 255 bit PN code as described above may have a bit rate (bit frequency) of $10^6$ bits per second (10 MHz). The PN code may be combined with OOK modulation as described above. The OOK modulation may include 25.5 microsecond (μs) wide pulses with, for example, at a 4% duty cycle, such that the full 255 bit PN code may be bi-phase modulated onto each OOK pulse and each bit in the PN code will have a duration of 100 nanoseconds (ns). A correlator, such as correlator 2112, may resolve time delays with a resolution of plus or minus one bit, or 100 ns. As described above, a 100 ns time delay corresponds to a resolution of only 50 feet. A delay circuit 2113 may be used to delay a sample of the transmitted PN code that may be correlated with the PN code extracted from the return signal. The delay may be adjusted to find a delay which produces the maximum correlation.

To achieve resolution greater than one bit, the delay circuit 2113 may be used to dither (in time) the sample of the transmitted PN code from pulse to pulse of the OOK signal. The dithering may be characterized by a dithering width and a dithering centerpoint. The dithering width and centerpoint may be used to track the return signal and may be adjusted to find the first correlation nulls on either side of the maximum correlation. The correlation nulls may be used to resolve the time delay of the return signal to a fraction of a bit duration (e.g., 1/10). For example, for the 100 ns duration bit described above, the resolution may be improved to 10 ns, corresponding to a distance resolution of 5 feet. Furthermore, the centerpoint of the delay may itself be dithered to track range changes as the distance between the transceiver and the golf ball closes.

Figure 24:
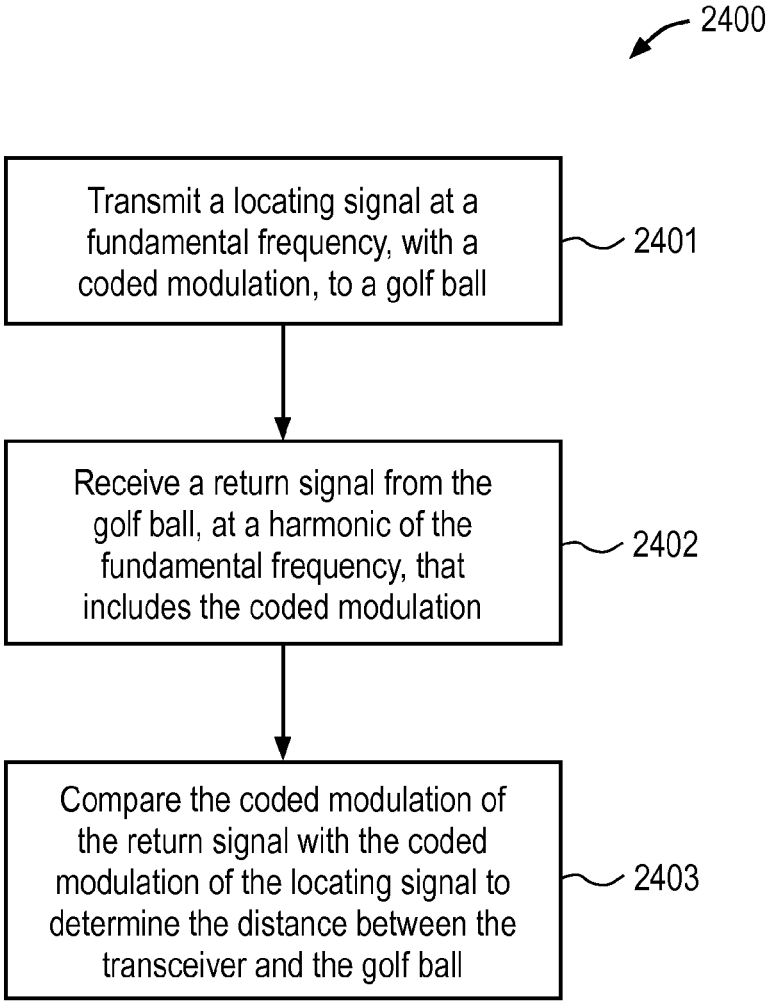
FIG. 24 is a flowchart which illustrates a method for determining a distance to a golf ball according to certain exemplary embodiments described herein.

Thus, in one embodiment, as illustrated in FIG. 24, a method 2400 for locating a golf ball may include: transmitting a locating signal at a fundamental frequency, with a coded modulation, to the golf ball (step 2401); receiving a return signal from the golf ball, at a harmonic of the fundamental frequency, that includes the coded modulation (step 2402); and comparing the coded modulation of the return signal with the coded modulation of the locating signal to determine the distance between the transceiver and the golf ball (step 2403).

The handheld transceiver is a specialized type of harmonic radar system. As described in Appendix A, the ratio of received power to transmitted power may be on the order of approximately −160 dB. For example, if the power transmitted at the fundamental frequency is +30 dBm (1 watt), then the power received at the second harmonic frequency may be in the range of approximately −130 dBm ($10^{-16}$ watts). As a result, the total isolation between the transmitter section and the receiver section in the handheld transceiver should be greater than approximately 160 dB to insure that leakage from the transmitter will be lower than the detection threshold of the receiver.

Harmonic radar provides an inherent level of isolation because the transmitted and received frequencies are separated by an octave, and the intended transmit and receive paths can be heavily filtered. However, special measures may be required to prevent energy leakage over unintended signal paths and especially over any path with a nonlinear response than can generate harmonics, such as a bimetallic contact or rectifying junction. The transceiver may therefore incorporate one or more of the following isolation techniques.

Figure 25A:
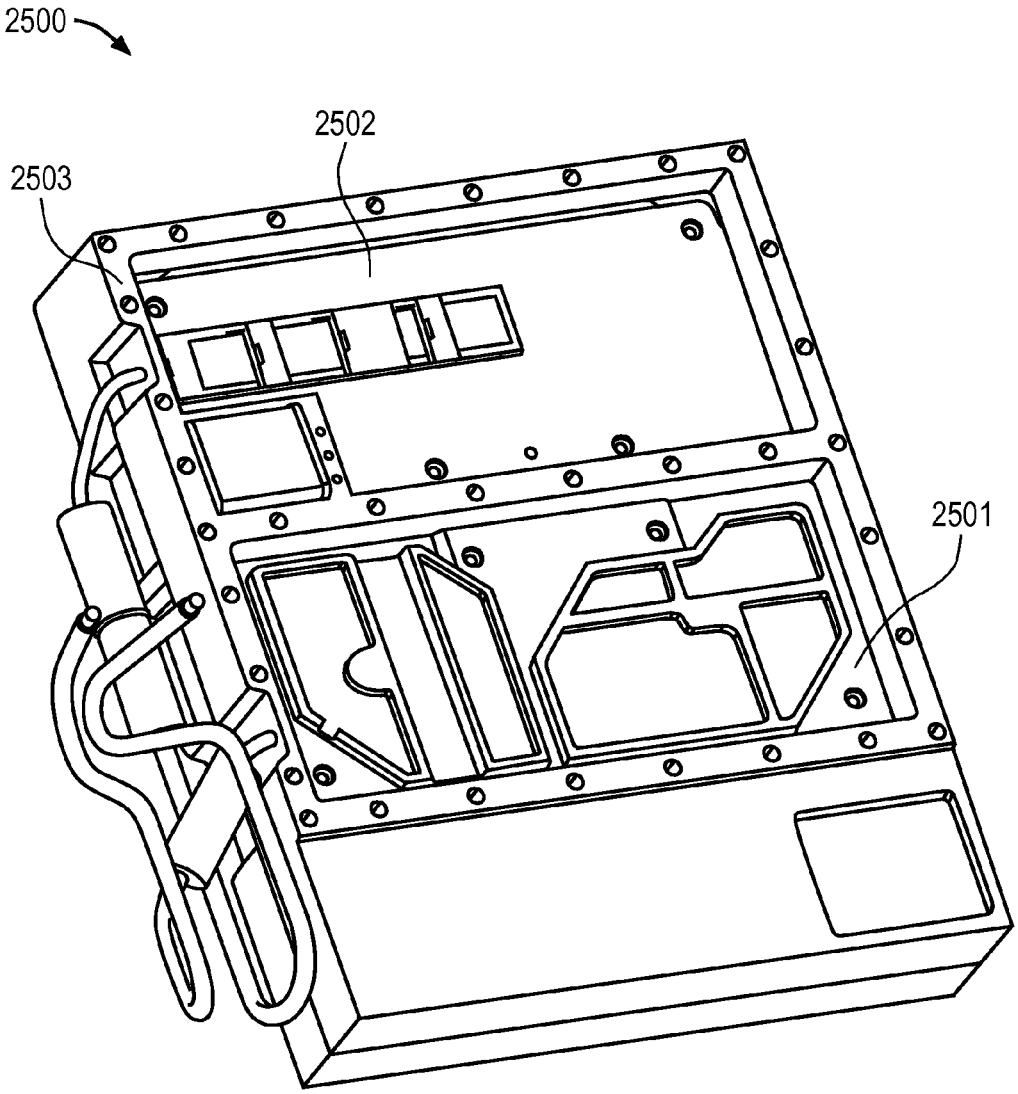
FIG. 25A illustrates a transceiver assembly in one embodiment of the inventions described herein.
Figure 25B:
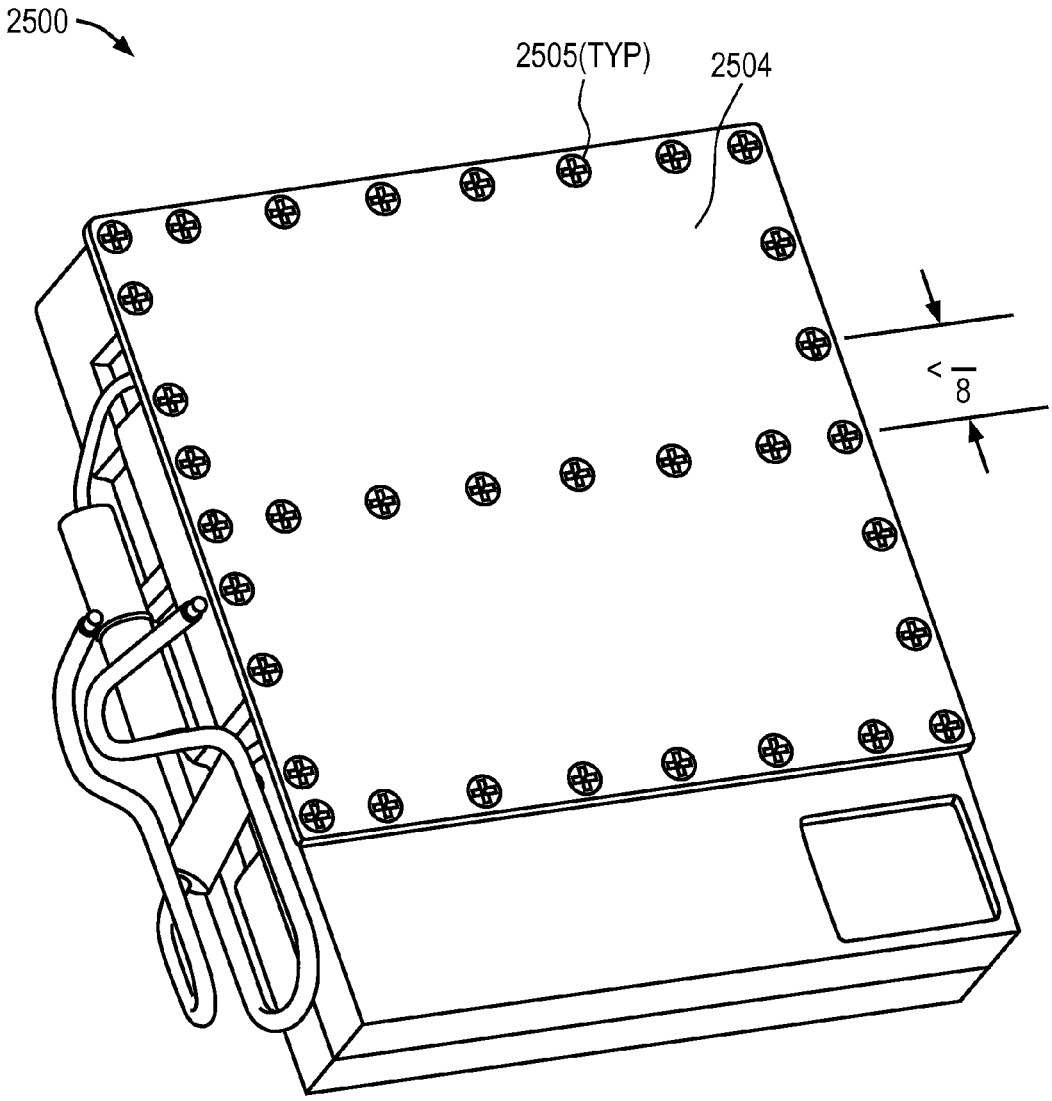
FIG. 25B illustrates transceiver shielding in one embodiment of the inventions described herein.

FIG. 25A illustrates an exemplary transceiver assembly 2500. Transceiver assembly 2500 includes a transmitter subassembly 2501 and a receiver subassembly 2502. The transmitter subassembly and the receiver subassembly are mounted in cavities in a housing 2503 that is machined from a solid (i.e., seamless) piece of metal (e.g., aluminum). All internal dimensions of the cavities are much less than one-half wavelength at the second harmonic of the transmitter frequency to avoid any resonant modes that may couple second harmonic energy to the receiver cavity. As illustrated in FIG. 25B, a metal (e.g., aluminum) lid 2504 may be used to close off the cavities of the transmitter and receiver subassemblies. The lid may be attached to the housing 2503 by a number of closely spaced screws, such as screw 2505. The screws may be spaced approximately less than or equal to one-eighth wavelength at the second harmonic of the transmit frequency to prevent leakage of radio frequency energy.

Printed circuit boards (PCBs) in the transmitter and receiver subassemblies may be configured as co-planar stripline (i.e., signal lines and ground planes on the same surface) to confine the electromagnetic fields and to facilitate shielding as described below. In addition, internal ground planes and vias (e.g., plated-through holes) may be used to minimize radiation, coupling and crosstalk.

Figure 26A:
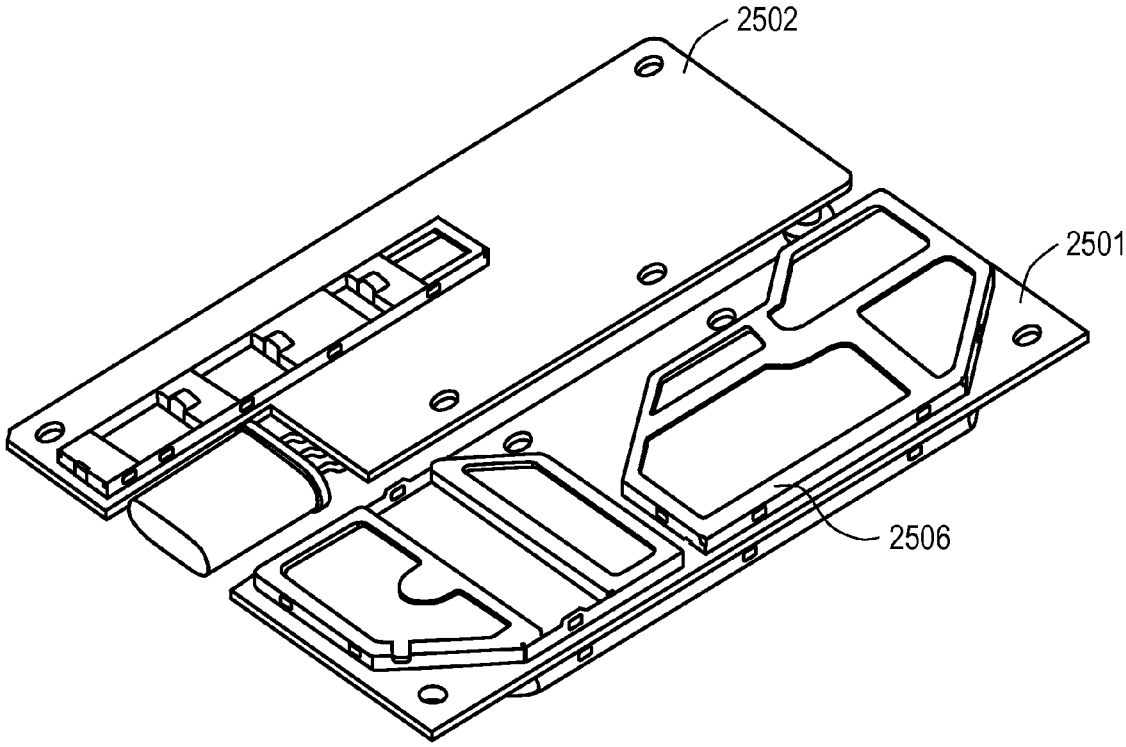
FIG. 26A illustrates one configuration of onboard shielding in one embodiment of the inventions described herein.
Figure 26B:
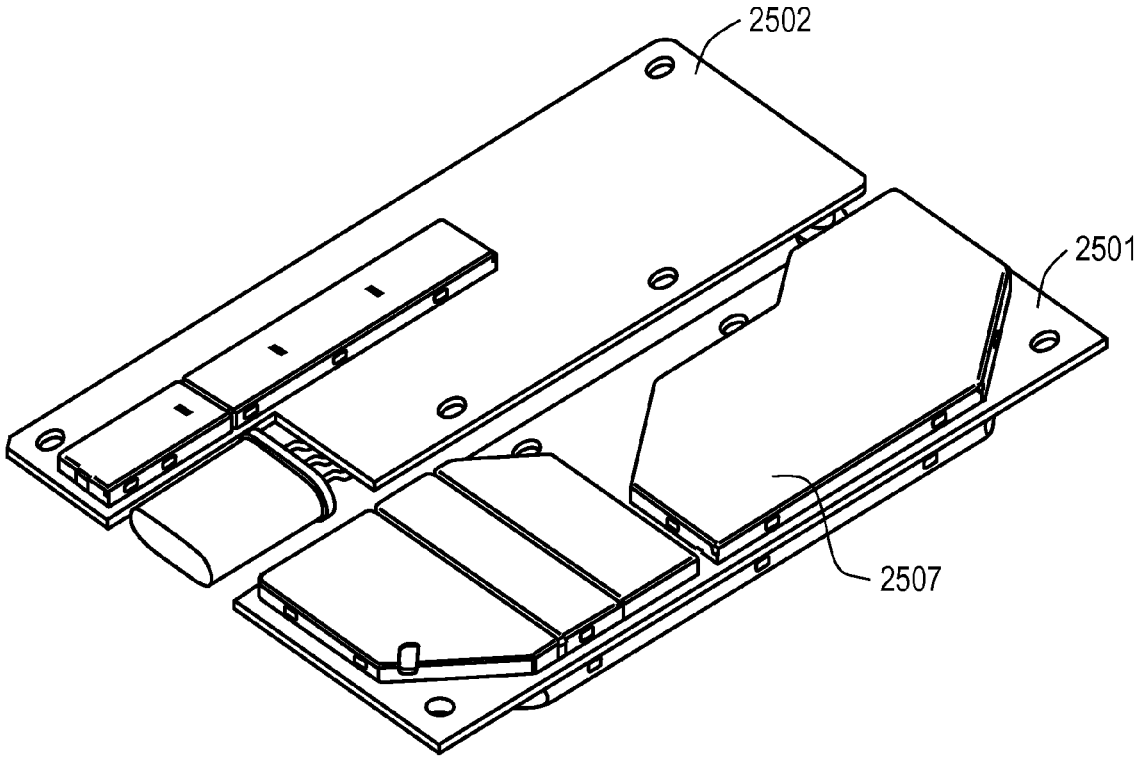
FIG. 26B illustrates another configuration of onboard shielding in one embodiment of the inventions described herein.

As illustrated in FIG. 26A, circuitry (e.g., filters, amplifiers, oscillators) in the transmitter subassembly 2501 and the receiver subassembly 2502 may be shielded individually with metallic fences, such as fence 2506, which may be soldered directly to a ground plane of the respective subassembly. As illustrated in FIG. 26B, enclosures formed by the fences may then be closed off and isolated from each other by placing metallic covers, such as cover 2507, over the fences.

Figure 27:
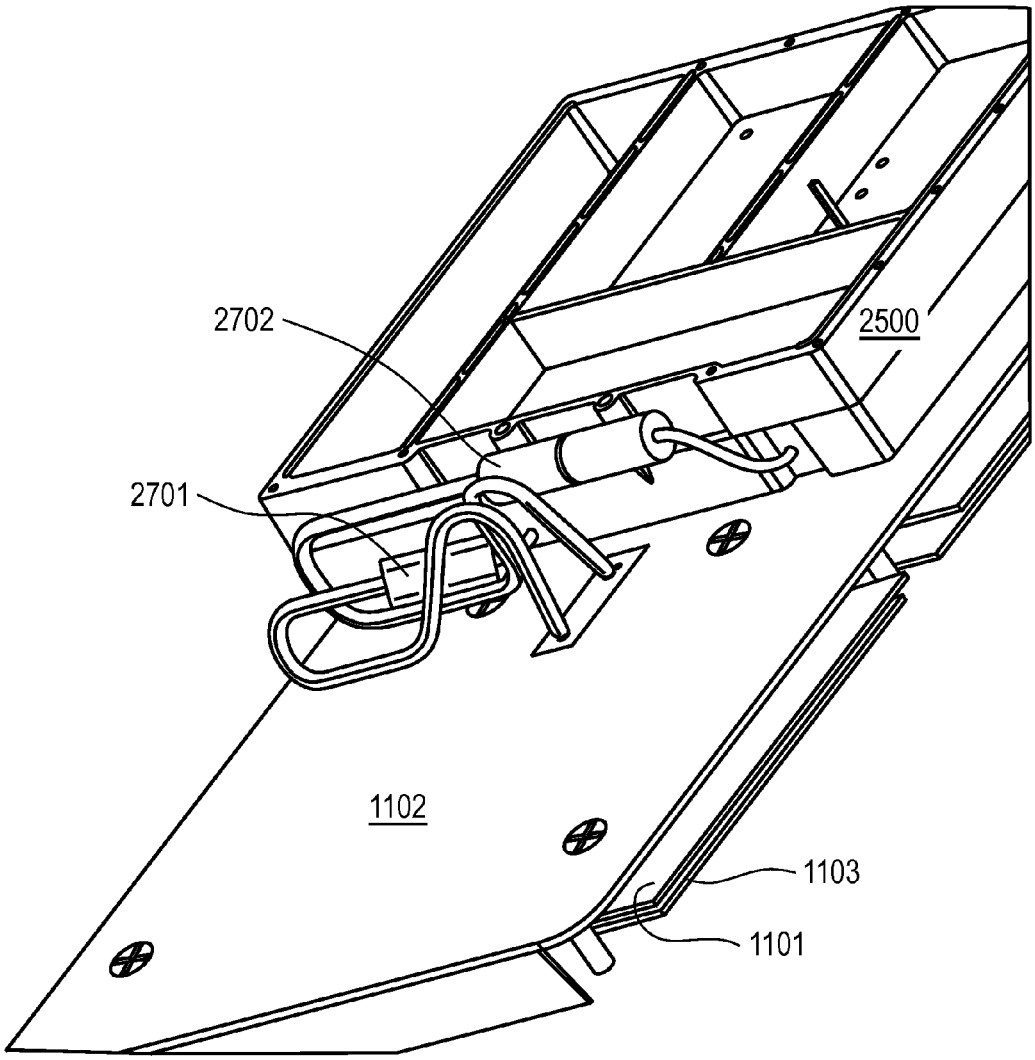
FIG. 27 illustrates signal isolation techniques in one embodiment of the inventions described herein.

Threaded RF connectors provide limited isolation (e.g., less than 90 dB) and the materials required for an adequate mechanical connection can create bimetallic contacts, which may generate harmonics in the presence of high energy radio frequency currents such as currents associated with transmitter subassembly 2501. Therefore, the RF signals, which enter or leave the transceiver assembly 2500 are cabled through small holes in the housing 2503 with metal-shielded cables (e.g., semi-rigid and/or conformable cables such as cables 1301 and 1302) that may be soldered in place. In one embodiment, the RF cables and the RF housing may be tin-plated and soldered with a tin-lead alloy solder to prevent non-linear bimetallic contact. In other embodiments, the cables and housing may be plated with other materials such as silver or gold, for example, and soldered with a corresponding silver or gold based solder to achieve a uni-metallic electrical and mechanical bond. FIG. 27 illustrates an exemplary connection between transceiver assembly 2500 and antenna assembly 1100 (i.e., ground plane 1102, transmit antenna 1101, and receive antenna 1103) using coaxial cables 1301 and 1302. At the antennas, the outer shields of the cable 1301 from the transmitter subassembly 2501 and cable 1302 from the receiver subassembly 2502 may be soldered to the respective ground planes of the transmit and receive antennas, and the center conductors may be soldered to the respective active elements of the transmit and receive antennas. As in the case of the cable to housing contacts, the contacting surfaces may be tin-plated and soldered with tin-lead solder.

As further illustrated in FIG. 27, additional isolation may be achieved by threading ferrite beads, such as ferrite beads 2701 and 2702 over the RF cables 1301 and 1302. Additionally, each control line (e.g., modulation controls, enable controls, etc.) which enters or exits the transceiver assembly 2500 may be filtered with a combination of a ferrite bead and a shunt capacitor, for example (not shown), which form a low-pass LC (inductor-capacitor) filter structure with a cutoff frequency below the second harmonic of the transmit frequency.

In general, lines, wires and cables may be routed and/or secured to avoid unintentional metal-to-metal contacts. As noted above, bimetallic contacts can form nonlinear junctions that can produce harmonics in the presence of circulating RF currents, but any metal-to-metal contact can compromise isolation by transferring energy in ground currents.

It will be appreciated that numerous modifications of the various embodiments described herein may be made. For example, each golf ball could be printed with a unique identification number such as a serial number in order to allow a user to identify from a group of lost balls which lost ball is his/her lost ball. Alternatively, a quasi-unique identifier, such as a manufacturing date when the ball is manufactured, may be printed on the outside of the ball so it can be read by a user to verify that a user's ball has been found within a group of lost balls which have been uncovered by the handheld transmitting/receiving device. Alternatively, the user may apply an identifier such as the user's initials onto the ball to thereby identify the ball when it has been uncovered by a handheld transmitting/receiving device. It will also be appreciated that the tags discussed above are passive tags having no active integrated circuit components such as semiconductor memory circuits, and the antenna does not need to energize such active integrated circuit components such as semiconductor memory components. However, in certain alternative embodiments, tags, such as RFID integrated circuit (IC) tags which include an electronic identification number (IDN) stored within the IC, may be used in the various different findable golf balls described herein. These tags would be "read" by a transmitting/receiving (T/R) device which transmits the IDN and "listens" for a reply from the tag with the IDN or which transmits a request for the IDN and listens for the IDN. In this case a user would program the IDN of a golf ball into the T/R device which can then be used to find the ball. The entire circuitry of such an RFID IC (within an IC) may be fit into 1 package and coupled to an antenna. Such an RFID (with IDN) may be used in a ball without a longer range tag (such as a harmonic tag which may be implemented as shown in FIGS. 2A and 2B) in the same ball, or such an RFID (with IDN) may be used in a ball with a longer range tag (e.g. as implemented in FIGS. 2A and 2B) in the same ball as the RFID (with IDN). In certain alternative embodiments, the transmitting and receiving frequencies may be the same, in which case the response from the tag is not a 2× response frequency (e.g. 2× of the transmit frequency). In this case, it may be desirable to turn off the transmitter for brief periods of time while the receiver is turned on to receive during those brief periods of time.

While various embodiments described herein relate to golf balls, alternative embodiments may be used in other types of balls (e.g. baseballs).

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

APPENDIX A

In a harmonic radar system, the radar range equation may be expressed as:

$$P_r=(P_tG_{t1})/(4\pi R^2)\cdot(A_{r2}L_cG_{t2})/(4\pi R^2)\cdot A_{r1}$$

where, $P_r$ is the power received at the second harmonic of the fundamental frequency (watts);

$P_t$ is the power transmitted at the fundamental frequency (watts);

$G_t$ is the gain of the transmitting antenna at the fundamental frequency;

R is the distance between the active transceiver and the target object (meters);

$A_{r2}$ is the effective aperture (square meters) of the receiving antenna in the target object at the fundamental frequency, which can be calculated from the gain of the receiving antenna as: $A_{r2}=(\lambda_1^2G_{r2})/4\pi$, where $\lambda_1$ is the wavelength (meters) of the fundamental frequency and $G_{r2}$ is the gain of the target object's receiving antenna at the fundamental frequency.

$L_c$ is the power conversion loss of the harmonic transducer in the target object at a reference power level. If the harmonic transducer is a square law device, the conversion loss will be inversely proportional to the square of the incident power, $P_{inc}=[(P_tG_{t1})/(4\pi R^2)][(A_{r2})]$. Because the incident power is inversely proportional to $R^2$, the transducer will add an $R^2$ factor to the range equation.

$G_{t2}$ is the gain of the transmitting antenna in the target object at the second harmonic of the fundamental frequency;

$A_{r1}$ is the effective aperture (square meters) of the receiving antenna, which can be calculated from the gain of the receiving antenna as: $A_{r1}=(\lambda_2^2G_{r1})/4\pi$, where $\lambda_2$ is the wavelength of the second harmonic of the fundamental frequency and $G_{r1}$ is the gain of the receiving antenna at the second harmonic.

The first term represents the power density (watts/meter$^2$) of the fundamental signal at a distance R meters from the transmitting antenna. The second term represents the transducer loss of the target object and the path loss of the return path, yielding the power density of the second harmonic signal at the receiver. The final term is simply the area over which the received power density is integrated. Substituting and rearranging the terms, and noting that $\lambda_2=\lambda_1/2$, we have:

$$P_r=[(P_tG_{t1})/(4\pi R^2)]\cdot[(\lambda_1^2G_{r2})/4\pi]\cdot[(L_cG_{t2})/(4\pi R^2)]\cdot[(\lambda_1^2G_{r1})/16\pi]$$

or $$P_r=P_t\cdot[(G_{t1}G_{r2}L_cG_{t2}G_{r1})/4]\cdot[(\lambda_1)/(4\pi R)]^4$$

By way of example, the following values may be representative of a practical handheld harmonic radar system operating at a fundamental frequency of 915 MHz with a target object the size of a golf ball:

Pt=1 watt (+30 dBm);

$G_{t1}$=3.5 (5.5 dB); $G_{r2}$=0.032 (−15 dB);

Lc=0.01 (−20 dB) @ $P_{inc}$=−35 dBm, the value of $[(P_t\,G_{t1})/(4\pi R^2)]\,[(\lambda_1^2G_{r2})/4\pi]$ in this example;

$G_{t2}$=0.125 (−9 dB); $G_{r1}$=5.0 (7 dB)

$\lambda_1$=0.328 meters; R=20 meters

In which case, the received power would be:

$$P_r=[(3.5)(0.032)(0.01)(0.125)/(4)]\cdot[(0.328)/(251)]^4=1.02\times10^{-16}\text{ watts}$$

or $$P_r=-130\text{ dBm}$$

APPENDIX B

A diode, such as a Schottky diode or a p-n junction diode, may be used as a harmonic transducer to generate harmonics of an RF signal received by the diode (e.g., by connecting the diode across the terminals of a receiving antenna). A diode has an exponential current-voltage characteristic approximated by:

$$I(t)=I_0(e^{kv(t)}-1)$$

where I(t) is the RF current in the diode as a function of time, v(t) is the incident RF voltage across the diode as a function of time, and $I_0$ and k are constants determined by physical constants and the structure of the diode. If the diode is connected across a resistive load $R_L$ (e.g., the radiation resistance of a transmitting antenna), then the output voltage will be $V_{out}(t)=R_l I(t)$. Therefore, ignoring the constant terms, $V_{out}(t)$ will be proportional to $e^{kv(t)}$. The exponential function may be represented by a Taylor series:

$$e^{kv(t)} = 1 + kv(t) + \frac{[kv(t)]^2}{2!} + \frac{[kv(t)]^3}{3!} + L$$

Thus, if v(t) has the form $v(t)=\cos\phi(t)\cos\omega_c t$, then $V_{out}(t)$ is given by:

$$V_{out}(t) = 1 + k\cos\phi(t)\cos\omega_c t + \frac{[k'\cos\phi(t)\cos\omega_c t]^2}{2} + \frac{[k\cos\phi(t)\cos\omega_c t]^3}{6}.$$

Expanding the equation yields:

$$V_{out}(t) = 1 + k\cos\phi(t)\cos\omega_c t + \frac{k^2\cos^2\phi(t)}{2}\cos^2\omega_c t + \frac{k^3\cos^3\phi(t)}{6}\cos^3\omega_c t$$

If $\phi(t)$ is a bi-phase modulation function (e.g., a maximal length PN code) having values 0 radians and $\pi$ radians, then $\cos\phi(t)$ will be either +1 or −1 and $\cos\phi^2(t)$ will be +1. Therefore, the equation for $V_{out}(t)$ may be simplified to:

$$V_{out}(t) = 1 + k\cos\phi(t)\cos\omega_c t + \frac{k^2}{2}\cos^2\omega_c t + \frac{k^3}{6}\cos\phi(t)\cos^3\omega_c t$$

Using the trigonometric identity $$\cos^2 x = \frac{1}{2}(1 + \cos 2x),$$

and ignoring DC and fundamental frequency terms ($\omega_c$) that may be filtered out of the return signal, the equation reduces to:

$$V_{out}(t) = \frac{k^2}{4}\cos 2\omega_c t + \frac{k^3}{12}\cos\phi(t)\cos\omega_c t\cos 2\omega_c t)$$

Using the trigonometric identity $$\cos x\cos y = \frac{\cos(x+y)}{2} + \frac{\cos(x-y)}{2},$$

we have $$V_{out}(t) = \frac{k^2}{4}\cos 2\omega_c t + \frac{k^3}{24}\cos\phi(t)[\cos 3\omega_c t + \cos\omega_c t]$$

Ignoring the fundamental frequency term again yields, $$V_{out}(t) = \frac{k^2}{4}\cos 2\omega_c t + \frac{k^3}{24}\cos\phi(t)[\cos 3\omega_c t]$$

Thus, we have a return signal with a second harmonic component ($2\omega_c$) without modulation, and a third harmonic component ($3\omega_c$) with the original bi-phase modulation $\cos\phi(t)$ intact.

What is claimed is:

1. A method of locating a golf ball with a handheld golf ball detector having a transmitter and a receiver, the method comprising:

modulating a carrier to provide a binary phase shift keyed (BPSK) modulated signal, the modulation comprising a pseudorandom binary sequence (PN) modulated on the carrier;

shielding the receiver from the transmitter;

transmitting with the transmitter the BPSK modulated signal in transmitted pulses to locate a golf ball having an RF (radio frequency) circuit;

receiving with the receiver a received signal from the golf ball, wherein the received signal is a harmonic of the transmitted pulses and wherein the received signal was despread by the golf ball's RF circuit.

2. A method as in claim 1 wherein the harmonic is a 2 times harmonic and wherein a single crystal is used to generate a reference frequency for both the transmitting and the receiving.

3. A handheld locator comprising:

a housing;

a modulator, within the housing and coupled to the signal source, the modulator to modulate a pseudorandom binary sequence (PN) on the signal source using binary phase shift keying (BPSK) modulation to produce a BPSK modulated signal;

a transmitter coupled to the modulator to transmit the BPSK modulated signal in transmitted pulses to locate an object having an RF (radio frequency) circuit, the transmitter being within the housing;

a receiver within the housing, the receiver to receive, as a received signal, a harmonic of the transmitted pulses, wherein the receiver is shielded from the transmitter and wherein the received signal was despread by the object's RF circuit.

4. A handheld locator as in claim 3 further comprising:

a frequency source coupled to the transmitter and to the receiver, the frequency source generating the signal source for the modulator and generating a reference frequency for use by the receiver, and wherein the harmonic is a 2 times harmonic.

* * * * *